US010704255B2

(12) United States Patent
Hakuta et al.

(10) Patent No.: US 10,704,255 B2
(45) Date of Patent: Jul. 7, 2020

(54) SOUNDPROOF STRUCTURE AND SOUNDPROOF STRUCTURE MANUFACTURING METHOD

(71) Applicant: FUJIFILM Corporation, Tokyo (JP)

(72) Inventors: Shinya Hakuta, Ashigara-kami-gun (JP); Shogo Yamazoe, Ashigara-kami-gun (JP); Tadashi Kasamatsu, Ashigara-kami-gun (JP); Masayuki Naya, Ashigara-kami-gun (JP)

(73) Assignee: FUJIFILM Corporation, Tokyo (JP)

( * ) Notice: Subject to any disclaimer, the term of this patent is extended or adjusted under 35 U.S.C. 154(b) by 364 days.

(21) Appl. No.: 15/802,784

(22) Filed: Nov. 3, 2017

(65) Prior Publication Data

US 2018/0051462 A1 Feb. 22, 2018

Related U.S. Application Data

(63) Continuation of application No. PCT/JP2016/068392, filed on Jun. 21, 2016.

(30) Foreign Application Priority Data

Jun. 22, 2015 (JP) ..... 2015-124639
Apr. 28, 2016 (JP) ..... 2016-090881

(51) Int. Cl.
*E04B 1/84* (2006.01)
*E04B 1/86* (2006.01)
*G10K 11/172* (2006.01)

(52) U.S. Cl.
CPC ..... *E04B 1/8404* (2013.01); *E04B 1/8409* (2013.01); *E04B 1/86* (2013.01);
(Continued)

(58) Field of Classification Search
CPC .... E04B 1/8404; E04B 1/8409; E04B 1/8209; E04B 2001/8476; E04B 2001/848;
(Continued)

(56) References Cited

U.S. PATENT DOCUMENTS 7,395,898 B2 7/2008 Yang et al.
8,109,361 B2 * 2/2012 Tsugihashi ..... F04B 39/0027 181/207
(Continued)

FOREIGN PATENT DOCUMENTS

JP 8-50489 A 2/1996
JP 2005-250474 A 9/2005
(Continued)

OTHER PUBLICATIONS

Translation of JP 2009-139555 A, accessed Dec. 27, 2019, <http://translationportal.epo.org/emtp/translate/?ACTION=description-retrieval&COUNTRY=JP&ENGINE=google&FORMAT=docdb&KIND=B2&LOCALE=en_EP&NUMBER=4998234&OPS=ops.epo.org/3.2&SRCLANG=ja&TRGLANG=en>.*
(Continued)

*Primary Examiner* — Jeremy A Luks
(74) *Attorney, Agent, or Firm* — Birch, Stewart, Kolasch & Birch, LLP

(57) ABSTRACT

A soundproof structure has a plurality of soundproof cells arranged in a two-dimensional manner. Each of the plurality of soundproof cells includes a frame formed of a frame member forming an opening and a film fixed to the frame. Two or more types of soundproof cells having different first resonance frequencies are present in the plurality of soundproof cells. A shielding peak frequency at which transmission loss is maximized is present within a range equal to or higher than a lowest frequency among first resonance frequencies of the soundproof cells and equal to or lower than
(Continued)

a highest frequency among the first resonance frequencies of the soundproof cells.

18 Claims, 19 Drawing Sheets

(52) U.S. Cl.
CPC ..... *G10K 11/172* (2013.01); *E04B 2001/848* (2013.01); *E04B 2001/8476* (2013.01)

(58) Field of Classification Search
CPC ... E04B 2001/8433; E04B 1/86; G03B 21/22; G10K 11/172
USPC ..... 181/291
See application file for complete search history.

(56) References Cited

U.S. PATENT DOCUMENTS

| | | | | |
|---|---|---|---|---|
| 8,869,933 | B1 * | 10/2014 | McKnight | G10K 11/172 181/207 |
| 10,099,317 | B2 * | 10/2018 | Hakuta | B23K 26/382 |
| 2006/0289229 | A1 * | 12/2006 | Yamaguchi | G10K 11/172 181/290 |
| 2009/0084627 | A1 * | 4/2009 | Tsugihashi | B60J 5/00 181/290 |
| 2009/0223738 | A1 * | 9/2009 | Nakamura | G10K 11/172 181/175 |
| 2011/0240402 | A1 * | 10/2011 | Chou | F16F 7/104 181/207 |
| 2014/0371698 | A1 * | 12/2014 | Chang | A61F 5/445 604/333 |

FOREIGN PATENT DOCUMENTS

| | | | |
|---|---|---|---|
| JP | 2009-139555 | A | 6/2009 |
| JP | 2009-139556 | A | 6/2009 |
| JP | 4832245 | B2 | 12/2011 |
| JP | 2012-71662 | A | 4/2012 |

OTHER PUBLICATIONS

Translation of JP 2009-139556 A, accessed Dec. 27, 2019, <http://translationportal.epo.org/emtp/translate/?ACTION=description-retrieval&COUNTRY=JP&ENGINE=google&FORMAT=docdb&KIND=B2&LOCALE=en_EP&NUMBER=5056385&OPS=ops.epo.org/3.2&SRCLANG=ja&TRGLANG=en>.*

International Preliminary Report on Patentability and Written Opinion of the International Searching Authority (forms PCT/IB/373, PCT/ISA/237 and PCT/IB/326), dated Jan. 4, 2018, for corresponding International Application No. PCT/JP2016/068392, with an English translation of the Written Opinion.

International Search Report (form PCT/ISA/210), dated Sep. 13, 2016, for corresponding International Application No. PCT/JP2016/068392, with an English translation.

Japanese Office Action dated Jan. 8, 2019 issued in corresponding Japanese Patent Application No. 2017-524922, with English translation.

* cited by examiner

SOUNDPROOF STRUCTURE AND SOUNDPROOF STRUCTURE MANUFACTURING METHOD

CROSS-REFERENCE TO RELATED APPLICATIONS

This application is a Continuation of PCT International Application No. PCT/JP2016/68392 filed on Jun. 21, 2016, which claims priority under 35 U.S.C. § 119(a) to Japanese Patent Application No. 2015-124639 filed on Jun. 22, 2015 and Japanese Patent Application No. 2016-090881 filed on Apr. 28, 2016. Each of the above applications is hereby expressly incorporated by reference, in its entirety, into the present application.

BACKGROUND OF THE INVENTION

1. Field of the Invention

The present invention relates to a soundproof structure, and more particularly to a soundproof structure in which two or more types of soundproof cells having different effective hardnesses, each of which has a frame and a film fixed to the frame, are arranged in a two-dimensional manner in order to strongly shield the sound of a target frequency selectively.

2. Description of the Related Art

In the case of a general sound insulation material, as the mass increases, the sound is more effectively shielded. Accordingly, in order to obtain a good sound insulation effect, the sound insulation material itself becomes large and heavy. On the other hand, in particular, it is difficult to shield the sound of low frequency components. In general, this region is called a mass law, and it is known that the shielding increases by 6 dB in a case where the frequency doubles.

Thus, most of the conventional soundproof structures are disadvantageous in that the soundproof structures are large and heavy due to sound insulation by the mass of the structures and that it is difficult to shield low frequencies.

For this reason, as a sound insulation material corresponding to various situations, such as equipment, automobiles, and general households, a light and thin sound insulation structure has been demanded. In recent years, therefore, a sound insulation structure for controlling the vibration of a film by attaching a frame to a thin and light film structure has been drawing attention (refer to JP4832245B, U.S. Pat. No. 7,395,898B (corresponding Japanese Patent Application Publication: JP2005-250474A), and JP2009-139556A).

In the case of these structures, the principle of sound insulation is a stiffness law different from the mass law described above. Accordingly, low frequency components can be further shielded even with a thin structure. This region is called a stiffness law, and the behavior is the same as in a case where a film has a finite size matching a frame opening since the film vibration is fixed at the frame portion.

JP4832245B discloses a sound absorber that has a frame body, which has a through-hole formed therein, and a sound absorbing material, which covers one opening of the through-hole and whose first storage modulus E1 is $9.7\times10^6$ or more and second storage modulus E2 is 346 or less (refer to abstract, claim 1, paragraphs [0005] to [0007] and [0034], and the like). The storage modulus of the sound absorbing material means a component, which is internally stored, of the energy generated in the sound absorbing material by sound absorption.

In JP4832245B, in the embodiment, by using a sound absorbing material containing a resin or a mixture of a resin and a filler as a mixing material, it is possible to obtain the peak value of the sound absorption rate in the range of 0.5 to 1.0 and the peak frequency in the range of 290 to 500 Hz and to achieve a high sound absorption effect in a low frequency region of 500 Hz or less without causing an increase in the size of the sound absorber.

In addition, U.S. Pat. No. 7,395,898B (corresponding Japanese Patent Application Publication: JP2005-250474A) discloses a sound attenuation panel including an acoustically transparent two-dimensional rigid frame divided into a plurality of individual cells, a sheet of flexible material fixed to the rigid frame, and a plurality of weights, and a sound attenuation structure (refer to claims 1, 12, and 15, FIG. 4, page 4, and the like). In the sound attenuation panel, the plurality of individual cells are approximately two-dimensional cells, each weight is fixed to the sheet of flexible material so that the weight is provided in each cell, and the resonance frequency of the sound attenuation panel is defined by the two-dimensional shape of each cell individual cell, the flexibility of the flexible material, and each weight thereon.

U.S. Pat. No. 7,395,898B (corresponding Japanese Patent Application Publication: JP2005-250474A) discloses that the sound attenuation panel has the following advantages compared with the related art. That is, (1) the sound attenuation panel can be made very thin. (2) The sound attenuation panel can be made very light (with a low density). (3) The panel can be laminated together to form wide-frequency range locally resonant sonic materials (LRSM) since the panel does not follow the mass law over a wide frequency range, and in particular, this can deviate from the mass law at frequencies lower than 500 Hz. (4) The panel can be manufactured easily and inexpensively. (Refer to line 65, page 5 to line 5, page 6).

JP2009-139556A discloses a sound absorber which is partitioned by a partition wall serving as a frame and is closed by a rear wall (rigid wall) of a plate-shaped member and in which a film material (film-shaped sound absorbing material) covering an opening portion of the cavity whose front portion is the opening portion is covered, a pressing plate is placed thereon, and a resonance hole for Helmholtz resonance is formed in a region (corner portion) within a range of 20% of the size of the surface of the film-shaped sound absorbing material from the fixed end of the peripheral portion of the opening portion that is a region where the displacement of the film material due to sound waves hardly occurs. In the sound absorber, the cavity is blocked except for the resonance hole. The sound absorber performs both a sound absorbing action by film vibration and a sound absorbing action by Helmholtz resonance.

SUMMARY OF THE INVENTION

Incidentally, most of the conventional soundproof structures are disadvantageous in that the soundproof structures are large and heavy due to sound insulation by the mass of the structures and that it is difficult to shield low frequencies.

In addition, since the sound absorber disclosed in JP4832245B is light and the peak value of the sound absorption rate is as high as 0.5 or more, it is possible to achieve a high sound absorption effect in a low frequency region where the peak frequency is 500 Hz or less. However, there has been a problem that the range of selection of a sound absorbing material is narrow and accordingly it is difficult to achieve the high sound absorption effect in a low frequency region.

In addition, since the sound absorber disclosed in JP4832245B is based on the principle of absorbing sound by coupling of film vibration and back air layer, a thick frame and a back wall are required to satisfy the conditions. For this reason, a place where installation takes place or the size has been greatly limited.

Since the sound absorbing material of such a sound absorber completely blocks the through-hole of the frame body, the sound absorbing material does not allow wind or heat to pass therethrough and accordingly heat tends to accumulate on the inside. For this reason, there is a problem that this is not suitable for the sound insulation of equipment and automobiles, which is disclosed in JP4832245B in particular.

In addition, the sound insulation performance of the sound absorber disclosed in JP4832245B changes smoothly according to the usual stiffness law or mass law. For this reason, it has been difficult to effectively use the sound absorber in general equipment and/or automobiles in which specific frequency components, such as motor sounds, are often strongly generated in a pulsed manner.

In U.S. Pat. No. 7,395,898B (corresponding Japanese Patent Application Publication: JP2005-250474A), the sound attenuation panel can be made very thin and light at low density, can be used at frequencies lower than 500 Hz, can deviate from the law of mass density, and can be easily manufactured at low cost. However, as a lighter and thinner sound insulation structure required in equipment, automobiles, general households, and the like, there are the following problems.

In the sound attenuation panel disclosed in U.S. Pat. No. 7,395,898B (corresponding Japanese Patent Application Publication: JP2005-250474A), weight is essential for the film. Accordingly, since the structure becomes heavy, it is difficult to use the sound attenuation panel in equipment, automobiles, general households, and the like.

There is no easy means for placing the weight in each cell structure. Accordingly, there is no manufacturing suitability.

Since the frequency and size of shielding strongly depend on the weight of the weight and the position of the weight on the film, robustness as a sound insulation material is low. Accordingly, there is no stability.

In JP2009-139556A, since it is necessary to use both the sound absorbing action by film vibration and the sound absorbing action by Helmholtz resonance, the rear wall of the partition wall serving as a frame is blocked by the plate-shaped member. Therefore, similarly to JP4832245B, since it is not possible to pass wind and heat, heat tends to accumulate on the inside. For this reason, there is a problem that the sound absorber is not suitable for sound insulation of equipment, automobiles, and the like.

An object of the present invention is to solve the aforementioned problems of the conventional techniques and provide a soundproof structure which is light and thin, in which sound insulation characteristics such as a shielding frequency and a shielding size do not depend on the shape, which has high robustness as a sound insulation material and is stable, which is suitable for equipment, automobiles, and household applications, and which is excellent in manufacturing suitability.

In the present invention, "soundproof" includes the meaning of both "sound insulation" and "sound absorption" as acoustic characteristics, but in particular, refers to "sound insulation". "Sound insulation" refers to "shielding sound", that is, "not transmitting sound", and accordingly, includes "reflecting" sound (reflection of sound) and "absorbing" sound (absorption of sound) (refer to Sanseido Daijibin (Third Edition) and http://www.onzai.or.jp/question/soundproof.html and http://www.onzai.or.jp/pdf/new/gijutsu201312_3.pdf on the web page of the Japan Acoustological Materials Society).

Hereinafter, basically, "sound insulation" and "shielding" are referred to in a case where "reflection" and "absorption" are not distinguished from each other, and "reflection" and "absorption" are referred to in a case where "reflection" and "absorption" are distinguished from each other.

In order to achieve the aforementioned object, a soundproof structure of the present invention is a soundproof structure comprising a plurality of soundproof cells arranged in a two-dimensional manner. Each of the plurality of soundproof cells comprises a frame formed of a frame member forming an opening and a film fixed to the frame. Two or more types of soundproof cells having different first resonance frequencies are present in the plurality of soundproof cells (or the plurality of soundproof cells have two or more types of soundproof cells having different first resonance frequencies). A shielding peak frequency at which transmission loss is maximized is present within a range equal to or higher than a lowest frequency among first resonance frequencies of the soundproof cells and equal to or lower than a highest frequency among the first resonance frequencies of the soundproof cells.

Here, it is preferable that the first resonance frequency is determined by a geometric form of the frame of each soundproof cell and stiffness of the film of each soundproof cell, there are one or more shielding peak frequencies, and each shielding peak frequency is set to a frequency between the two different first resonance frequencies adjacent to each other.

It is preferable that two or more different first resonance frequencies among the first resonance frequencies of the plurality of soundproof cells are included within a range of 10 Hz to 100000 Hz.

Assuming that a circle equivalent radius of the frame is R (m), a thickness of the film is t (m), a Young's modulus of the film is E (Pa), and a density of the film is d (kg/m$^3$), it is preferable that a parameter B expressed by following Equation (1) for each of the two or more types of soundproof cells having the different first resonance frequencies is 15.47 or more and $2.350\times10^5$ or less.

$$B=t/R^2*\sqrt{(E/d)} \quad (1)$$

It is preferable that an average size of the frames of the plurality of soundproof cells is equal to or less than a wavelength size corresponding to the shielding peak frequency.

It is preferable that the two or more types of soundproof cells having the different first resonance frequencies have the two or more types of films having different film thicknesses.

It is preferable that the two or more types of soundproof cells having the different first resonance frequencies have the two or more types of frames having different frame sizes.

It is preferable that the two or more types of soundproof cells having the different first resonance frequencies have the two or more types of films having different tensions.

It is preferable that the two or more types of soundproof cells having the different first resonance frequencies are formed of the films of the same kind of film material.

It is preferable that the two or more types of soundproof cells having the different first resonance frequencies have the two or more types of films using different film materials.

It is preferable that a region where the soundproof cells having the same first resonance frequency are continuous is less than a wavelength at the shielding peak frequency.

It is preferable that the film of each of the plurality of soundproof cells has one or more through-holes the film.

It is preferable that one or more holes are a plurality of holes having the same size. It is preferable that at least 70% of one or more holes of the plurality of soundproof cells are holes having the same size.

It is preferable that sizes of one or more holes are equal to or greater than 2 μm.

It is preferable that the film is impermeable to air.

It is preferable that one hole of each soundproof cell is provided at the center of the film.

It is preferable that the film is formed of a flexible elastic material.

It is preferable that the frames of the plurality of soundproof cells are formed by one frame body covering the plurality of soundproof cells.

It is preferable that the films of the plurality of soundproof cells having the same first resonance frequency among plurality of soundproof cells are formed by one sheet-shaped film body covering the plurality of soundproof cells.

It is preferable that the plurality of soundproof cells have a first soundproof cell and a second soundproof cell having the different first resonance frequencies and that a first resonance frequency of the first soundproof cell and a higher order resonance frequency of the second soundproof cell match each other.

Here, in a case where the first resonance frequency of the first soundproof cell and the higher order resonance frequency of the second soundproof cell match each other, the soundproof structure comprising the first soundproof cell and the second soundproof cell shows a maximum absorbance, and the first resonance frequency of the first soundproof cell and the higher order resonance frequency of the second soundproof cell match each other means that a difference between the first resonance frequency of the first soundproof cell and the higher order resonance frequency of the second soundproof cell is within ±⅓ of the higher order resonance frequency of the second soundproof cell.

It is preferable that the first soundproof cell has a film of one layer covering an opening and the second soundproof cell has films of a plurality of layers each covering an opening.

It is preferable that the second soundproof cell has films of two layers and that the higher order resonance frequency of the second soundproof cell is a resonance frequency of a resonance mode in which displacements of the films of the two layers of the second soundproof cell occur in opposite directions.

It is preferable that a frame size or a frame thickness of the frame of each of the plurality of soundproof cells is a size less than ¼ of a wavelength of a sound wave.

It is preferable that the second soundproof cell has films of a plurality of layers each covering an opening and that a distance between adjacent films among the films of the plurality of layers is a size less than ¼ of a wavelength of a sound wave.

According to the present invention, it is possible to provide a soundproof structure which is light and thin, in which sound insulation characteristics such as a shielding frequency and a shielding size do not depend on the shape, which has high robustness as a sound insulation material and is stable, which is suitable for equipment, automobiles, and household applications, and which is excellent in manufacturing suitability.

In particular, according to the present invention, by using two or more types of different soundproof cells having different hardnesses of shielding structures each of which is configured to include a frame and a film, specifically, having different effective hardnesses determined by a film material (physical properties of a film, such as a Young's modulus and a density), film thickness, film size (frame size), film tension, and the like, it is possible to shield, that is, reflect and/or absorb an arbitrary desired frequency component very strongly.

That is, according to the present invention, it is possible to realize strong sound insulation simply by bonding two structures configured to include a frame and a film and having different "hardnesses", for example, bonding two types of films having different thicknesses and/or two types of films having different types (physical properties) to the same frame or by bonding the same film to frames having different sizes.

DESCRIPTION OF THE PREFERRED EMBODIMENTS

Hereinafter, a soundproof structure according to the present invention will be described in detail with reference to preferred embodiments shown in the accompanying diagrams.

Figure 1:
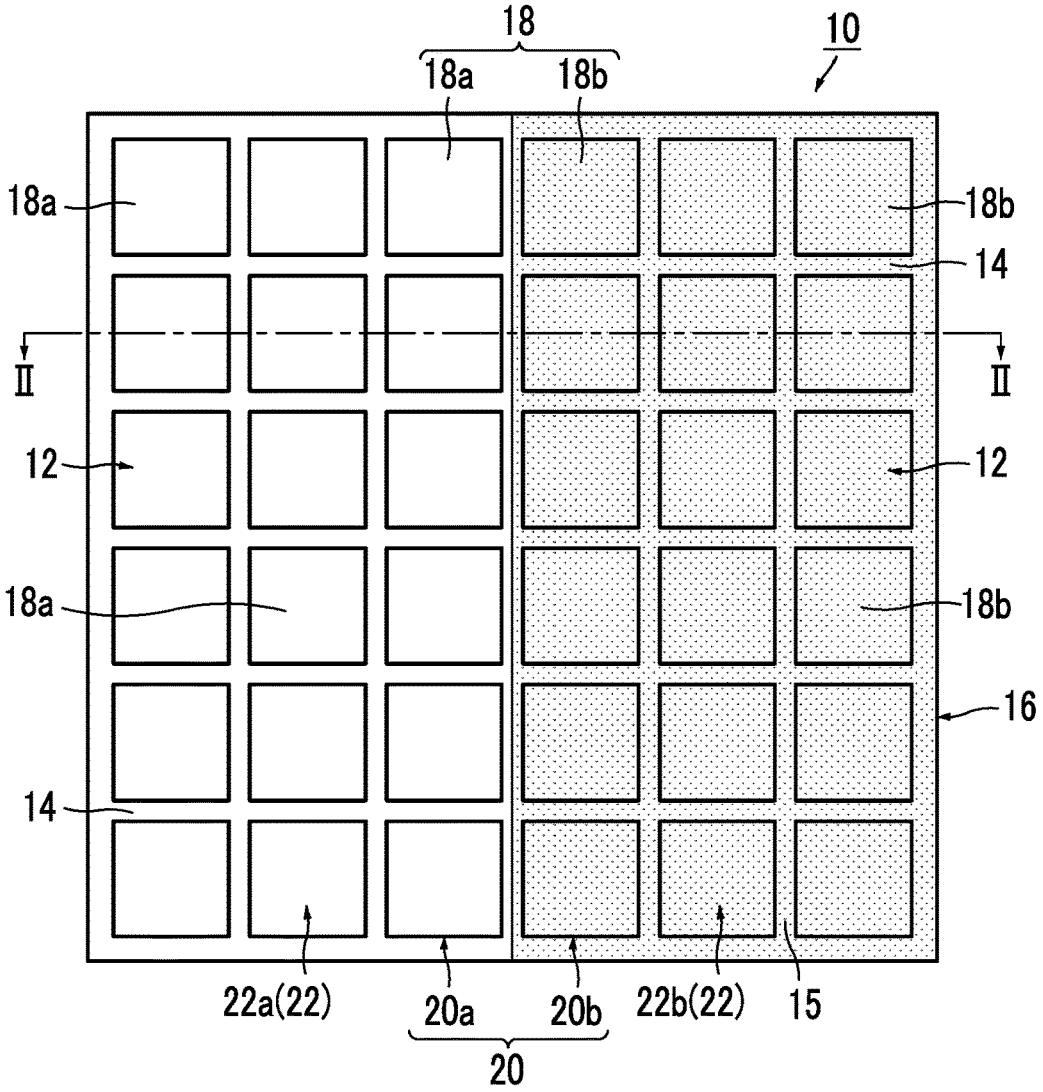
FIG. 1 is a plan view schematically showing an example of a soundproof structure according to an embodiment of the present invention.
Figure 2:
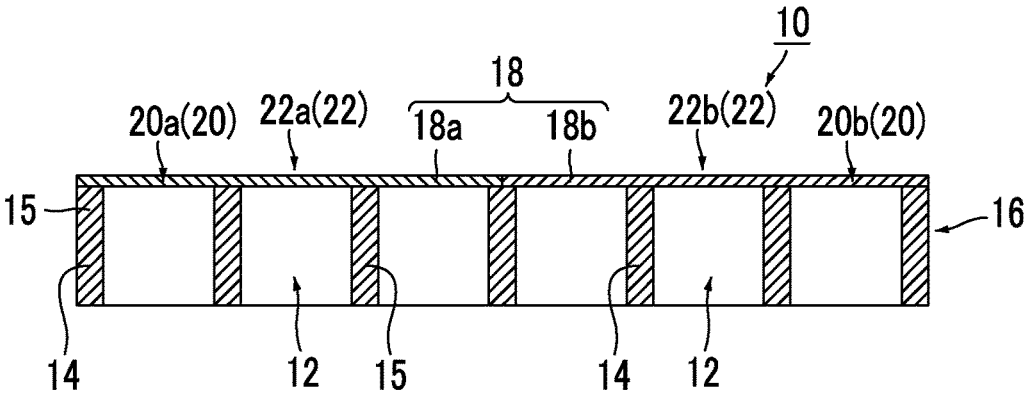
FIG. 2 is a schematic cross-sectional view of the soundproof structure shown in FIG. 1 taken along the line II-II.
Figure 3:
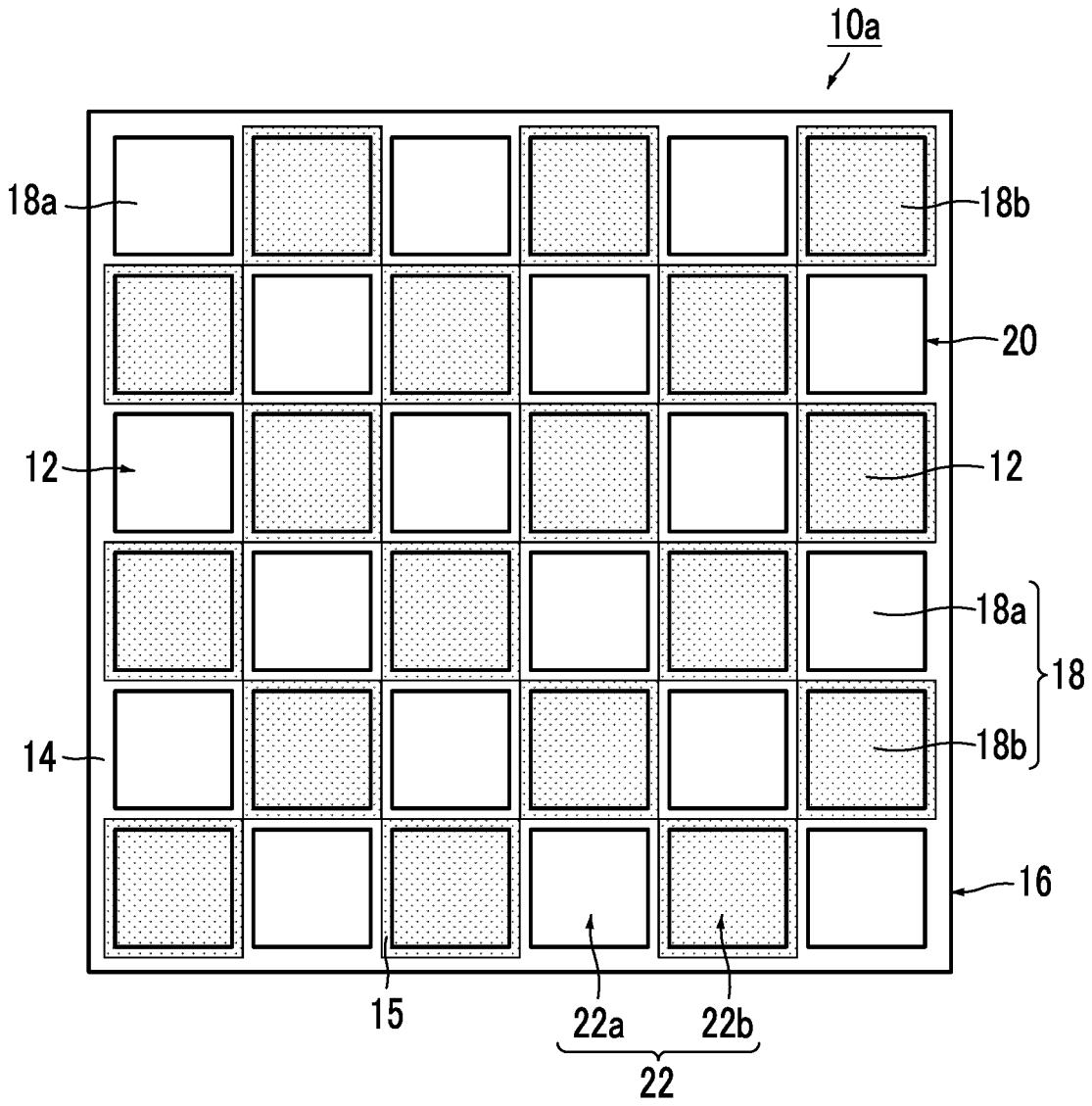
FIG. 3 is a plan view schematically showing an example of a soundproof structure according to another embodiment of the present invention.
Figure 4:
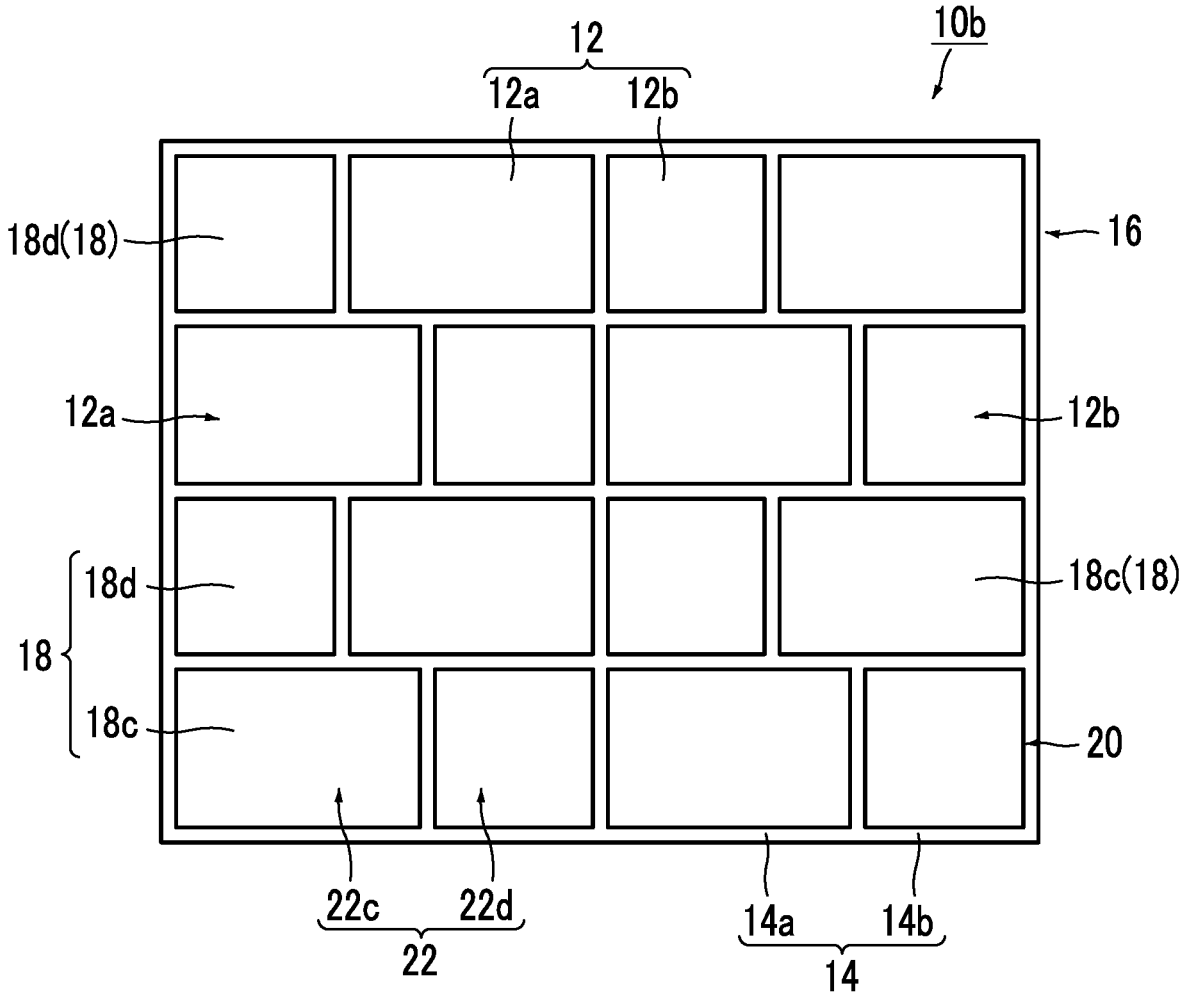
FIG. 4 is a plan view schematically showing an example of a soundproof structure according to another embodiment of the present invention.
Figure 5:
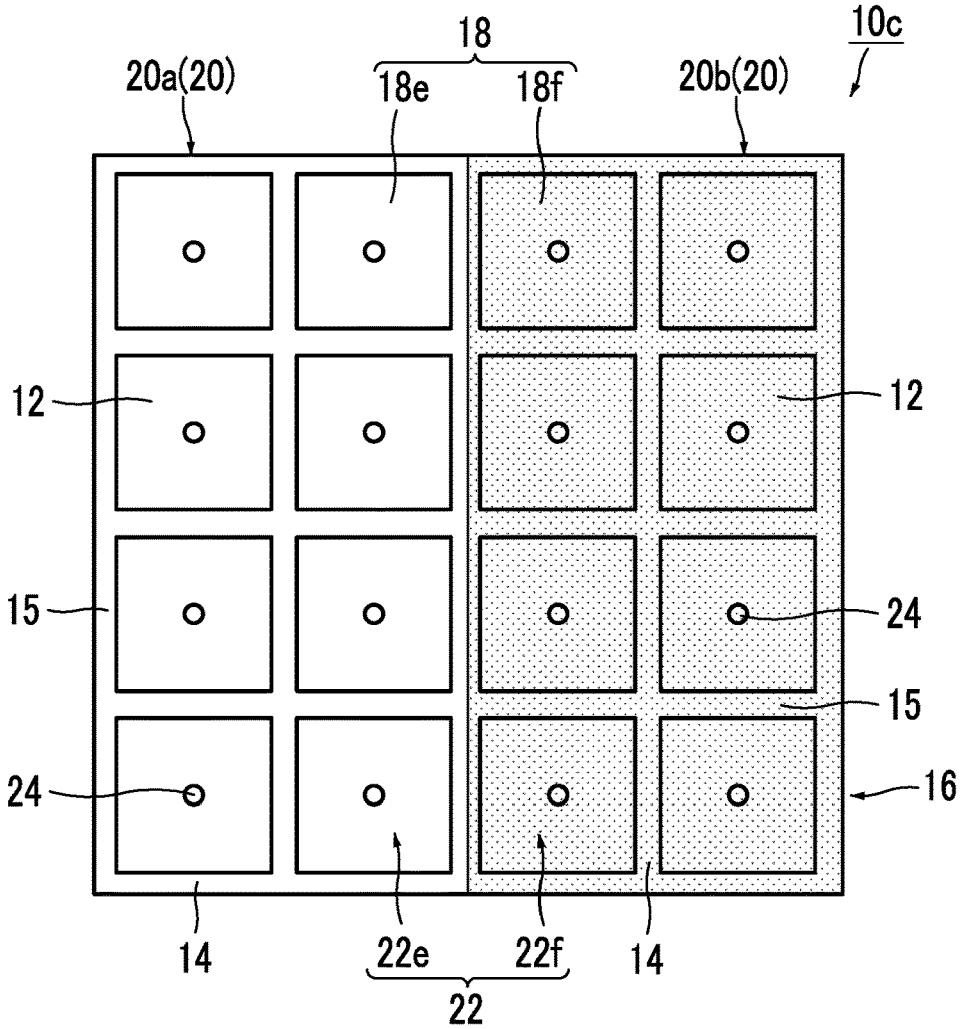
FIG. 5 is a plan view schematically showing an example of a soundproof structure according to another embodiment of the present invention.

FIG. 1 is a plan view schematically showing an example of a soundproof structure according to an embodiment of the present invention, and FIG. 2 is a schematic cross-sectional view taken along the line II-II in the soundproof structure shown in FIG. 1. FIGS. 3 to 5 are plan views schematically showing examples of soundproof structures according to other embodiments of the present invention.

A soundproof structure 10 of the present invention shown in FIGS. 1 and 2 has: a frame body 16 forming a plurality of frames 14 (in the illustrated example, 36 frames 14) each of which has an opening 12 and which are arranged in a two-dimensional manner; and a sheet-shaped film body 20 forming a plurality of films 18 (in the illustrated example, 36 films 18) which are fixed to the respective frames 14 so as to cover the openings 12 of the respective frames 14. The plurality (36) of films 18 are two types of films 18*a* and 18*b* (a plurality of films 18*a* and a plurality of films 18*b*; in the illustrated example, 18 films 18*a* and 18 films 18*b*) having different thicknesses and/or types (physical properties, such as a Young's modulus and a density). The film body 20 is formed by sheet-shaped film bodies 20*a* and 20*b* forming a plurality (18) of films 18*a* and a plurality (18) of films 18*b*, respectively.

In the soundproof structure 10 of the present embodiment, one frame 14 and the film 18 fixed to the frame 14 form one soundproof cell 22.

Accordingly, the soundproof structure 10 has a plurality of soundproof cells 22 (in the illustrated example, 36 soundproof cells 22) arranged in a two-dimensional manner. Each of the soundproof cells 22 is configured to include a plurality (18) of soundproof cells 22*a*, each of which includes the frame 14 and the film 18*a* and has a predetermined first resonance frequency, and a plurality (18) of soundproof cells 22*b*, each of which includes the frame 14 and the film 18*b* and has a predetermined first resonance frequency different from that of the soundproof cell 22*a*. The eighteen soundproof cells 22*a* and the eighteen soundproof cells 22*b* are arranged in six rows by three columns adjacent to the right side and the left side in the diagram, respectively. In the illustrated example, six soundproof cells 22*a* in the rightmost column and six soundproof cells 22*b* in the leftmost column are arranged adjacent to each other. The first resonance frequency is the lowest order resonance frequency of each of the soundproof cells 22*a* and 22*b*. In the soundproof structure 10 of the present embodiment, two types of soundproof cells 22*a* and 22*b* having different first resonance frequencies are formed by using the films 18*a* and 18*b* having different thicknesses and/or types (physical properties).

Due to the two types of soundproof cells 22*a* and 22*b* having different first resonance frequencies, the soundproof structure 10 of the present invention has a shielding peak frequency at which the transmission loss is maximized between the first resonance frequencies of the two types of soundproof cells 22*a* and 22*b*. The first resonance frequencies of the two types of soundproof cells and the shielding peak frequency indicating the shielding peak will be described later.

The soundproof structure 10 in the illustrated example is formed by two types of plural soundproof cells 22 (22*a*, 22*b*) having films having different thicknesses and types (physical properties). However, the present invention is not limited thereto, and the soundproof structure 10 may be formed by one soundproof cell 22*a* or one soundproof cell 22*b*.

In the soundproof structure 10 in the illustrated example, a plurality (18) of soundproof cells 22*a* and a plurality (18) of soundproof cells 22*b* are collectively arranged on both sides of one boundary line (in the illustrated example, on the left and right sides). However, the present invention is not limited thereto, and the soundproof cell 22*a* and the soundproof cell 22*b* may be arranged in a zigzag manner as in a soundproof structure 10*a* shown in FIG. 3. In the soundproof structure 10*a* shown in FIG. 3, the films 18*a* and 18*b* having different thicknesses and/or types (physical properties) are bonded to the frame 14 so as to cover the openings 12 of the frame 14 in a zigzag manner. Therefore, the sheet-shaped film body 20 is formed as a whole, but there are no sheet-shaped film bodies 20*a* and 20*b* in which the same kind of films 18*a* and 18*b* are continuous.

In the soundproof structure 10 shown in FIG. 1, the plurality of soundproof cells 22*a* are continuously arranged in one of the two regions and the plurality of soundproof cells 22*b* are continuously arranged in the other region different from the one region. In the soundproof structure 10*a* shown in FIG. 3, neither the soundproof cells 22*a* nor the soundproof cells 22*b* are continuously arranged, and the soundproof cells 22*b* are arranged in four directions (front and back and left and right) around the soundproof cell 22*a* and the soundproof cells 22*a* are arranged in four directions (front and back and left and right) around the soundproof cell 22*b*. However, the present invention is not limited thereto, and an intermediate arrangement between the above two types of arrangements may also be adopted. For example, there may be a region where a plurality of soundproof cells 22*a* are partially continuous and a region where a plurality of soundproof cells 22*b* are partially continuous, these regions may be arranged in a zigzag manner, or may be arranged in an intermediate state in which this arrangement and the arrangement of the soundproof cells 22*a* and 22*b* shown in FIG. 3 are mixed.

As in the soundproof structures 10 and 10*a* of the present invention, it is preferable that the number of soundproof cells 22*a* and the number of soundproof cells 22*b* (soundproof cells 22*a* and 22*b* having different effective hardnesses) are the same. However, the present invention is not limited thereto, and the number of soundproof cells 22*a* and the number of soundproof cells 22*b* may be different as long as the shielding peak frequency to be described later can be reliably present between the first resonance frequencies of the two soundproof cells 22*a* and 22*b* to be described later.

In the soundproof structure 10 of the present embodiment, the film 18*a* of the soundproof cell 22*a* and the film 18*b* of the soundproof cell 22*b* are different in the thickness and/or the type (physical properties, such as a Young's modulus and a density) of the film 18. Therefore, one soundproof cell 22*a* and the other soundproof cell 22*b* of the soundproof cell 22 of the frame-film structure, which is a combination of the frame 14 and the film 18, are two types of frame-film structures that are different in the hardness of the film as a frame-film structure. In the soundproof cell 22*a* and the soundproof cell 22*b* of the two types of frame-film structures, at a frequency at which one structure shows a behavior on the mass law side and the other structure shows a behavior on the stiffness law side, sound waves passing through the structures cancel each other. Therefore, in the soundproof structure 10 of the present embodiment, strong sound insulation can be obtained.

In the present invention, "hardness" refers to the effective hardness in the frame-film structure determined not only by the Young's modulus, which is an index of the hardness as a physical property of the film, but also by the thickness of the film and/or the film type (physical properties of the film, such as a Young's modulus and a density). In the present invention, the effective hardness may be determined not only by the thickness of the film and/or the film type (physical properties of the film, such as a Young's modulus and a density) but also by the size of the frame 14, that is, the size of the opening 12 of the frame 14, accordingly, by the size of the film 18 bonded to the frame 14.

In the example shown in FIG. 1, the soundproof cell 22 of the frame-film structure having the films 18 (18*a*, 18*b*) having different effective hardnesses is configured to include two types of soundproof cells 22*a* and 22*b*. However, the present invention is not limited thereto, and may be configured to include three or more types of soundproof cells 22 having the films 18 having different effective hardnesses. Hereinafter, two types of soundproof cells will be described as a representative example.

Since the frame 14 is formed so as to annularly surround a frame member 15 that is a thick plate-shaped member, has the opening 12 thereinside, and fixes the film 18 (18*a*, 18*b*: in the following description, assumed to be indicated by reference numeral 18 unless it is necessary to distinguishably describe them) so as to cover the opening 12 on at least one side, the frame 14 serves as a node of film vibration of the film 18 fixed to the frame 14. Therefore, the frame 14 has higher stiffness than the film 18. Specifically, both the mass and the stiffness of the frame 14 per unit area need to be high.

It is preferable that the shape of the frame 14 has a closed continuous shape capable of fixing the film 18 so as to restrain the entire outer periphery of the film 18. However, the present invention is not limited thereto, and the frame 14 may be made to have a discontinuous shape by cutting a part thereof as long as the frame 14 serves as a node of film vibration of the film 18 fixed to the frame 14. That is, since the role of the frame 14 is to fix the film 18 to control the film vibration, the effect is achieved even if there are small cuts in the frame 14 or even if there are very slightly unbonded parts.

The shape of the opening 12 formed by the frame 14 is a planar shape, and is a square in the example shown in FIG. 1. In the present invention, however, the shape of the opening 12 is not particularly limited. For example, the shape of the opening 12 may be a quadrangle such as a rectangle, a diamond, or a parallelogram, a triangle such as an equilateral triangle, an isosceles triangle, or a right triangle, a polygon including a regular polygon such as a regular pentagon or a regular hexagon, an elliptical shape, and the like, or may be an irregular shape. End portions of the frame 14 on both sides of the opening 12 are not blocked and but are open to the outside as they are. The film 18 is fixed to the frame 14 so as to cover the opening 12 in at least one opened end portion of the opening 12.

The size of the frame 14 is a size in a plan view, and can be defined as the size of the opening 12. However, in the case of a regular polygon such as a square shown in FIG. 1 or a circle, the size of the frame 14 can be defined as a distance between opposite sides passing through the center or as a circle equivalent diameter. In the case of a polygon, an ellipse, or an irregular shape, the size of the frame 14 can be defined as a circle equivalent diameter. In the present invention, the circle equivalent diameter and the radius are a diameter and a radius at the time of conversion into circles having the same area.

In the soundproof structure 10 of the present invention, in a case where two or more types of films 18 having different thicknesses and/or types (physical properties) are used, the size of the frame 14 may be fixed in all frames 14. However, frames having different sizes (including a case where shapes are different) may be included. In this case, the average size of the frames 14 may be used as the size of the frame 14.

On the other hand, in the soundproof structure 10 of the present invention, in a case where one type of film 18 having the same thickness and type (physical properties) is used, the size of the frame 14 may be two or more types of different sizes as in a soundproof structure 10*b* shown in FIG. 4.

The soundproof structure 10*b* shown in FIG. 4 has a frame body 16 having a plurality (16) of frames 14, which are a plurality of frames 14*a* (in the illustrated example, eight frames 14*a*) formed of the frame member 15 forming a rectangular opening 12*a* and a plurality of frames 14*b* (in the illustrated example, eight frames 14*b*) formed of the frame member 15 forming a rectangular opening 12*b* of which one side is a short side of the rectangular opening 12*a* and which has a different size from the opening 12*a*, and a sheet-shaped film body 20 that is formed of the same material and that is fixed to all the frames 14 so as to cover the openings 12*a* of all the frames 14*a* and the openings 12*b* of all the frames 14*b*. In the soundproof structure 10*b*, the sheet-shaped film body 20 forms a plurality (16) of films 18 of a film 18*c* covering the opening 12*a* of the frame 14*a* and a film 18*d* covering the opening 12*b* of the frame 14*b*, the frame 14*a* and the film 18*c* form a soundproof cell 22*c*, and the frame 14*b* and the film 18*d* form a soundproof cell 22*d*.

In the soundproof structure 10*b*, the frames 14*a* and 14*b*, accordingly, the films 18*c* and 18*d* form a rectangle and a square each having one side having a common length. However, the present invention is not limited thereto as long as the sizes of the frames 14*a* and 14*b*, accordingly, the sizes of the films 18 covering the openings 12 are different, and any shape and any size may be adopted.

The size of the frame 14 is not particularly limited, and may be set according to a soundproofing target to which the soundproof structures 10, 10*a*, and 10*b* (hereinafter, represented by the soundproof structure 10) of the present invention is applied, for example, a copying machine, a blower, air conditioning equipment, a ventilator, a pump, a generator, a duct, industrial equipment including various kinds of manufacturing equipment capable of emitting sound such as a coating machine, a rotary machine, and a conveyor machine, transportation equipment such as an automobile, a train, and aircraft, and general household equipment such as a refrigerator, a washing machine, a dryer, a television, a copying machine, a microwave oven, a game machine, an air conditioner, a fan, a PC, a vacuum cleaner, and an air purifier.

The soundproof structure 10 itself can also be used like a partition in order to shield sound from a plurality of noise sources. Also in this case, the size of the frame 14 can be selected from the frequency of the target noise.

As will be described in detail later, in order to obtain the natural vibration mode of the soundproof structure 10 having two types of soundproof cells 22 (22*a* and 22*b*, 22*c* and 22*d*) of frame-film structures, each of which is configured to include the frame 14 and the film 18 and which have different effective hardnesses, on the high frequency side, it is preferable to reduce the size of the frame 14.

Although the average size of the frame 14 will be described in detail, in order to prevent sound leakage due to diffraction at the shielding peak of the soundproof structure 10 due to the two types of soundproof cells 22 (22*a* and 22*b*, 22*c* and 22*d*), it is preferable that the average size of the frame 14 is equal to or less than the wavelength size corresponding to a shielding peak frequency to be described later.

For example, even in the case of frames 14*a* and 14*b* having different sizes, the size of the frame 14 is preferably 0.5 mm to 200 mm, more preferably 1 mm to 100 mm, and most preferably 2 mm to 30 mm.

Except for a case where the effective hardness of the frame-film structure of the soundproof cell 22 is made to change with the size of the frame 14, the size of the frame 14 may be expressed by an average size in a case where different sizes are included in each frame 14.

In addition, the width and the thickness of the frame 14 are not particularly limited as long as the film 18 can be fixed so as to be reliably restrained and accordingly the film 18 can be reliably supported. For example, the width and the thickness of the frame 14 can be set according to the size of the frame 14.

For example, in a case where the size of the frame 14 is 0.5 mm to 50 mm, the width of the frame 14 is preferably 0.5 mm to 20 mm, more preferably 0.7 mm to 10 mm, and most preferably 1 mm to 5 mm.

In a case where the ratio of the width of the frame 14 to the size of the frame 14 is too large, the area ratio of the frame 14 with respect to the entire structure increases. Accordingly, there is a concern that the soundproof structure 10 as a device will become heavy. On the other hand, in a case where the ratio is too small, it is difficult to strongly fix the film with an adhesive or the like in the frame 14 portion.

In a case where the size of the frame 14 exceeds 50 mm and is equal to or less than 200 mm, the width of the frame 14 is preferably 1 mm to 100 mm, more preferably 3 mm to 50 mm, and most preferably 5 mm to 20 mm.

In addition, the thickness of the frame 14 is preferably 0.5 mm to 200 mm, more preferably 0.7 mm to 100 mm, and most preferably 1 mm to 50 mm.

It is preferable that the width and the thickness of the frame 14 are expressed by an average size, for example, in a case where different widths and thicknesses are included in each frame 14.

In the present invention, it is preferable that a plurality of frames 14, that is, two or more frames 14 are formed as the frame body 16 arranged so as to be connected in a two-dimensional manner, preferably, as one frame body 16.

Here, the number of frames 14 of the soundproof structure 10 of the present invention, that is, the number of frames 14 forming the frame body 16 in the illustrated example, is 36. However, the number of frames 14 is not particularly limited, and may be set according, to the above-described soundproofing target of the soundproof structure 10 of the present invention. Alternatively, since the size of the frame 14 described above is set according to the above-described soundproofing target, the number of frames 14 may be set according to the size of the frame 14.

For example, in the case of in-device noise shielding, the number of frames 14 is preferably 1 to 10000, more preferably 2 to 5000, and most preferably 4 to 1000.

The reason is as follows. For the size of general equipment, the size of the equipment is fixed. Accordingly, in order to set the size of one soundproof cell 22 (22*a* and 22*b*, 22*c* and 22*d*) to a size suitable for the frequency of noise, it is often necessary to perform shielding (reflection and/or absorption) with the frame body 16 obtained by combining a plurality of soundproof cells 22. In addition, by increasing the number of soundproof cells 22 too much, the total weight is increased by the weight of the frame 14. On the other hand, in a structure such as a partition that is not limited in size, it is possible to freely select the number of frames 14 according to the required overall size.

In addition, since one soundproof cell 22 has one frame 14 as a structural unit, the number of frames 14 of the soundproof structure 10 of the present invention is the number of soundproof cells 22.

The material of the frame 14, that is, the material of the frame body 16, is not particularly limited as long as the material can support the film 18, has a suitable strength in the case of being applied to the above soundproofing target, and is resistant to the soundproof environment of the soundproofing target, and can be selected according to the soundproofing target and the soundproof environment. For example, as materials of the frame 14, metal materials such as aluminum, titanium, magnesium, tungsten, iron, steel, chromium, chromium molybdenum, nichrome molybdenum, and alloys thereof, resin materials such as acrylic resins, polymethyl methacrylate, polycarbonate, polyamideide, polyarylate, polyether imide, polyacetal, polyether ether ketone, polyphenylene sulfide, polysulfone, polyethylene terephthalate, polybutylene terephthalate, polyimide, and triacetyl cellulose, carbon fiber reinforced plastics (CFRP), carbon fiber, and glass fiber reinforced plastics (GFRP) can be mentioned.

A plurality of materials of the frame 14 may be used in combination.

Since the film 18 is fixed so as to be restrained by the frame 14 so as to cover the opening 12 inside the frame 14, the film 18 vibrates in response to sound waves from the outside. By absorbing or reflecting the energy of sound waves, the sound is insulated. For this reason, it is preferable that the film 18 is impermeable to air.

Incidentally, since the film 18 needs to vibrate with the frame 14 as a node, it is necessary that the film 18 is fixed to the frame 14 so as to be reliably restrained by the frame 14 and accordingly becomes an antinode of film vibration, thereby absorbing or reflecting the energy of sound waves to insulate sound. For this reason, it is preferable that the film 18 is formed of a flexible elastic material.

Therefore, the shape of the film 18 is the shape of the opening 12 of the frame 14. In addition, the size of the film 18 is the size of the frame 14. More specifically, the size of the film 18 can be said to be the size of the opening 12 of the frame 14.

As shown in FIGS. 1 to 4, the film 18 is configured to include two types of films 18*a* and 18*b* having different thicknesses and/or types (physical properties, such as a Young's modulus and a density) or to include two types of films 18*c* and 18*d* having different frame sizes, accordingly, different bonding sizes with respect to the frame 14. In the soundproof structures 10, 10*a*, and 10*b* shown in FIGS. 1 to 4, as shown in FIGS. 6 to 10, 12, and 13, two different types of films 18 (18*a* and 18*b*, 18*c* and 18*d*) fixed to the frames 14 (14*a* and 14*b*) of two types of soundproof cells 22 (22*a* and 22*b*, 22*c* and 22*d*) have different first resonance frequencies at which the transmission loss is minimized, for example, 0 dB, as frequencies of the lowest order natural vibration mode (natural vibration frequency). That is, in the present invention, sound is transmitted at the first natural vibration frequency of the film 18. Accordingly, the soundproof structures 10, 10*a*, and 10*b* of the present invention have a shielding peak frequency at which the transmission loss is maximized, that is, a shielding peak occurs, between the two first resonance frequencies of the two types of films 18.

In the soundproof structure of the present invention, two or more types of film having different sizes, thicknesses, and/or types (physical properties thereof) are provided, and accordingly two or more types of soundproof cells having different first resonance frequencies are provided. Therefore, a shielding peak frequency is present at which the transmission loss is maximized within a range that is equal to or higher than the lowest frequency among the first resonance frequencies of the respective soundproof cells and is equal to or lower than the highest frequency among the first resonance frequencies of the respective soundproof cells.

The principle of soundproofing of the soundproof structure of the present invention having such characteristics can be considered as follows.

First, as described above, the frame-film structure of the soundproof cell of the soundproof structure of the present invention has a first resonance frequency that is a frequency at which the film surface vibrates in a resonating manner to greatly transmit the sound wave. The first resonance frequency is determined by effective hardness, such as the film thickness, film type (physical properties, such as a Young's modulus and a density), and/or frame size (opening size, film) described above, and a harder structure has a resonance point at a higher frequency.

In the stiffness law region that is a frequency region equal to or lower than the first resonance frequency of the frame-film structure, the spring equation that a fixed portion in the frame pulls the film is dominant. In this case, the phase of the sound wave passing through the film is delayed by, for example, 90°. Therefore, the frame-film structure can be said to behave like a capacitor. On the other hand, in the mass law region that is a frequency region equal to or higher than the first resonance frequency, the equation of motion due to the weight of the film itself is dominant. In this case, the phase of the sound wave passing through the film advances by, for example, 90°. Therefore, the frame-film structure can be said to behave like an inductance. That is, the frame-film structure can be regarded as a structure in which a capacitor and an inductance (coil) are connected to each other.

Here, since the sound wave is also based on the wave phenomenon, the amplitude of the wave due to interference is strengthened or canceled. Since the phase-delayed wave transmitted through the frame-film structure (soundproof cell) indicating the stiffness law and the phase-advancing wave transmitted through another frame-film structure (soundproof cell) showing the mass law have opposite phases, the phase-delayed wave and the phase-advancing wave are canceled. Therefore, in a frequency region interposed between the two first resonance frequencies of two different frame-film structures (soundproof cells), waves are canceled. In particular, at a frequency at which sound waves transmitted through each frame-film structure are equal in amplitude, the waves are equal in amplitude and have opposite phases. As a result, very large shielding occurs.

That is, it is possible to realize strong sound insulation simply by using frame-film structures (soundproof cells) that are two structures having different effective "hardnesses", for example, simply by bonding two types of films having the same frame and different thicknesses and/or two types of films having different physical properties.

This is the principle of soundproofing of the soundproof structure of the present invention.

Such a feature of the present invention is that two or more types of frame-film structures (soundproof cells) having different hardnesses are preferably provided and that the material or thickness of the film can be selected variously according to the application. Therefore, in the soundproof structure of the present invention, since films having various properties can be used as films to be bonded to a frame, for example, it is possible to easily provide a soundproof structure having a function combined with other physical properties or characteristics, such as flame retardancy, light transmittance, and/or heat insulation.

Figure 13:
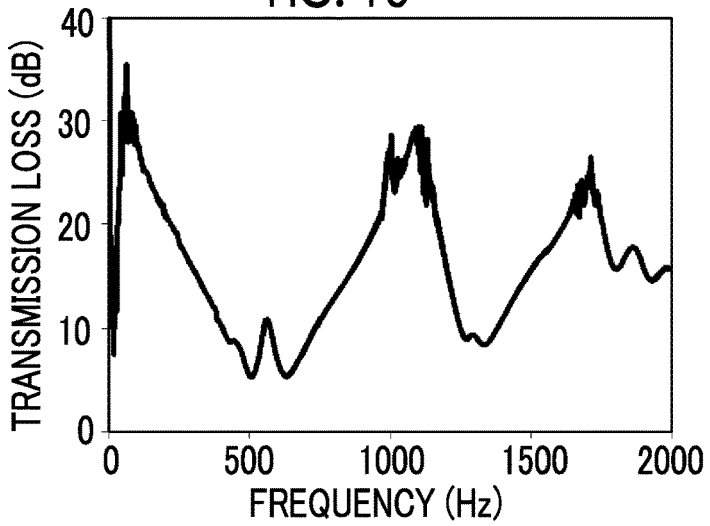
FIG. 13 is a graph showing the sound insulation characteristics of a soundproof structure of Example 2 of the present invention.

FIGS. 6 to 9 described above and FIGS. 18 and 19 are graphs showing the simulation results of sound insulation characteristics for films having different thicknesses of the soundproof structure of the present invention, films having different physical properties, films having different sizes that are bonded to frames having different sizes, and a plurality of combinations of films having different tensions, respectively. FIGS. 10 and 13 are graphs showing the sound insulation characteristics of soundproof structures of Examples 1 and 2 of the soundproof structure of the present invention, and show the transmission loss with respect to the frequency. Details of the simulation of the sound insulation characteristics of the soundproof structure of the present invention will be described later.

Here, the first resonance frequency of the film 18, which is fixed so as to be restrained by the frame 14, in the structure configured to include the frame 14 and the film 18 is a resonance frequency of the natural vibration mode, in which sound waves are largely transmitted at the frequency in a case where the sound waves cause film vibration most due to the resonance phenomenon.

Figure 6:
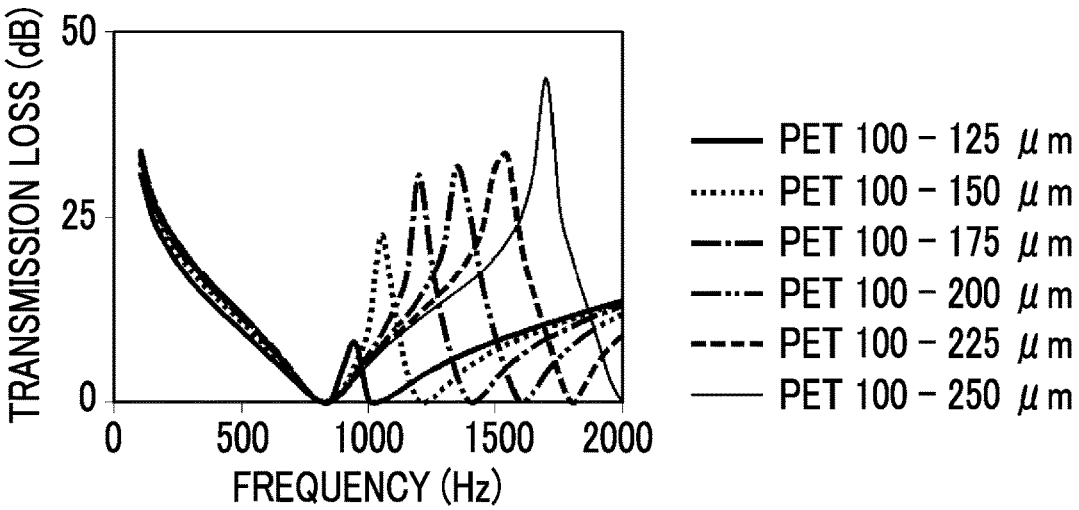
FIG. 6 is a graph showing sound insulation characteristics represented by transmission loss with respect to the frequency for a plurality of combinations of films having different thicknesses of the soundproof structure shown in FIG. 1.

For example, FIG. 6 is a graph showing the simulation results of sound insulation characteristics represented by transmission loss with respect to the frequency for a plurality of combinations of the films 18 (18*a* and 18*b*) having different thicknesses for the soundproof structure 10 shown in FIG. 1. FIG. 6 shows the transmission loss in a case where the frame 14 is a square having one side of 20 mm, the films 18*a* and 18*b* are polyethylene terephthalate (PET) films of the same type (same material and same physical properties), the thickness of one film 18*a* is set to 100 μm, and the thickness of the other film 18*b* is changed from 125 μm to 250 μm at intervals of 25 μm. In FIG. 6, for example, in the example shown by the two-dot chain line, the first resonance frequency of the soundproof cell 22*a* including one film 18*a* having a thickness of 100 μm is about 830 Hz within the audible range where the transmission loss is 0 dB, and the first resonance frequency of the soundproof cell 22*b* including the other film 18*b* is about 1610 Hz within the audible range where the transmission loss is 0 dB. At about 1360 Hz between the first resonance frequencies, a shielding peak at which the transmission loss is about 32 dB (peak value) is shown. Therefore, it is possible to selectively insulate sound in a predetermined frequency band centered on 1360 Hz that is a shielding peak frequency within the audible range.

In the example shown in FIG. 6, it can be seen that, as the thickness of the other film 18*b* increases, the first resonance frequency of the soundproof cell 22*b* due to the thickness of the film 18*b* shifts to the high frequency side and accordingly, the shielding peak frequency also shifts to the high frequency side, the shielding peak also increases, and the sound insulation becomes strong. Therefore, sound in a desired specific frequency band can be selectively insulated by appropriately selecting the combination of the thicknesses of the two different films 18*a* and 18*b*.

Figure 7:
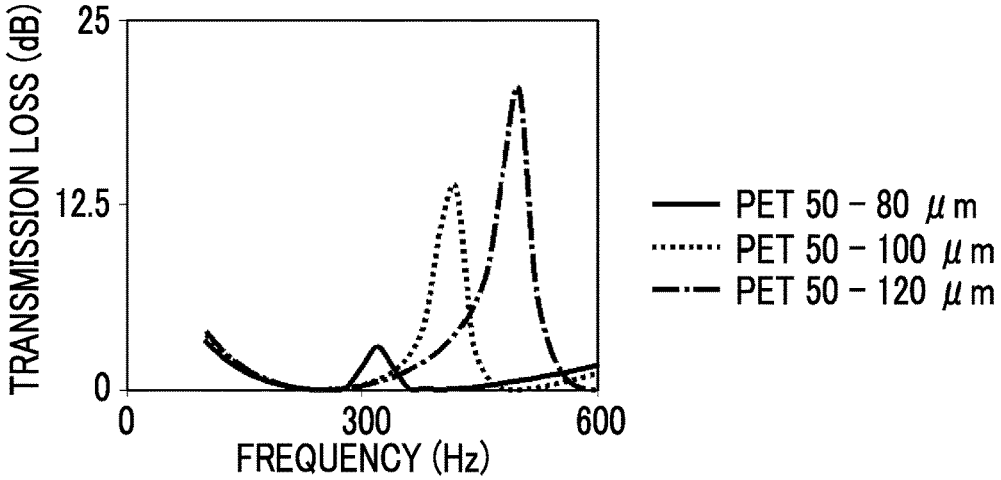
FIG. 7 is a graph showing sound insulation characteristics for a plurality of other combinations of films having different thicknesses of the soundproof structure shown in FIG. 1.

Next, FIG. 7 shows a graph showing the simulation results of sound insulation characteristics represented by transmission loss with respect to the frequency in a case where the frame 14 is a square having one side of 25 mm, the films 18*a* and 18*b* are PET films of the same type, the thickness of the film 18*a* is reduced to 50 and the thickness of the other film 18*b* is changed from 80 μm to 120 μm at intervals of 20 μm in the soundproof structure shown in FIG. 1. In the example shown in FIG. 7, compared with the example shown in FIG. 6, both the first resonance frequencies of the soundproof cells 22*a* and 22*b* can be shifted to the lower frequency side. Therefore, a shielding peak frequency indicating the shielding peak can be taken at 300 Hz to 600 Hz on the lower frequency side. Thus, in the example shown in FIG. 7, the shielding peak is lowered on the lower frequency side, but sound in a predetermined frequency band centered on the shielding peak frequency can be selectively insulated on the lower frequency side.

In the above description, FIGS. 6 and. 7 have been described as the sound insulation characteristics of the soundproof structure 10 shown in FIG. 1. However, it is confirmed in the following examples that, as long as the configurations of the soundproof cells 22*a* and 22*b* having different film thicknesses are the same, the sound insulation characteristics of the soundproof structure 10*a* shown in FIG. 3 in which both the soundproof cells 22*a* and 22*b* are arranged in a zigzag manner are the same as the sound insulation characteristics of the soundproof structure 10 shown in FIG. 1 in which both the soundproof cells 22*a* and 22*b* are completely divided into two regions using a boundary line, that is, those shown in FIGS. 6 and 7.

Here, even in the case of two types of films 18*a* and 18*b* having different thicknesses, the thickness of the film 18 is not particularly limited as long as the film can vibrate by absorbing or reflecting the energy of sound waves to insulate sound. However, it is preferable to make the film 18 thick in order to obtain a natural vibration mode on the high frequency side. In the present invention, for example, the thickness of the film 18 can be set according to the size of the frame 14, that is, the size of the film.

For example, in a case where the size of the frame 14 is 0.5 mm to 50 mm, the thickness of the film 18 is preferably 0.005 mm (5 μm) to 5 mm, more preferably 0.007 mm (7 μm) to 2 mm, and most preferably 0.01 mm (10 μm) to 1 mm.

In a case where the size of the frame 14 exceeds 50 mm and is equal to or less than 200 mm, the thickness of the film 18 is preferably 0.01 mm (10 μm) to 20 mm, more preferably 0.02 mm (20 μm) to 10 mm, and most preferably 0.05 mm (50 μm) to 5 mm.

The thickness of the film 18 is preferably expressed by an average thickness, for example, in a case where the thickness of one film 18 is different or in a case where different thicknesses are included in each film 18.

Figure 8:
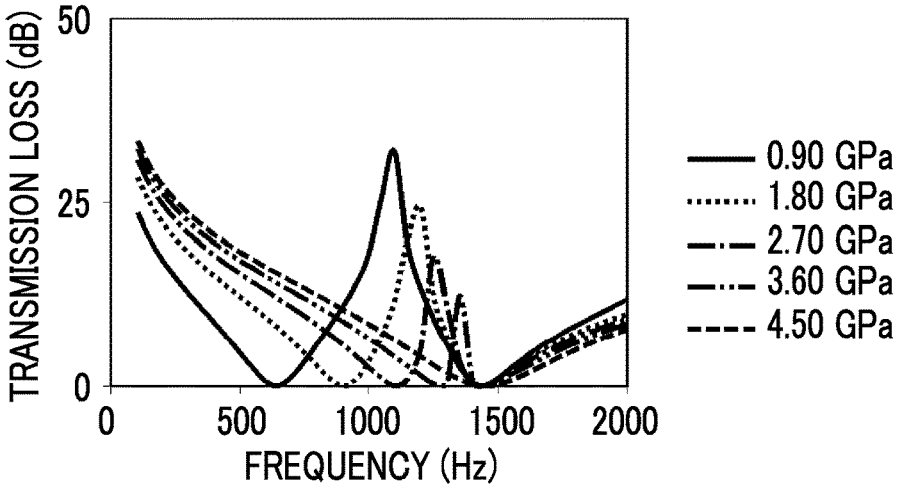
FIG. 8 is a graph showing sound insulation characteristics for a plurality of combinations of films having different physical properties of the soundproof structure shown in FIG. 1.

Next, FIG. 8 is a graph showing the simulation results of sound insulation characteristics for a plurality of combinations of the films 18 (18*a* and 18*b*) having different Young's moduli that are types, for example, physical properties of a film, for the soundproof structure 10 shown in FIG. 1. FIG. 8 shows the transmission loss in a case where the frame 14 is a square having one side of 15 mm, the films 18*a* and 18*b* are PET films having a thickness of 100 μm, the Young's modulus of one film 18*b* is set to 4.50 GPa, and the Young's modulus of the other film 18*a* is changed from 0.90 GPa to 4.50 GPa at intervals of 0.90 GPa. In this case, physical property values (for example, a density) of the PET film other than the Young's modulus are not changed. In FIG. 8, in the soundproof structure in which the Young's moduli of the films 18*a* and 18*b* are equal to 4.50 GPa, the first resonance frequencies due to the films 18*a* and 18*b* appear near the same frequency of about 1450 Hz, but the shielding peak does not appear. Accordingly, it can be seen that the soundproof structure of the present invention is not obtained. From FIG. 8, in the other soundproof structures of the present invention in which the Young's moduli of the films 18*a* and 18*b* are different, in a case where the Young's modulus of the film 18*a* is 0.90 GPa, the first resonance frequency due to the film 18*a* is on the lowest frequency side and accordingly, the shielding peak frequency is also on the lowest frequency side and the shielding peak is the highest. Therefore, it can be seen that, as the Young's modulus of the film 18*a* increases, the first resonance frequency due to the film 18*a* and the shielding peak frequency shift to the high frequency side and the shielding peak becomes low. In this manner, by making the physical properties of films, such as the Young's modulus of the film 18 of the soundproof cell 22 of the soundproof structure 10, different, it is possible to selectively insulate sound in a predetermined frequency band centered on the shielding peak frequency within the audible range.

Therefore, in the soundproof structure 10 of the present invention configured to include the frame 14 and different films 18 (18*a* and 18*b*), in order to make the shielding peak frequency present between the two first resonance frequencies depending on the different films 18*a* and 18*b* become an arbitrary frequency within the audible range, it is important to increase the difference between the two first resonance frequencies by setting the other first resonance frequency on the high frequency side with respect to one first resonance frequency. This is particularly important for practical use. For this reason, it is preferable to make the thickness of the other film 18, for example, the thickness of the film 18*b* larger than the thickness of the one film 18, for example, the thickness of the film 18*a*, to increase the difference therebetween, and it is preferable that the Young's modulus of the material of the film 18*b* is large in order to increase the difference between the films. That is, in the present invention, these preferable conditions are important. The size of the frame 14, accordingly, the size of the film 18 may be reduced.

Figure 18:
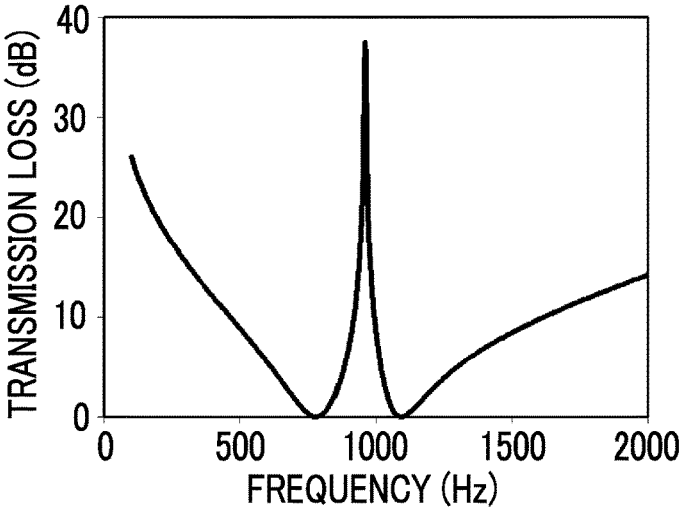
FIG. 18 is a graph showing sound insulation characteristics for a combination of films having different tensions of the soundproof structure shown in FIG. 1.

Next, FIG. 18 is a graph showing the simulation results of sound insulation characteristics represented by transmission loss with respect to the frequency for a plurality of combinations of the films 18 (18*a* and 18*b*) having different tensions for the soundproof structure 10 shown in FIG. 1. FIG. 18 shows the transmission loss in a case where the frame 14 is a square having one side of 20 mm, the film 18 is a PET film, the thickness of the film 18 is set to 100 μm, and a predetermined tension 130 (N/m) is applied to only one of the films 18*a* and 18*b*, for example, only the film 18*a*. In FIG. 18, for example, the first resonance frequency of the soundproof cell 22*a* including the other film 18*b* to which no tension is applied is about 830 Hz within the audible range where the transmission loss is 0 dB, but the first resonance frequency of the soundproof cell 22*a* including the one film 18*a* to which tension is applied is about 1100 Hz within the audible range where the transmission loss is 0 dB. At about 960 Hz between both the first resonance frequencies, a shielding peak at which the transmission loss is about 38 dB (peak value) is shown. Therefore, it is possible to selectively insulate sound in a predetermined frequency band centered on 960 Hz that is a shielding peak frequency within the audible range.

Therefore, in the soundproof structure 10 of the present invention, one frame-film structure complies with the stiffness law and the other frame-film structure complies with the mass law. In order to cause sound wave shielding at the shielding peak frequency between the two first resonance frequencies of the different films 18*a* and 18*b* fixed to the frame 14, both the two first resonance frequencies of the films 18*a* and 18*b* are preferably 10 Hz to 100000 Hz corresponding to the sound wave sensing range of a human being, more preferably 20 Hz to 20000 Hz that is the audible range of sound waves of a human being, even more preferably 40 Hz to 16000 Hz, most preferably 100 Hz to 12000 Hz.

Here, in the soundproof structure 10 of the present invention, the first resonance frequencies of the films 18*a* and 18*b* in a structure configured to include the frame 14 and the film 18 (18*a* and 18*b*) can be determined by the geometric form of the frame 14 of the plurality of soundproof cells 22, for example, the shape and size of the frame 14, and the stiffness of the film 18 (18*a* and 18*b*) of the plurality of soundproof cells 22, for example, thickness and flexibility of the film.

As a parameter characterizing the first natural vibration mode of the film 18, in the case of the film 18 of the same material, a ratio between the thickness (t) of the film 18 and the square of the size (a) of the frame 14 can be used. For example, in the case of a square, a ratio $[a^2/t]$ between the size of one side and the square of the size (a) of the frame 14 can be used. In a case where the ratio $[a^2/t]$ is the same, for example, in a case where (t, a) is (50 μm, 7.5 mm) and a case where (t, a) is (200 μm, 15 mm), the first natural vibration mode is the same frequency, that is, the same first resonance frequency. That is, by setting the ratio $[a^2/t]$ to a fixed value, the scale law is established. Accordingly, an appropriate size can be selected.

Even if the Young's moduli of both films are different, the Young's modulus of the film 18 (18*a* and 18*b*) is not particularly limited as long as the film has elasticity capable of vibrating in order to insulate sound by absorbing or reflecting the energy of sound waves. However, it is preferable to set the Young's modulus of the film 18 (18*a* and 18*b*) to be large in order to obtain a natural vibration mode on the high frequency side. In the present invention, for example, the Young's modulus of the film 18 (18*a* and 18*b*) can be set according to the size of the frame 14, that is, the size of the film 18.

For example, the Young's modulus of the film 18 (18*a* and 18*b*) is preferably 1000 Pa to 3000 GPa, more preferably 10000 Pa to 2000 GPa, and most preferably 1 MPa to 1000 GPa.

Even if the Young's moduli of both films are different, the density of the film 18 (18*a* and 18*b*) is not particularly limited either as long as the film can vibrate by absorbing or reflecting the energy of sound waves to insulate sound. For example, the density of the film 18 (18*a* and 18*b*) is preferably 10 kg/m$^3$ to 30000 kg/m$^3$, more preferably 100 kg/m$^3$ to 20000 kg/m$^3$, and most preferably 500 kg/m$^3$ to 10000 kg/m$^3$.

In a case where a film-shaped material or a foil-shaped material is used as a material of the film 18, the material of the film 18 is not particularly limited as long as the material has a strength in the case of being applied to the above soundproofing target and is resistant to the soundproof environment of the soundproofing target so that the film 18 can vibrate by absorbing or reflecting the energy of sound waves to insulate sound, and can be selected according to the soundproofing target, the soundproof environment, and the like. Examples of the material of the film 18 include resin materials that can be made into a film shape such as polyethylene terephthalate (PET), polyimide, polymethylmethacrylate, polycarbonate, acrylic (PMMA), polyamideide, polyarylate, polyetherimide, polyacetal, polyetheretherketone, polyphenylene sulfide, polysulfone, polyethylene terephthalate, polybutylene terephthalate, polyimide, triacetyl cellulose, polyvinylidene chloride, low density polyethylene, high density polyethylene, aromatic polyamide, silicone resin, ethylene ethyl acrylate, vinyl acetate copolymer, polyethylene, chlorinated polyethylene, polyvinyl chloride, polymethyl pentene, and polybutene, metal materials that can be made into a foil shape such as aluminum, chromium, titanium, stainless steel, nickel, tin, niobium, tantalum, molybdenum, zirconium, gold, silver, platinum, palladium, iron, copper, and permalloy, fibrous materials such as paper and cellulose, and materials or structures capable of forming a thin structure such as a nonwoven fabric, a film containing nano-sized fiber, porous materials including thinly processed urethane or synthrate, and carbon materials processed into a thin film structure.

The film 18 may be individually fixed to each of the plurality of frames 14 of the frame body 16 of the soundproof structure 10 to form the sheet-shaped film body 20 as a whole. Conversely, each film 18 covering each frame 14 may be formed by one sheet-shaped film body 20 fixed so as to cover all the frames 14. That is, a plurality of films 18 may be formed by one sheet-shaped film body 20 covering a plurality of frames 14. Alternatively, the film 18 covering each frame 14 may be formed by fixing a sheet-shaped film body to a part of the frame 14 so as to cover some of the plurality of frames 14, and the sheet-shaped film body 20 covering all of the plurality of frames 14 (all frames 14) may be formed by using some of these sheet-shaped film bodies.

In addition, the film 18 is fixed to the frame 14 so as to cover an opening on at least one side of the opening 12 of the frame 14. That is, the film 18 may be fixed to the frame 14 so as to cover openings on one side, the other side, or both sides of the opening 12 of the frame 14.

Here, all the films 18 may be provided on the same side of the opening 12 of the plurality of frames 14 of the soundproof structure 10. Alternatively, some of the films 18 may be provided on one side of each of some of the openings 12 of the plurality of frames 14, and the remaining films 18 may be provided on the other side of each of the remaining some openings 12 of the plurality of frames 14. Furthermore, films provided on one side, the other side, and both sides of the openings 12 of the frame 14 may be mixed.

The method of fixing the film 18 to the frame 14 is not particularly limited. Any method may be used as long as the film 18 can be fixed to the frame 14 so as to serve as a node of film vibration. For example, a method using an adhesive, a method using a physical fixture, and the like can be mentioned.

In the method of using an adhesive, an adhesive is applied onto the surface of the frame 14 surrounding the opening 12 and the film 18 is placed thereon, so that the film 18 is fixed to the frame 14 with the adhesive. Examples of the adhesive include epoxy-based adhesives (Araldite (registered trademark) (manufactured by Nichiban Co., Ltd.) and the like), cyanoacrylate-based adhesives (Aron Alpha (registered trademark) (manufactured by Toagosei Co., Ltd.) and the like), and acrylic-based adhesives.

As a method using a physical fixture, a method can be mentioned in which the film 18 disposed so as to cover the opening 12 of the frame 14 is interposed between the frame 14 and a fixing member, such as a rod, and the fixing member is fixed to the frame 14 by using a fixture, such as a screw.

Figure 9:
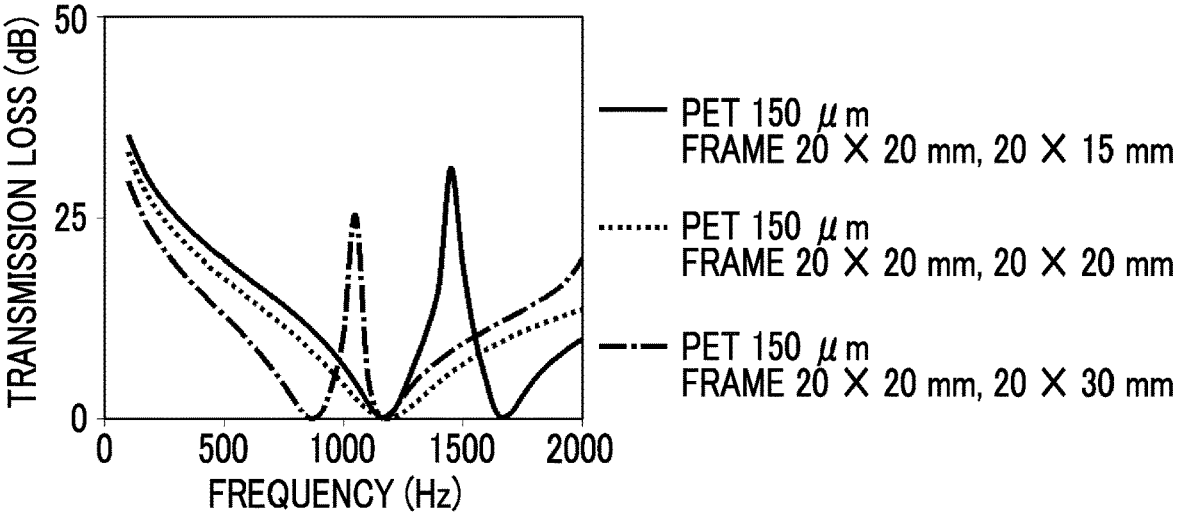
FIG. 9 is a graph showing sound insulation characteristics for a plurality of combinations of frames having different sizes of the soundproof structure shown in FIG. 4.
Figure 10:
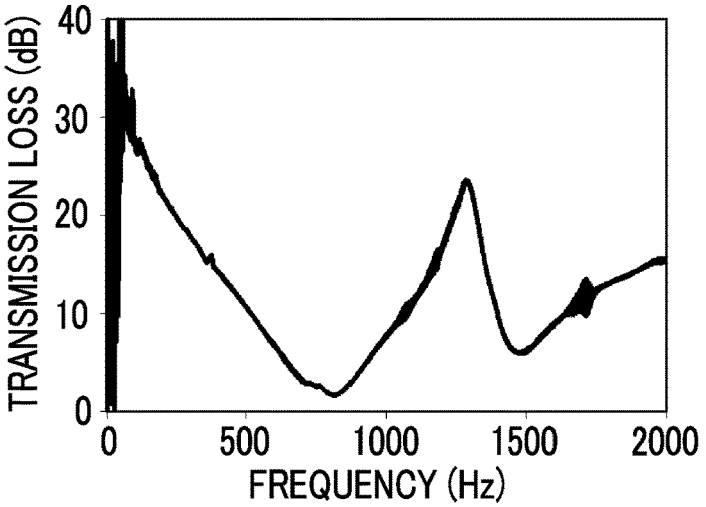
FIG. 10 is a graph showing the sound insulation characteristic of a soundproof structure of Example 1 of the present invention.

Next, FIG. 9 is a graph showing the simulation results of sound insulation characteristics for a plurality of combinations of the frames 14 (14*a* and 14*b*) having different sizes of the soundproof structure 10*b* shown in FIG. 4. FIG. 9 shows the transmission loss in a case where the film 18 (18*c* and 18*d*) is a PET film having a thickness of 100 μm, the size of the frame 14*a*, accordingly, the sizes of the opening 12*a* and the film 18*c* are changed to three types of rectangles of 20 mm (one side)×15 mm (one side), 20 mm (one side)×20 mm (one side), and 20 mm (one side)×30 mm (one side), and the size of the frame 14*b*, accordingly, the sizes of the opening 12*b* and the film 18*d* are changed to one type of square having one side of 20 mm. In FIG. 9, in the soundproof structure in which the sizes of the frames 14*a* and 14*b* are equal to each other as squares having one side of 20 mm, the first resonance frequencies of the soundproof cells 22*c* and 22*d* due to the films 18*c* and 18*d* appear near the same frequency of about 1200 Hz, but the shielding peak does not appear. Accordingly, it can be seen that the soundproof structure of the present invention is not obtained. From FIG. 9, in the soundproof structure 10*b* of the present invention in which the size of the frame 14*a* is smaller than the size of the frame 14*b*, the effective hardness of the soundproof cell 22*c* is larger than that of the soundproof cell 22*d*. Therefore, the first resonance frequency of the soundproof cell 22*c* shifts to the high frequency side. Conversely, in the soundproof structure 10*b* of the present invention in which the size of the frame 14*a* is larger than the size of the frame 14*b*, the effective hardness of the soundproof cell 22*c* is smaller than that of the soundproof cell 22*d*. Therefore, the first resonance frequency of the soundproof cell 22*c* shifts to the low frequency side. In this manner, by making the sizes of the frames 14 (films 18) of the soundproof cells 22 of the soundproof structure 10*b* different, it is possible to selectively insulate sound in a predetermined frequency band centered on the shielding peak frequency within the audible range.

Figure 19:
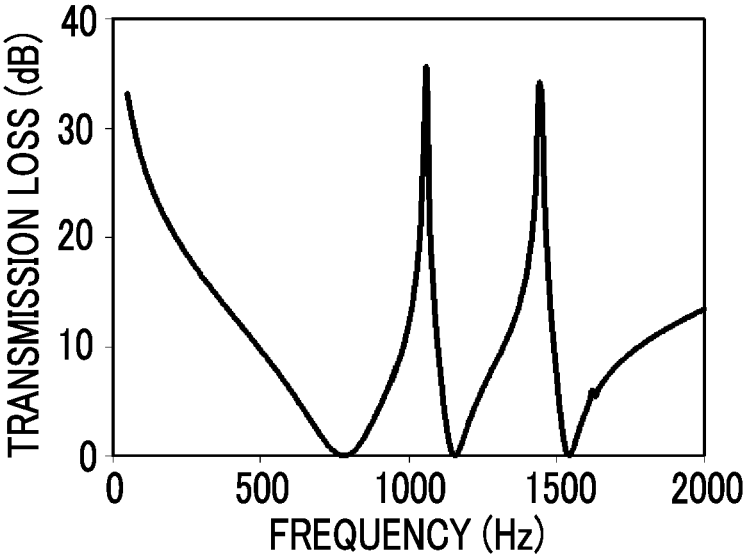
FIG. 19 is a graph showing sound insulation characteristics represented by transmission loss with respect to the frequency for three types of combinations of films having different thicknesses of the soundproof structure shown in FIG. 1.

Next, FIG. 19 is a graph showing the simulation results of sound insulation characteristics represented by transmission loss with respect to the frequency for a combination of three types of films 18 having different hardnesses for the soundproof structure of the present invention. FIG. 19 shows the transmission loss in a case where the frame 14 is a square having one side of 20 mm, the film 18 is a PET film, the thickness of the film 18 is set to three kinds of 100 μm, 150 μm, and 200 μm. In FIG. 19, the first resonance frequency of the soundproof cell 22 in which the thickness of the film 18 is 100 μm is about 830 Hz within the audible range where the transmission loss is 0 dB as described above, the first resonance frequency of the soundproof cell 22 in which the thickness of the film 18 is 150 μm is about 1150 Hz within the audible range where the transmission loss is 0 dB, and the first resonance frequency of the soundproof cell 22 in which the thickness of the film 18 is 200 μm is about 1550 Hz within the audible range where the transmission loss is 0 dB. In addition, two shielding peaks of a shielding peak, at which the transmission loss is about 34 dB (peak value) at about 1050 Hz between two adjacent first resonance frequencies of about 830 Hz and about 1150 Hz, and a shielding peak, at which the transmission loss is about 34 dB (peak value) at about 1450 Hz between two adjacent first resonance frequencies of about 1150 Hz and about 1550 Hz, are shown. Therefore, it is possible to selectively insulate sound in predetermined frequency bands having about 1050 Hz and about 1450 Hz, which are two shielding peak frequencies within the audible range, at respective centers.

As will be described in detail later, also in each of Examples 1 and 2 of the soundproof structure of the present invention shown in FIGS. 10 and 13, two first resonance frequencies due to two different types of soundproof cells (22*a* and 22*b*) appear at 500 Hz to 800 Hz and 1400 Hz to 1500 Hz within the audible range. In addition, between the two first resonance frequencies, a shielding peak frequency at which the transmission loss is maximized appears at 1000 Hz to 1300 Hz within the audible range. This shows that it is possible to selectively insulate sound in a predetermined frequency band centered on each shielding peak frequency.

Figure 11:
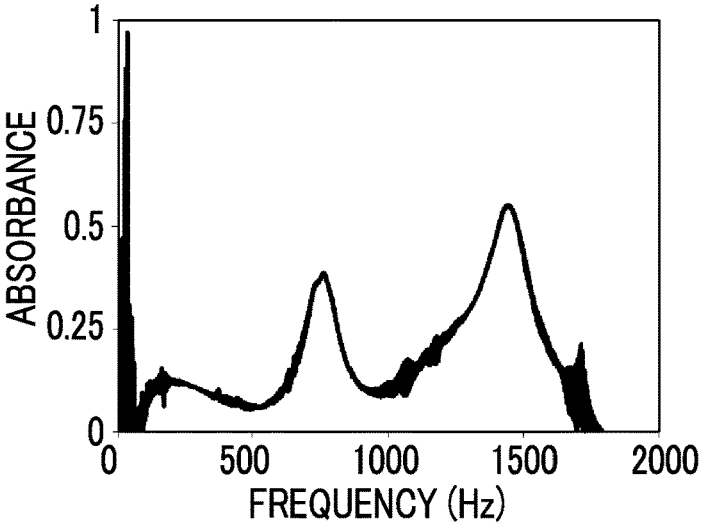
FIG. 11 is a graph showing the sound absorption characteristics of the soundproof structure of Example 1 of the present invention.
Figure 14:
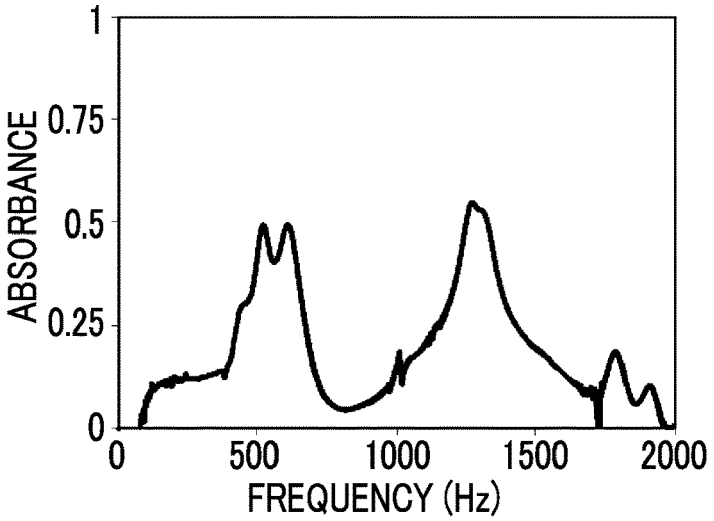
FIG. 14 is a graph showing the sound absorption characteristics of the soundproof structure of Example 2 of the present invention.

In the soundproof structure of the present invention, as shown in FIGS. 11 and 14, a maximum sound absorbance appears near each of the two first resonance frequencies corresponding to the two types of different soundproof cells (22*a* and 22*b*). As a result, broadband sound absorption is achieved.

A method of measuring the transmission loss (dB) and the absorbance in the example of the soundproof structure of the present invention will be described later.

In the above-described examples shown in FIGS. 1 to 4, the film 18 (including 18*a* and 18*b* and 18*c* and 18*d*) is bonded to the frame 14 so as to close the opening 12 (including 12*a* and 12*b*) of the frame 14 (including 14*a* and 14*b*). However, the present invention is not limited thereto, one or more through-holes 24 may be drilled in the film 18 configured to include films 18*e* and 18*f* having different sizes, thicknesses and/or types (physical properties and the like) as in the soundproof structure 10*c* of the embodiment shown in FIG. 5.

Figure 15:
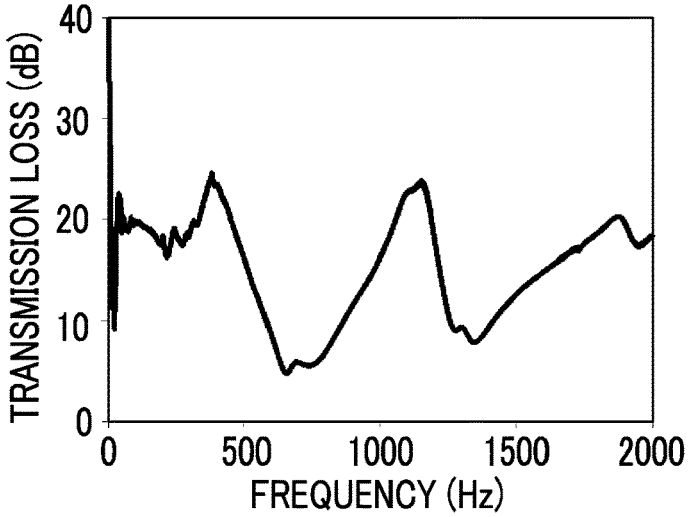
FIG. 15 is a graph showing the sound insulation characteristics of a soundproof structure of Example 3 of the present invention.

In the present invention, as shown in FIG. 15, also in the soundproof structure 10*c* of the present embodiment configured to include different soundproof cells 22*e* and 22*f* shown in FIG. 5, similarly to the soundproof structures 10, 10*a*, and 10*b* shown in FIGS. 1 to 4, the thickness and type (physical properties) of the film 18 of each of the soundproof cells 22*e* and 22*f* and/or the size of the frame 14 (size of the film 18) are made different regardless of the presence of the through-hole 24. As a result, the first resonance frequency appears in each of the soundproof cells 22*e* and 22*f*, a peak of transmission loss at which shielding is a peak (maximum) appears between the two first resonance frequencies, and a frequency at which the shielding (transmission loss) is a peak (maximum) is the shielding peak frequency.

In the soundproof structure 10*c* of the present embodiment, as shown in FIG. 15, a new shielding peak due to the through-hole 24 appears on the lower frequency side than the first resonance frequency on the low frequency side appears by providing the through-hole 24 in the soundproof cells 22*e* and 22*f*. In this manner, in the soundproof structure 10*c* of the present embodiment, not only is the shielding peak present between the two first resonance frequencies due to the two types of soundproof cells 22 having different effective hardnesses, but also a new shielding peak due to the through-hole 24 is present on the lower frequency side than the first resonance frequency on the low frequency side. Therefore, it is possible to improve sound insulation.

Figure 16:
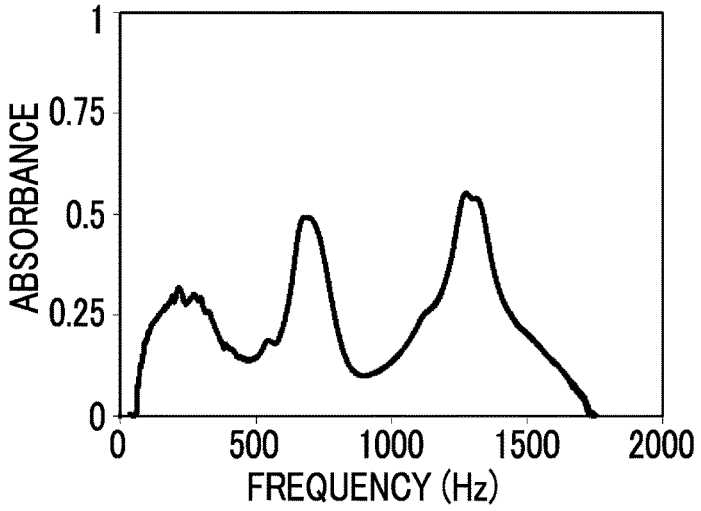
FIG. 16 is a graph showing the sound absorption characteristics of the soundproof structure of Example 3 of the present invention.

In the soundproof structure 10*c* of the present embodiment, as shown in FIG. 16, a maximum sound absorbance is present near each of the two first resonance frequencies corresponding to the two types of different soundproof cells (22*e* and 22*f*). As a result, broadband sound absorption is achieved.

Here, as shown in FIG. 5, one or two or more through-holes 24 may be drilled in the film 18 (18*e* and 18*f*) that covers the opening 12 of the soundproof cell 22 (22*e* and 22*f*). As shown in FIG. 5, the drilling position of the through-hole 24 may be the middle of the film 18, that is, the soundproof cell 22 (hereinafter, represented by the soundproof cell 22). However, the present invention is not limited thereto, the drilling position of the through-hole 24 does not need to be the middle of the soundproof cell 22 as shown in FIG. 5, and the through-hole 24 may be drilled at any position.

That is, the sound insulation characteristics of the soundproof structure 10*c* of the present embodiment are not changed simply by changing the drilling position of the through-hole 24.

In the present invention, however, it is preferable that the through-hole 24 is drilled in a region within a range away from the fixed end of the peripheral portion of the opening 12 more than 20% of the size of the surface of the film 18. Most preferably, the through-hole 24 is provided at the center of the film 18.

As shown in FIG. 5, the number of through-holes 24 in the soundproof cell 22 may be one for one soundproof cell 22. However, the present invention is not limited thereto, and two or more (that is, a plurality of) through-holes 24 may be provided.

In the soundproof structure 10*c* of the present embodiment, from the viewpoint of air permeability, as shown in FIG. 5, it is preferable that the through-hole 24 of each soundproof cell 22 is formed as one through-hole 24. The reason is that, in the case of a fixed opening ratio, the easiness of passage of air as wind is large in a case where one hole is large and the viscosity at the boundary does not work greatly.

On the other hand, in a case where a plurality of through-holes 24 are present in one soundproof cell 22, the sound insulation characteristics of the soundproof structure 10*c* of the present embodiment show sound insulation characteristics corresponding to the total area of the plurality of through-holes 24. Therefore, it is preferable that the total area of the plurality of through-holes 24 in one soundproof cell 22 (or the film 18) is equal to the area of one through-hole 24 that is only provided in another soundproof cell 22 (or the film 18). However, the present invention is not limited thereto.

In a case where the opening ratio of the through-hole 24 in the soundproof cell 22 (total area ratio of all the through-holes 24 to the area of the film 18 covering the opening 12 (ratio of the total area of all the through-holes 24)) is the same, the same soundproof structure 10*c* is obtained by the single through-hole 24 and the plurality of through-holes 24. Accordingly, even if the size of the through-hole 24 is fixed to any size, it is possible to manufacture various soundproof structures.

In the present embodiment, the opening ratio (area ratio) of the through-hole 24 (all through-holes) in the soundproof cell 22 is not particularly limited, and may be appropriately set according to the sound insulation characteristic. The opening ratio (area ratio) of the through-hole 24 in the soundproof cell 22 is preferably 0.000001% to 70%, more preferably 0.000005% to 50%, and most preferably 0.00001% to 30%. By setting the opening ratio of all the through-holes 24 within the above range, it is possible to appropriately adjust the sound insulation peak frequency, which is the center of the sound insulation frequency band to be selectively insulated, and the transmission loss at the sound insulation peak.

From the viewpoint of manufacturing suitability, it is preferable that the soundproof structure 10*c* of the present embodiment has a plurality of through-holes 24 having the same size in one soundproof cell 22. That is, it is preferable that a plurality of through-holes 24 having the same size are drilled in each soundproof cell 22.

In addition, in the soundproof structure 10*c* of the present embodiment, it is preferable that the through-holes 24 of all the soundproof cells 22 are holes having the same size.

In the present invention, it is preferable that the through-hole 24 is drilled using a processing method for absorbing energy, for example, laser processing, or it is preferable that the through-hole 24 is drilled using a mechanical processing method based on physical contact, for example, punching or needle processing.

Therefore, in a case where a plurality of through-holes 24 in one soundproof cell 22 or one or a plurality of through-holes 24 in all the soundproof cells 22 are made to have the same size, it is possible to continuously drill holes without changing the setting of a processing apparatus or the processing strength in the case of drilling holes by laser processing, punching, or needle processing.

In addition, as shown in FIG. 5, in the soundproof structure 10*c* of the present embodiment, the size of the through-hole 24 in the soundproof cell 22 (or the film 18) may be different for each soundproof cell 22 (or each film 18). In a case where there are through-holes 24 having different sizes for each soundproof cell 22 (or each film 18) as described above, sound insulation characteristics corresponding to the average area obtained by averaging the areas of the through-holes 24 are shown.

In addition, it is preferable that 70% or more of the through-holes 24 of each soundproof cell 22 of the soundproof structure 10 of the present invention are formed as holes having the same size.

The size of the through-hole 24 may be any size as long as the through-hole 24 can be appropriately drilled by the above-described processing method, and is not particularly limited.

However, from the viewpoint of processing accuracy of laser processing such as accuracy of laser diaphragm, processing accuracy of punching or needle processing, manufacturing suitability such as easiness of processing, and the like, the size of the through-hole 24 on the lower limit side thereof is preferably 2 μm or more, more preferably 5 μm or more, and most preferably 10 μm or more.

The upper limit of the size of the through-hole 24 needs to be smaller than the size of the frame 14. Therefore, normally, in a case where the size of the frame 14 is set to the order of mm and the size of the through-hole 24 is set to the order of μm, the upper limit of the size of the through-hole 24 does not exceed the size of the frame 14. In a case where the upper limit of the size of the through-hole 24 exceeds the size of the frame 14, the upper limit of the size of the through-hole 24 may be set to be equal to or less than the size of the frame 14.

In the examples shown in FIGS. 1 to 5, the film 18 is fixed to the frame 14 so as to cover the opening on one side of the opening 12 of the frame 14, but the present invention is not limited thereto. As in a soundproof structure 10*d* of an embodiment shown in FIG. 22, a soundproof structure configured to include a soundproof cell (hereinafter, referred to as a first soundproof cell) 22*h* in which a film 18*g* is provided on only one side of the opening 12 of the frame 14 and a soundproof cell (hereinafter, referred to as a second soundproof cell) 22*i* in which a film 18*h*, which is provided on both sides of the opening 12 of the frame 14 and has a different thickness from the film 18*g*, is provided may be used. Alternatively, as in a soundproof structure 10*e* of an embodiment shown in FIG. 23, a soundproof structure configured to include a soundproof cell (hereinafter, referred to as a first soundproof cell) 22*j* in which a film 18*i* is provided on only one side of the opening 12 of the frame 14 and a soundproof cell (hereinafter, referred to as a second soundproof cell) 22*k* in which a film 18*j*, which is provided on both sides of the opening 12 of the frame 14 and has a different frame thickness from the soundproof cell 22*j*, that is, a different size from the film 18*i*, is provided may be used.

More specifically, in the examples shown in FIGS. 1 to 5, the films 18 (18*a* and 18*b*, 18*c* and 18*d*, 18*e* and 18*f*) having different thicknesses, types (physical properties), and/or film sizes cover one side of the opening 12 of the frame 14, and two types of soundproof cells having different first resonance frequencies are combined and arranged in a two-dimensional manner. However, as in the soundproof structure 10*d* of the embodiment shown in FIG. 22, a soundproof structure obtained by combining a soundproof cell in which the film 18*g* covers only one side of the opening 12 of the frame 14, that is, the soundproof cell 22*h* including a one-layer (monolayer) film, and a soundproof cell in which the film 18*h* covers both sides of the opening 12 of the frame 14, that is, the soundproof cell 22*i* including a two-layer (multilayer) film, may be used. In addition, as shown in the soundproof structure 10*e* of the embodiment shown in FIG. 23, a soundproof structure soundproof structure obtained by combining a soundproof cell in which the film 18*i* covers only one side of the opening 12 of the frame 14, that is, the soundproof cell 22*j* including a one-layer film (monolayer film), and a soundproof cell in which the film 18*j* covers both sides of the opening 12 of the frame 14, that is, the soundproof cell 22*k* including a two-layer film (multilayer film), may be used. In the examples shown in FIG. 22 and FIG. 23, each of the soundproof cells 22*j* and 22*k* has a two-layer film. However, the present invention is not limited thereto, and a soundproof cell having a film with multiple layers of two or more layers may be adopted.

For the resonance of film vibration, there is a higher order resonance frequency in addition to the first resonance frequency. In a case where the film 18 is laminated and fixed in multiple layers so as to cover the opening 12 of the frame 14 as in the soundproof cells 22*i* and 22*k* in which the film is fixed to both sides of the opening 12 of the frame 14, resonance due to interaction of films of multiple layers also occurs.

Figure 22:
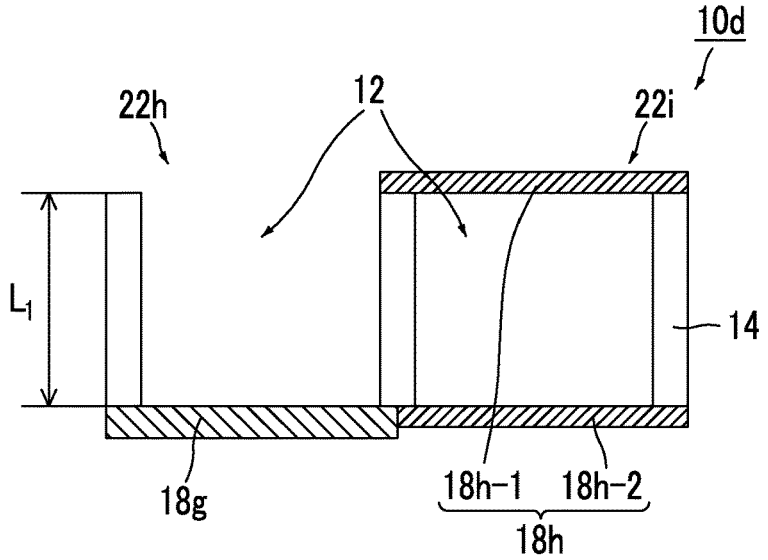
FIG. 22 is a cross-sectional view schematically showing an example of a soundproof structure according to another embodiment of the present invention.
Figure 23:
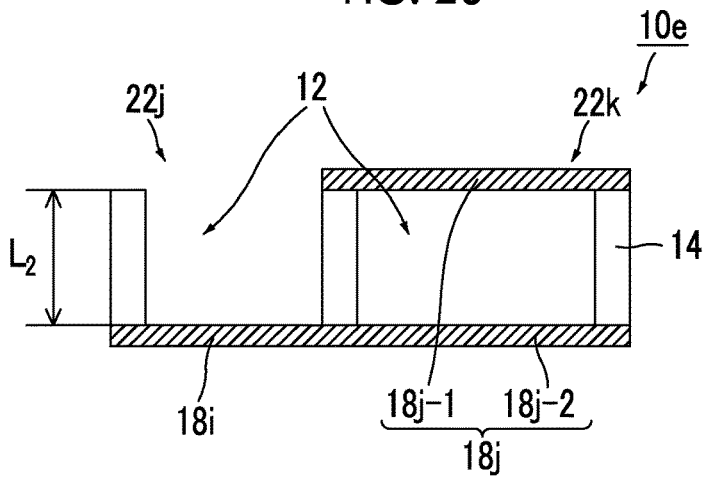
FIG. 23 is a cross-sectional view schematically showing an example of the soundproof structure according to another embodiment of the present invention.

In the embodiments shown in FIGS. 22 and 23, the soundproof cell 22 of the one-layer film 18 and the soundproof cell 22 of the two-layer film 18 (22*h* and 22*i*, 22*j* and 22*k*) having different first resonance frequencies are combined to use such an effect.

In the embodiments shown in FIGS. 22 and 23, the frame size, the frame thickness, or the distance between two layers (between films) is adjusted so that the first resonance frequency of the one-layer film of the soundproof cell (first soundproof cell) 22*h* or 22*j* matches the higher order resonance frequency of the soundproof cell (second soundproof cell) 22*j* or 22*k*.

Specifically, the film thickness, the frame size, the frame thickness, or the distance between two layers (between films) is adjusted so that the first resonance frequency of the one-layer film of the soundproof cell (first soundproof cell) 22*h* or 22*j* and the resonance frequency of the resonance mode in which the displacements of films of two layers occur in opposite directions, among resonance frequencies of the higher order mode of the soundproof cell (second soundproof cell) 22*j* or 22*k*, match each other.

As described above, by making the first resonance frequency of the first soundproof cell and the higher order resonance frequency of the second soundproof cell match each other, a soundproof structure including the first soundproof cell and the second soundproof cell, for example, a soundproof structure in which the first soundproof cell and the second soundproof cell are disposed adjacent to each other, shows a maximum sound absorbance at a specific frequency, that is, has a specific frequency indicating the maximum absorbance. The specific frequency indicating the maximum absorbance can be called a maximum absorption frequency. In this case, it can be said that the maximum absorption frequency is a higher order resonance frequency of the second soundproof cell or is approximately equal to the higher order resonance frequency of the second soundproof cell.

In the present invention, it is preferable that the "first resonance frequency of the first soundproof cell and the higher order resonance frequency of the second soundproof cell match each other" means that the difference (deviation) between the first resonance frequency of the first soundproof cell and the higher order resonance frequency of the second soundproof cell is within ±1/3 of the higher order resonance frequency of the second soundproof cell.

Such a difference between the first resonance frequency of the first soundproof cell and the higher order resonance frequency of the second soundproof cell is preferably within ±1/7 of the higher order resonance frequency of the second soundproof cell, more preferably within ±1/17 of the higher order resonance frequency of the second soundproof cell, and most preferably within ±1/33 of the higher order resonance frequency of the second soundproof cell. For example, in a case where the maximum absorption frequency indicating the maximum sound absorbance, that is, the higher order resonance frequency (for example, second order resonance frequency) of the second soundproof cell is 1650 Hz in a soundproof structure including the first soundproof cell and the second soundproof cell, the difference between the first resonance frequency of the first soundproof cell and the higher order resonance frequency (for example, second order resonance frequency) of the second soundproof cell is preferably within ±550 Hz, more preferably within ±250 Hz, even more preferably ±100 Hz, and most preferably ±50 Hz.

Through such a configuration, in the soundproof structures 10*d* and 10*e* of the embodiments shown in FIGS. 22 and 23, as in soundproof structures the embodiments 10, 10*a*, 10*b*, and 10*c* of the embodiments shown in FIGS. 1 to 5, the first resonance frequencies of two types of soundproof cells (22*h* and 22*i*, 22*j* and 22*k*) are different. Therefore, it is possible to generate a shielding peak frequency, at which the transmission loss is maximized, between the first resonance frequencies of the two types of soundproof cells.

Specifically, in the soundproof structures 10*d* and 10*e* of the embodiments shown in FIGS. 22 and 23, as in the soundproof structures 10, 10*a*, 10*b*, and 10*c* of the embodiments shown in FIGS. 1 to 5, the first resonance frequency corresponding to each of the soundproof cells 22*h* and 22*i* appears, the peak of transmission loss at which shielding is a peak (maximum) appears between the two first resonance frequencies, and a frequency at which the shielding (transmission loss) is a peak (maximum) is the shielding peak frequency.

In the soundproof structures 10*d* and 10*e* of the embodiments shown in FIGS. 22 and 23, in addition to generating the peak of transmission loss, by matching the first resonance frequency of the film vibration of one of the two types of soundproof cells having different first resonance frequencies, that is, the first resonance frequency of the film vibration of the soundproof cell of the one-layer film with the higher order resonance frequency of the film vibration of the other soundproof cell, that is, the higher order resonance frequency of the film vibration of the soundproof cell of the two-layer film, a large sound absorbance far beyond 50% that cannot be achieved in a soundproof structure configured to include a single soundproof cell can be obtained at a frequency at which both match each other, for example, at the higher order resonance frequency of the other soundproof cell. That is, a maximum absorbance can be achieved.

That is, in the soundproof structures 10*d* and 10*e* of the embodiments shown in FIGS. 22 and 23, by designing to make the first resonance frequency of the one-layer film match the higher order resonance frequency of the two-layer film, it is possible to achieve a sound absorbance far beyond 50% even if the frame size or the frame thickness of the frame of the soundproof cell and the distance between two layers (between films) are less than 1/4 of the wavelength of the sound wave.

In particular, in the soundproof structure 10*d* of the embodiment shown in FIG. 22, even if the frame size or the frame thickness of the soundproof cell is less than 1/10 of the wavelength of the sound wave, it is possible to achieve a sound absorbance of 90% or more.

In general, it is very difficult to realize an absorbance of 50% or more with a soundproof structure whose size is much smaller than the magnitude of the wavelength of the sound wave.

This can also be seen from the absorbance derived from the equation of continuity of the pressure of the sound wave shown below.

An absorbance A is determined as A=1−T−R.

A transmittance T and a reflectivity R are expressed by a transmission coefficient t and a reflection coefficient r, and $T=|t|^2$ and $R=|r|^2$ are assumed.

The equation of continuity of pressure that is the basic equation of sound waves interacting with the structure of the one-layer film is $p_I=p_T+p_R$ assuming that the incident sound pressure is $p_I$, the reflected sound pressure is $p_R$, and the transmitted sound pressure is $p_T$ ($p_I$, $p_R$, and $p_T$ are complex numbers). Since $t=p_T/p_I$ and $r=p_R/p_I$ are satisfied, the equation of continuity of pressure is expressed as follows.

$$I=t+r$$

From this, the absorbance A is calculated. Re indicates the real part of the complex number, and Im indicates the imaginary part of the complex number.

$$\begin{aligned} A &= 1-T-R = 1-|t|^2-|r|^2 = 1-|t|^2-|1-t|^2 \\ &= 1-(\mathrm{Re}(t)^2+\mathrm{Im}(t)^2)-(\mathrm{Re}(1-t))^2+\mathrm{Im}(1-t))^2) \\ &= 1-(\mathrm{Re}(t)^2+\mathrm{Im}(t)^2)-(1-2\mathrm{Re}(t)+\mathrm{Re}(t)^2+\mathrm{Im}(t))^2) \\ &= -2\mathrm{Re}(t)^2+2\mathrm{Re}(t)-2\mathrm{Im}(t)^2 \\ &= 2\mathrm{Re}(t)\times(1-\mathrm{Re}(t))-2\mathrm{Im}(t)^2 < 2\mathrm{Re}(t)\times(I-\mathrm{Re}(t)) \end{aligned}$$

The above equation is an equation of the form of 2x×(1−x), and takes the range of 0≤x≤1. In this case, it can be seen that a maximum value is obtained at the time of x=0.25 and 2x(1−x)≤0.5 is satisfied. Therefore, A<Re(t)×(1−Re(t))≤0.5 is obtained, and this shows that the absorbance in a single structure is 0.5 at the maximum.

Thus, it can be understood that the sound absorbance in the structure of one-layer film usually remains 50% or less.

Figure 25:
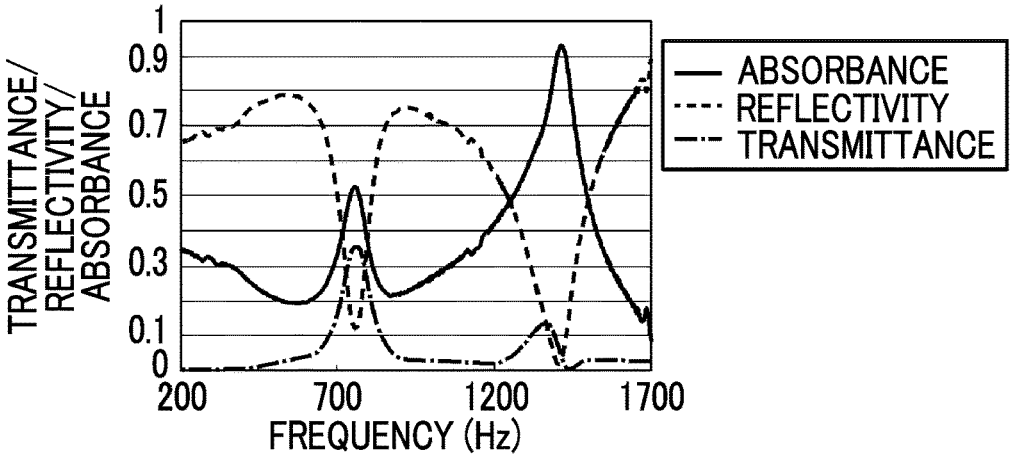
FIG. 25 is a graph showing the sound transmission characteristics, sound reflection characteristics, and sound absorption characteristics of the soundproof structure of Example 5 of the present invention.

Even in the case of a structure of a two-layer film, in a case where the distance between two layers (between films) is much smaller than the magnitude of the wavelength of sound, specifically, in a case where the distance between two layers (between films) is less than ¼ of the magnitude of the wavelength of sound, it is difficult to obtain the phases of transmitted waves canceling each other. Therefore, the sound absorbance stays about 50%. This also means that, in FIG. 25 showing the sound absorbing characteristics of a soundproof structure of Example 5 to be described later, the first resonance frequency corresponding to the soundproof cell 22*i* having a two-layer film is present at 760 Hz but the sound absorbance corresponding to the frequency is about 50%.

As described above, according to the soundproof structure of the present embodiment, it is possible to obtain a sound absorbance far beyond the absorbance in the related art simply by changing the frame size or adjusting the frame thickness.

In the soundproof structure 10*d* shown in FIG. 22, a film 18*h*-1 and a film 18*h*-2 of the soundproof cell 22*i* have the same film thickness, but films having different film thicknesses can also be used without being limited thereto.

In the soundproof structure 10*e* shown in FIG. 23, a film 18*i* of the soundproof cell 22*i* and a film 18*j*-1 and a film 18*j*-2 of the soundproof cell 22*k* have the same film thickness. However, the present invention is not limited thereto, and the film thicknesses of the film 18*i* and the film 18*j*-2 that covers one side of the opening 12 of the frame 14 of each of the two soundproof cells, and the film thickness of the soundproof cell 18*j*-1 may be different from the film thicknesses of the films 18*i* and 18*j*-2.

Incidentally, in the soundproof structures 10, 10*a*, 10*b*, and 10*c* of the present invention shown in FIGS. 1 to 5, two or more first resonance frequencies are determined by two or more types of soundproof cells 22 in which at least one of the thickness of the film 18 of the frame-film structure configured to include the frame 14 and the film 18, the type (physical properties) of the film 18, and the size of the frame 14 (size of the film 18) is different, and the shielding peak frequency at which the transmission loss is a peak is determined depending on the effective hardnesses of the two or more types of soundproof cells 22.

Figure 20:
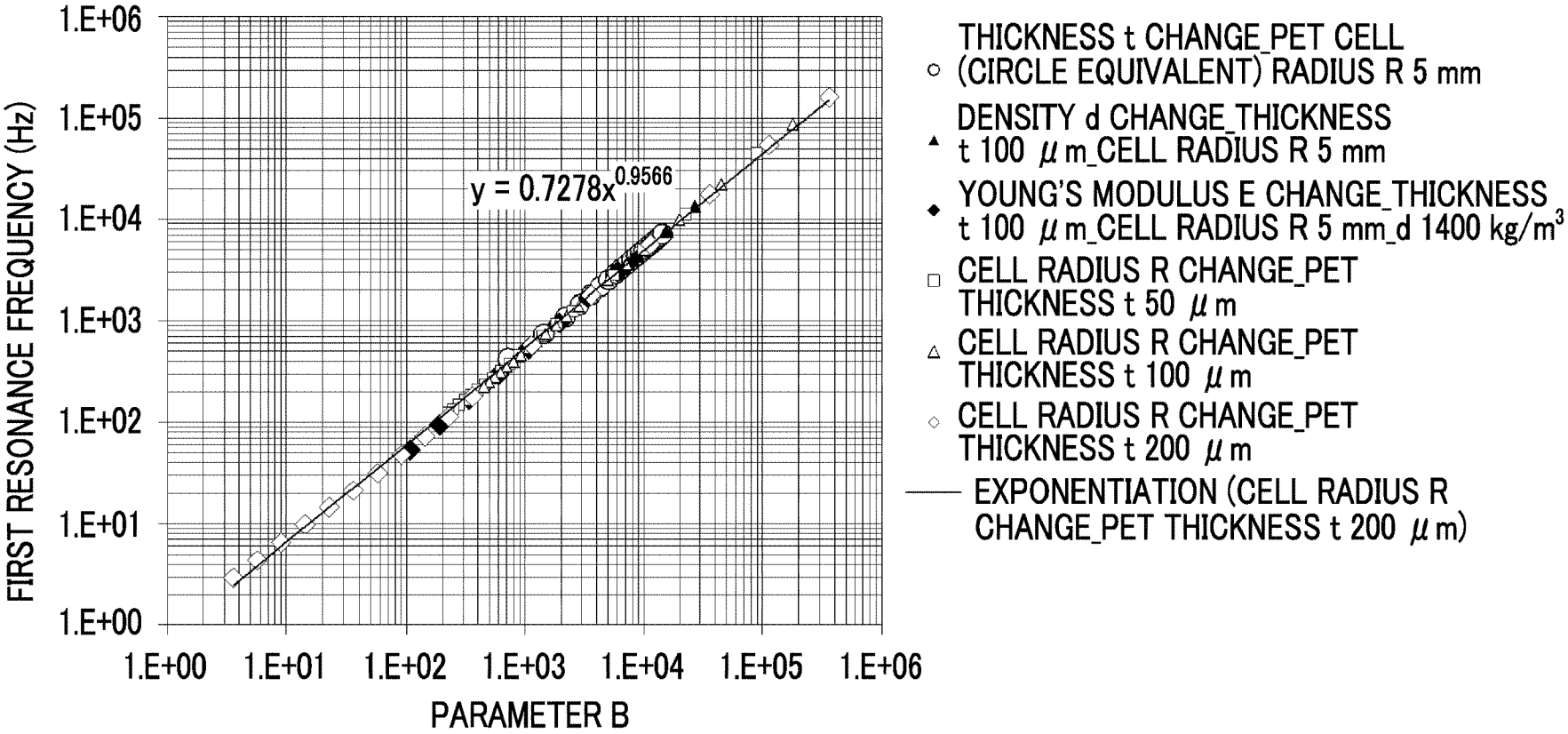
FIG. 20 is a graph showing a first resonance frequency with respect to a parameter B of the soundproof structure of the present invention having various frame shapes.
Figure 21:
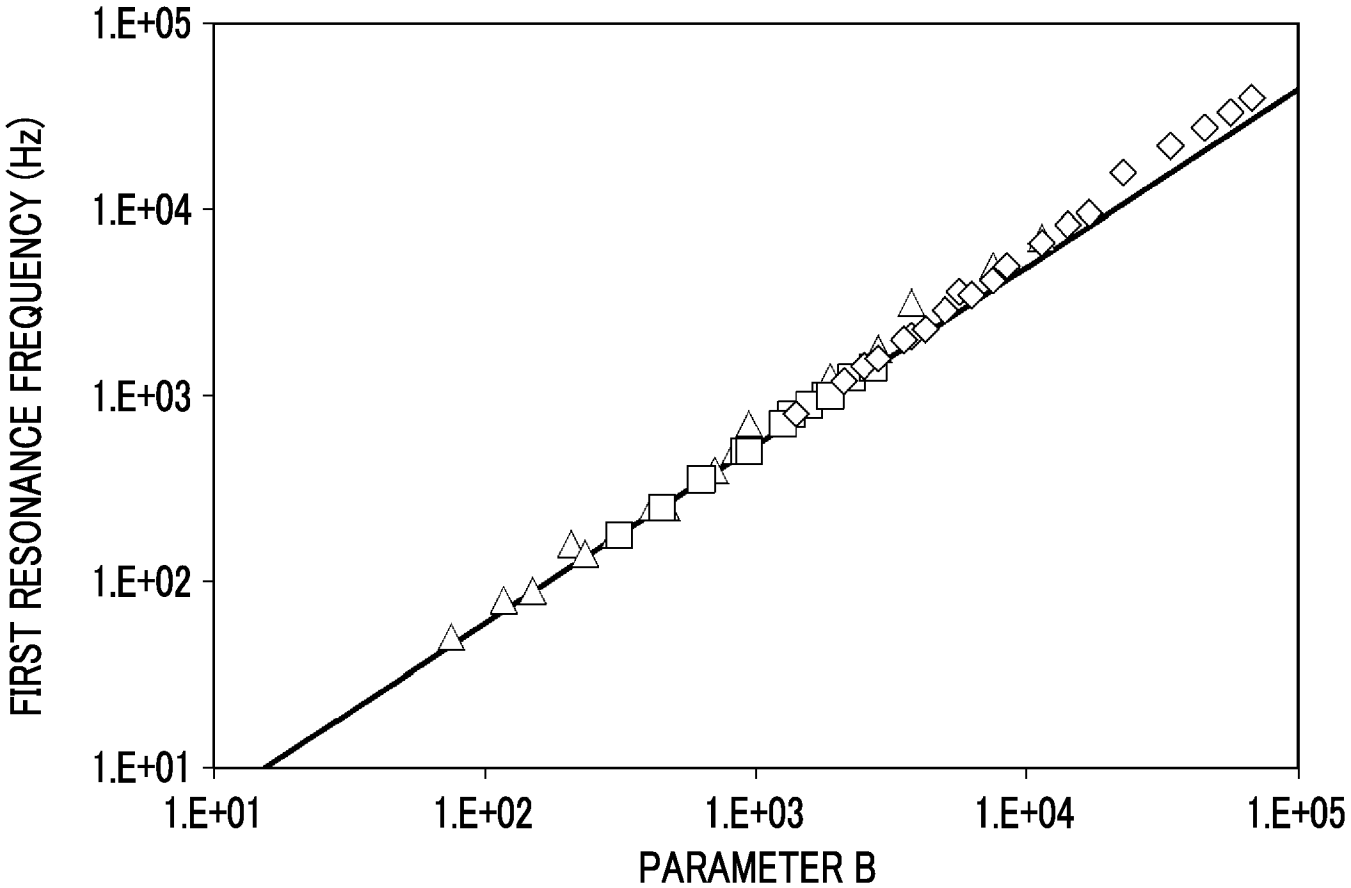
FIG. 21 is a graph showing a first resonance frequency with respect to the parameter B of the soundproof structure of the present invention having a quadrangular shape.

Here, in the soundproof cells 22 (22*a*, 22*b*, 22*c*, 22*d*, 22*e*, 22*f*) of the soundproof structures 10, 10*a*, 10*b*, and 10*c* of the present invention, the present inventors have found that, assuming that the circle equivalent radius of the frame 14 (14*a*, 14*b*) is R (m), the thickness of the film 18 (18*a*, 18*b*, 18*c*, 18*d*, 18*e*, and 18*f*) is t (m), the Young's modulus of the film 18 is E (Pa), and the density of the film 18 is d (kg/m$^3$), a parameter B (√m) expressed by the following Equation (1) and the first resonance frequency (Hz) of each soundproof cell 22 of the frame-film structure configured to include the frame 14 and the film 18 of the soundproof structure 10, 10*a*, 10*b*, and 10*c* have a substantially linear relationship and are expressed by the following Equation (2) as shown in FIGS. 20 and 21 even in a case where the circle equivalent radius R (m) of the soundproof cell 22, the thickness t (m) of the film 18, the Young's modulus E (Pa) of the film 18, and the density d (kg/m$^3$) of the film 18 are changed.

$$B=t/R^2*\sqrt{(E/d)} \quad (1)$$

$$y=0.7278x^{0.9566} \quad (2)$$

Here, y is the first resonance frequency (Hz), and x is the parameter B.

FIGS. 20 and 21 are obtained from the simulation result at the design stage before the experiment of an example to be described later.

FIG. 20 is a plot of the relationship between the first resonance frequency (Hz) and the parameter B for the soundproof cell 22 configured to include the frame 14 having the openings 12, which have various opening shapes and sizes, and the film 18 having physical properties, such as various thicknesses, densities, and Young's moduli. Since all points indicating the relationship between the parameter B and the first resonance frequency (Hz) of the soundproof structure are located on substantially the same straight line, FIG. 20 shows that the relationship is expressed by the above Equation (2) regarded as a substantially linear equation.

On the other hand, FIG. 21 is a plot of the relationship between the first resonance frequency (Hz) and the parameter B for one soundproof cell 22 configured to include the film 18 and the frame (quadrangular frame) 14 having a quadrangular shape of the soundproof structure of the present invention shown in Tables 1 to 3. FIG. 21 shows that all points indicating the relationship between the parameter B and the first resonance frequency (Hz) of the soundproof structure are on substantially the same straight line. In Tables 1 to 3, E indicates an exponential expression with 10 as a base. For example, 1.00E−04 indicates $1.00\times10^{-4}$.

From FIG. 21, it can be approximately said that, in a case where the soundproof structure of the present invention includes the soundproof cell 22 configured to include the frame (quadrangular frame) 14 having a quadrangular shape and the film 18, points indicating the relationship between the parameter B and the first resonance frequency (Hz) of the soundproof structure are located on the same straight line as the straight line expressed by the above Equation (2) regarded as a substantially linear equation shown in FIG. 20.

TABLE 1

| Film thickness t (m) | One side length L (m) of frame | Circle equivalent radius R (m) | Young's modulus E (Pa) | Density d (kg/m$^3$) of film |
|---|---|---|---|---|
| 1.00E−04 | 5.00E−03 | 2.82E−03 | 4.50E+09 | 1.40E+03 |
| 1.50E−04 | 5.00E−03 | 2.82E−03 | 4.50E+09 | 1.40E+03 |
| 2.00E−04 | 5.00E−03 | 2.82E−03 | 4.50E+09 | 1.40E+03 |
| 2.50E−04 | 5.00E−03 | 2.82E−03 | 4.50E+09 | 1.40E+03 |
| 3.00E−04 | 5.00E−03 | 2.82E−03 | 4.50E+09 | 1.40E+03 |
| 1.00E−04 | 1.00E−02 | 5.64E−03 | 4.50E+09 | 1.40E+03 |
| 1.50E−04 | 1.00E−02 | 5.64E−03 | 4.50E+09 | 1.40E+03 |
| 2.00E−04 | 1.00E−02 | 5.64E−03 | 4.50E+09 | 1.40E+03 |
| 2.50E−04 | 1.00E−02 | 5.64E−03 | 4.50E+09 | 1.40E+03 |
| 3.00E−04 | 1.00E−02 | 5.64E−03 | 4.50E+09 | 1.40E+03 |
| 1.00E−04 | 1.50E−02 | 8.46E−03 | 4.50E+09 | 1.40E+03 |
| 1.50E−04 | 1.50E−02 | 8.46E−03 | 4.50E+09 | 1.40E+03 |
| 2.00E−04 | 1.50E−02 | 8.46E−03 | 4.50E+09 | 1.40E+03 |
| 2.50E−04 | 1.50E−02 | 8.46E−03 | 4.50E+09 | 1.40E+03 |
| 3.00E−04 | 1.50E−02 | 8.46E−03 | 4.50E+09 | 1.40E+03 |
| 1.00E−04 | 2.00E−02 | 1.13E−02 | 4.50E+09 | 1.40E+03 |
| 1.50E−04 | 2.00E−02 | 1.13E−02 | 4.50E+09 | 1.40E+03 |
| 2.00E−04 | 2.00E−02 | 1.13E−02 | 4.50E+09 | 1.40E+03 |
| 2.50E−04 | 2.00E−02 | 1.13E−02 | 4.50E+09 | 1.40E+03 |
| 3.00E−04 | 2.00E−02 | 1.13E−02 | 4.50E+09 | 1.40E+03 |

TABLE 2

| Film thickness t (m) | One side length L (m) of frame | Circle equivalent radius R (m) | Young's modulus E (Pa) | Density d (kg/m$^3$) of film |
|---|---|---|---|---|
| 5.00E−05 | 2.50E−02 | 1.41E−02 | 4.50E+09 | 1.40E+03 |
| 1.00E−04 | 2.50E−02 | 1.41E−02 | 4.50E+09 | 1.40E+03 |
| 1.50E−04 | 2.50E−02 | 1.41E−02 | 4.50E+09 | 1.40E+03 |
| 2.00E−04 | 2.50E−02 | 1.41E−02 | 4.50E+09 | 1.40E+03 |
| 2.50E−04 | 2.50E−02 | 1.41E−02 | 4.50E+09 | 1.40E+03 |
| 3.00E−04 | 2.50E−02 | 1.41E−02 | 4.50E+09 | 1.40E+03 |
| 5.00E−05 | 3.00E−02 | 1.69E−02 | 4.50E+09 | 1.40E+03 |
| 1.00E−04 | 3.00E−02 | 1.69E−02 | 4.50E+09 | 1.40E+03 |
| 1.50E−04 | 3.00E−02 | 1.69E−02 | 4.50E+09 | 1.40E+03 |
| 2.00E−04 | 3.00E−02 | 1.69E−02 | 4.50E+09 | 1.40E+03 |
| 2.50E−04 | 3.00E−02 | 1.69E−02 | 4.50E+09 | 1.40E+03 |
| 3.00E−04 | 3.00E−02 | 1.69E−02 | 4.50E+09 | 1.40E+03 |

TABLE 3

| Film thickness t (m) | One side length L (m) of frame | Circle equivalent radius R (m) | Young's modulus E (Pa) | Density d (kg/m$^3$) of film |
|---|---|---|---|---|
| 5.00E−05 | 5.00E−03 | 2.82E−03 | 5.00E+08 | 1.40E+03 |
| 1.00E−04 | 5.00E−03 | 2.82E−03 | 5.00E+08 | 1.40E+03 |
| 1.50E−04 | 5.00E−03 | 2.82E−03 | 5.00E+08 | 1.40E+03 |
| 5.00E−05 | 1.00E−02 | 5.64E−03 | 5.00E+08 | 1.40E+03 |
| 1.00E−04 | 1.00E−02 | 5.64E−03 | 5.00E+08 | 1.40E+03 |
| 1.50E−04 | 1.00E−02 | 5.64E−03 | 5.00E+08 | 1.40E+03 |
| 2.50E−05 | 1.50E−02 | 8.46E−03 | 5.00E+08 | 1.40E+03 |
| 5.00E−05 | 1.50E−02 | 8.46E−03 | 5.00E+08 | 1.40E+03 |
| 1.00E−04 | 1.50E−02 | 8.46E−03 | 5.00E+08 | 1.40E+03 |
| 1.50E−04 | 1.50E−02 | 8.46E−03 | 5.00E+08 | 1.40E+03 |
| 2.50E−05 | 2.00E−02 | 1.13E−02 | 5.00E+08 | 1.40E+03 |
| 5.00E−05 | 2.00E−02 | 1.13E−02 | 5.00E+08 | 1.40E+03 |
| 1.00E−04 | 2.00E−02 | 1.13E−02 | 5.00E+08 | 1.40E+03 |
| 1.50E−04 | 2.00E−02 | 1.13E−02 | 5.00E+08 | 1.40E+03 |

TABLE 3-continued

| Film thickness t (m) | One side length L (m) of frame | Circle equivalent radius R (m) | Young's modulus E (Pa) | Density d (kg/m$^3$) of film |
|---|---|---|---|---|
| 2.50E−05 | 2.50E−02 | 1.41E−02 | 5.00E+08 | 1.40E+03 |
| 5.00E−05 | 2.50E−02 | 1.41E−02 | 5.00E+08 | 1.40E+03 |
| 1.00E−04 | 2.50E−02 | 1.41E−02 | 5.00E+08 | 1.40E+03 |
| 1.50E−04 | 2.50E−02 | 1.41E−02 | 5.00E+08 | 1.40E+03 |

From the above, in the soundproof structures 10 to 10*c* of the present invention, by standardizing the circle equivalent radius R (m) of the soundproof cell 22, the thickness t (m) of the film 18, the Young's modulus E (Pa) of the film 18, and the density d (kg/m$^3$) of the film 18 with the parameter B (√m), points indicating the relationship between the parameter B and the first resonance frequency (Hz) of the soundproof structure 10 on the two-dimensional (xy) coordinates are expressed by the above Equation (2) regarded as a substantially linear equation. Therefore, it can be seen that all points are on substantially the same straight line.

Table 1 shows the value of the parameter B for a plurality of values of the first resonance frequency from 10 Hz to $10^5$ (100000) Hz.

TABLE 4

| Frequency (Hz) | B parameter |
|---|---|
| 10 | 1.547 × 10 |
| 20 | 3.194 × 10 |
| 40 | 6.592 × 10 |
| 100 | 1.718 × $10^2$ |
| 12000 | 2.562 × $10^4$ |
| 16000 | 3.460 × $10^4$ |
| 20000 | 4.369 × $10^4$ |
| 100000 | 2.350 × $10^5$ |

As is apparent from Table 4, the parameter B corresponds to the first resonance frequency. Therefore, in the present invention, the parameter B is preferably 15.47 (1.547×10) or more and 2.350×$10^5$ or less, more preferably 31.94 (3.194×10) to 4.369×$10^4$, even more preferably 65.92 (6.592×10) to 3.460×$10^4$, and most preferably 171.8 (1.718×$10^2$) to 2.562×$10^4$.

By using the parameter B standardized as described above, in the soundproof structure of the present invention, the first resonance frequency of a soundproof cell on one side that is the lower limit on the low frequency side of the shielding peak frequency and the first resonance frequency of another soundproof cell on the other side that is the upper limit on the high frequency side of the shielding peak frequency can be determined. Therefore, it is possible to determine the shielding peak frequency that is the center of the frequency band in which sound is to be selectively insulated. Conversely, by using the parameter B, it is possible to set the soundproof structure of the present invention having two or more types of first resonance frequencies between which a shielding peak frequency that is the center of the frequency band to be selectively insulated can be set.

Since the soundproof structure of the present invention is configured as described above, the soundproof structure of the present invention has features that it is possible to perform low frequency shielding, which has been difficult in conventional soundproof structures, and that it is possible to design a structure capable of strongly insulating, noise of various frequencies from low frequencies to frequencies exceeding, 1000 Hz. In addition, since the soundproof structure of the present invention is based on the sound insulation principle independent of the mass of the structure (mass law), it is possible to realize a very light and thin sound insulation structure compared with conventional soundproof structures. Therefore, the soundproof structure of the present invention can also be applied to a soundproof target from which it has been difficult to sufficiently insulate sound with the conventional soundproof structures.

In addition, compared with most conventional sound insulation materials and sound insulation structures, the soundproof structure of the present invention may be a simple frame-film structure while the conventional sound insulation structures need to be heavy due to shielding based on the mass law. Therefore, the soundproof structure of the present invention can be made light.

In the soundproof structure of the present invention, a strong shielding peak can be obtained without using a weight that needs to be attached with a pressure sensitive adhesive later unlike in the technique disclosed in U.S. Pat. No. 7,395,898B (corresponding Japanese Patent Application Publication: JP2005-250474A). Therefore, the configuration is simpler. The soundproof structure of the present invention has a feature that a weight is not required in the frame-film structure unlike in the technique disclosed in U.S. Pat. No. 7,395,898B (corresponding Japanese Patent Application Publication: JP2005-250474A) and that a sound insulation structure with manufacturing suitability and high robustness as a sound insulation material is obtained simply by making films or frames different from each other.

In the technique disclosed in U.S. Pat. No. 7,395,898B (corresponding Japanese Patent Application Publication: JP2005-250474A), sound is insulated by the structural mechanics principle in which the average value of film vibration within a unit cell is set to 0. In the soundproof structure of the present invention, however, the sound insulation peak is generated by the acoustic wave principle in which the film itself vibrates and the sound is eliminated by the interference of transmitted sound waves. Thus, since the principles are totally different, it is possible to selectively eliminate sound having an arbitrary specific frequency, particularly, low frequency side sound.

The soundproof structure of the present invention insulates sound based on a technique which is not found in the technique disclosed in JP4832245B and in which a strong sound insulation peak is generated to eliminate a desired frequency. Therefore, it can be said that there is a large performance improvement that a strong shielding peak can be aimed at an arbitrary frequency by a simple change of combining a plurality of hardnesses of films.

In the soundproof structure of the present invention, since a technique of insulating sound by the combination of a plurality of cells is used, the soundproof structure of the present invention can be applied to various kinds of sound insulation compared with the conventional technique in which the sound insulation effect is caused by devising within one unit cell. Therefore, the soundproof structure of the present invention has high versatility.

In the soundproof structure of the present invention, as a technique for strongly shielding arbitrary frequencies of low and medium frequencies within the audible range, there is no need to add an extra structure such as a weight. Accordingly, since a frame-film structure configured to include only a frame and a film as the simplest configuration is obtained, the soundproof structure of the present invention is excellent in manufacturing suitability and superior in terms of cost.

In the soundproof structure of the present invention, since the soundproof effect is determined by the hardness, density, and/or film thickness among the physical properties and does not depend on other physical properties of the film, a combination with other various excellent physical properties, such as flame retardancy, high transparency, biocompatibility, heat insulation, and radio wave transparency, is possible. For example, for the radio wave transparency, the radio wave transparency is secured by a combination of a dielectric film and a frame material having no electrical conductivity, such as acrylic, and on the other hand, radio waves can be shielded by covering the entire surface with a metal film or a frame material having a large electrical conductivity, such as aluminum.

Hereinafter, the physical properties or characteristics of a structural member that can be combined with a soundproof member having the soundproof structure of the present invention will be described.

[Flame Retardancy]

In the case of using a soundproof member having the soundproof structure of the present invention as a soundproof material in a building or a device, flame retardancy is required.

Therefore, the film is preferably flame retardant. As the film, for example, Lumirror (registered trademark) nonhalogen flame-retardant type ZV series (manufactured by Toray Industries, Inc.) that is a flame-retardant PET film, Teijin Tetoron (registered trademark) UF (manufactured by Teijin Ltd.), and/or Dialamy (registered trademark) (manufactured by Mitsubishi Plastics Co., Ltd.) that is a flame-retardant polyester film may be used.

The frame is also preferably a flame-retardant material. A metal such as aluminum, an inorganic material such as semilac, a glass material, flame-retardant polycarbonate (for example, PCMUPY 610 (manufactured by Takiron Co., Ltd.)), and/or flame-retardant plastics such as flame-retardant acrylic (for example, Acrylite (registered trademark) FRI (manufactured by Mitsubishi Rayon Co., Ltd.)) can be mentioned.

As a method of fixing the film to the frame, a bonding method using a flame-retardant adhesive (Three Bond 1537 series (manufactured by Three Bond Co. Ltd.)) or solder or a mechanical fixing method, such as interposing a film between two frames so as to be fixed therebetween, is preferable.

[Heat Resistance]

There is a concern that the soundproofing characteristics may be changed due to the expansion and contraction of the structural member of the soundproof structure of the present invention due to an environmental temperature change. Therefore, the material forming the structural member is preferably a heat resistant material, particularly a material having low heat shrinkage.

As the film, for example, Teijin Tetoron (registered trademark) film SLA (manufactured by Teijin DuPont), PEN film Teonex (registered trademark) (manufactured by Teijin DuPont), and/or Lumirror (registered trademark) off-anneal low shrinkage type (manufactured by Toray Industries, Inc.) are preferably used. In general, it is preferable to use a metal film, such as aluminum having a smaller coefficient of thermal expansion than a plastic material.

As the frame, it is preferable to use heat resistant plastics, such as polyimide resin (TECASINT 4111 (manufactured by Enzinger Japan Co., Ltd.)) and/or glass fiber reinforced resin (TECAPEEKGF 30 (manufactured by Enzinger Japan Co., Ltd.)) and/or to use a metal such as aluminum, an inorganic material such as ceramic, or a glass material.

As the adhesive, it is preferable to use a heat resistant adhesive (TB 3732 (Three Bond Co., Ltd.), super heat resistant one component shrinkable RTV silicone adhesive sealing material (manufactured by Momentive Performance Materials Japan Ltd.) and/or heat resistant inorganic adhesive Aron Ceramic (registered trademark) (manufactured by Toagosei Co., Ltd.)). In the case of applying these adhesives to a film or a frame, it is preferable to set the thickness to 1 μm or less so that the amount of expansion and contraction can be reduced.

[Weather Resistance and Light Resistance]

In a case where the soundproof member having the soundproof structure of the present invention is disposed outdoors or in a place where light is incident, the weather resistance of the structural member becomes a problem.

Therefore, as a film, it is preferable to use a weather-resistant film, such as a special polyolefin film (ARTPLY (trademark) (manufactured by Mitsubishi Plastics Inc.)), an acrylic resin film (ACRYPRENE (manufactured by Mitsubishi Rayon Co.)), and/or Scotch Calfilm (trademark) (manufactured by 3M Co.).

As a frame member, it is preferable to use plastics having high weather resistance such as polyvinyl chloride, polymethyl methacryl (acryl), metal such as aluminum, inorganic materials such as ceramics, and/or glass materials.

As an adhesive, it is preferable to use epoxy resin based adhesives and/or highly weather-resistant adhesives such as Dry Flex (manufactured by Repair Care International).

Regarding moisture resistance as well, it is preferable to appropriately select a film, a frame, and an adhesive having high moisture resistance. Regarding water absorption and chemical resistance, it is preferable to appropriately select an appropriate film, frame, and adhesive.

[Dust]

During long-term use, dust may adhere to the film surface to affect the soundproofing characteristics of the soundproof structure of the present invention. Therefore, it is preferable to prevent the adhesion of dust or to remove adhering dust.

As a method of preventing dust, it is preferable to use a film formed of a material to which dust is hard to adhere. For example, by using a conductive film (Flecria (registered trademark) (manufactured by TDK Corporation) and/or NCF (Nagaoka Sangyou Co., Ltd.)) so that the film is not charged, it is possible to prevent adhesion of dust due to charging. It is also possible to suppress the adhesion of dust by using a fluororesin film (Dynoch Film (trademark) (manufactured by 3M Co.)), and/or a hydrophilic film (Miraclain (manufactured by Lifegard Co.)), RIVEX (manufactured by Riken Technology Inc.) and/or SH2CLHF (manufactured by 3M Co.)). By using a photocatalytic film (Raceline (manufactured by Kimoto Corporation)), contamination of the film can also be prevented. A similar effect can also be obtained by applying a spray having the conductivity, hydrophilic property and/or photocatalytic property and/or a spray containing a fluorine compound to the film.

In addition to using the above special films, it is also possible to prevent contamination by providing a cover on the film. As the cover, it is possible to use a thin film material (Saran Wrap (registered trademark) or the like), a mesh having a mesh size not allowing dust to pass therethrough, a nonwoven fabric, a urethane, an airgel, a porous film, and the like.

Figure 35:
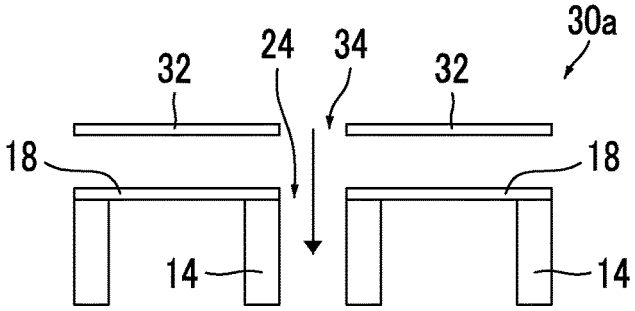
FIG. 35 is a schematic cross-sectional view of an example of a soundproof member having the soundproof structure of the present invention.
Figure 36:
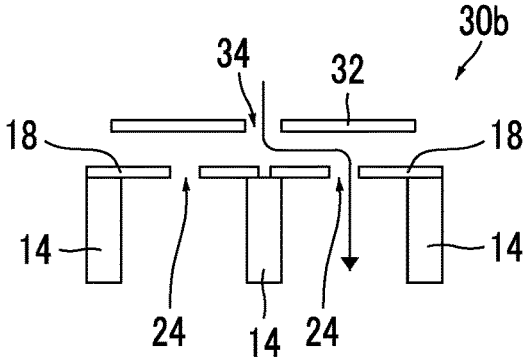
FIG. 36 is a schematic cross-sectional view of another example of the soundproof member having the soundproof structure of the present invention.

In the case of the soundproof structure 10*c* having the through-hole 24 serving as a ventilation hole in the film 18 as shown in FIG. 5, it is preferable to drill a hole 34 in a cover 32 provided on the film 18, as in soundproof members 30*a* and 30*b* shown in FIGS. 35 and 36, in order to prevent wind or dust from becoming in direct contact with the film 18.

As a method of removing adhering dust, it is possible to remove dust by emitting sound having the resonance frequency of a film and strongly vibrating the film. The same effect can be obtained even if a blower or wiping is used.

[Wind Pressure]

In a case where a strong wind hits a film, the film may be pressed to change the resonance frequency. Therefore, by covering the film with a nonwoven fabric, urethane, and/or a film, the influence of wind can be suppressed. In the case of the soundproof structure 10*c* having the through-hole 24 in the film 18 as shown in FIG. 5, in the same manner as in the above case of dust, it is preferable to drill the hole 34 in the cover 32 provided on the film 18, as in soundproof members 30*a* and 30*b* shown in FIGS. 35 and 36, in order to prevent wind from becoming in direct contact with the film 18.

[Combination of Unit Cells]

The soundproof structures 10, 10*a*, 10*b*, and 10*c* of the present invention shown in FIGS. 1 to 5 are formed by one frame body 16 in which a plurality of frames 14 are continuous. However, the present invention is not limited thereto, and a soundproof cell as a unit cell having one frame and one film attached thereto or having the one frame, the one film, and a through-hole formed in the film may be used. That is, the soundproof member having the soundproof structure of the present invention does not necessarily need to be formed by one continuous frame body, and a soundproof cell having a frame structure as a unit cell and a film structure attached thereto or a soundproof cell having one frame structure, one film structure, and a hole structure formed in the film structure may be used. Such a unit cell can be used independently, or a plurality of unit cells can be connected and used.

As a method of connecting a plurality of unit cells, as will be described later, a Magic Tape (registered trademark; the same hereinbelow), a magnet, a button, a suction cup, and/or an uneven portion may be attached to a frame body portion so as to be combined therewith, or a plurality of unit cells can be connected using a tape or the like.

[Arrangement]

Figure 37:
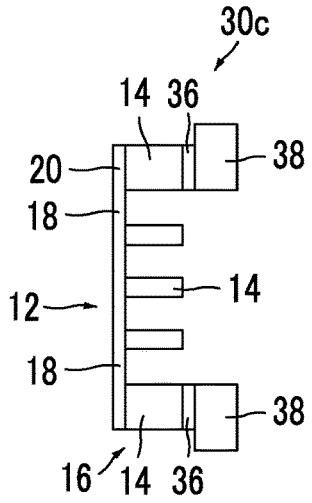
FIG. 37 is a schematic cross-sectional view showing an example of a state in which a soundproof member having the soundproof structure of the present invention is attached to the wall.
Figure 38:
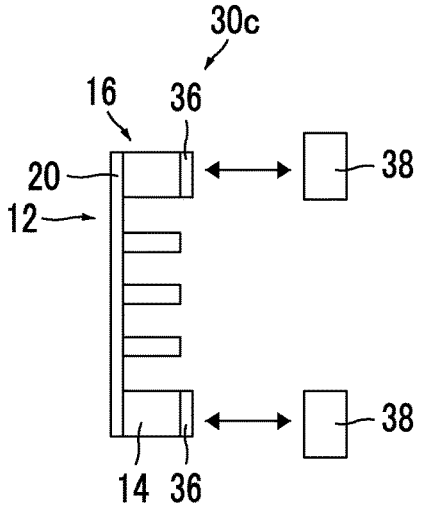
FIG. 38 is a schematic cross-sectional view of an example of a state in which the soundproof member shown in FIG. 37 is detached from the wall.

In order to allow the soundproof member having the soundproof structure of the present invention to be easily attached to a wall or the like or to be removable therefrom, a detaching mechanism formed of a magnetic material, a Magic Tape, a button, a suction cup, or the like is preferably attached to the soundproof member. For example, as shown in FIG. 37, a detaching mechanism 36 may be attached to the bottom surface of the frame 14 on the outer side of the frame body 16 of a soundproof member 30*c*, and the detaching mechanism 36 attached to the soundproof member 30*c* may be attached to a wall 38 so that the soundproof member 30*c* is attached to the wall 38. As shown in FIG. 38, the detaching mechanism 36 attached to the soundproof member 30*c* may be detached from the wall 38 so that the soundproof member 30*c* is detached from the wall 38.

Figure 39:
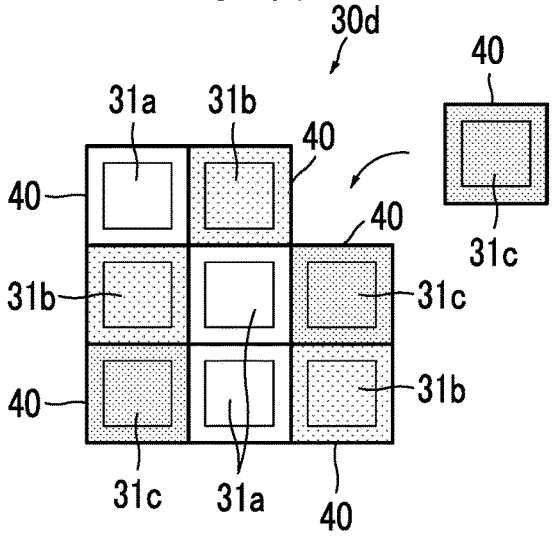
FIG. 39 is a plan view showing attachment and detachment of a unit cell in another example of the soundproof member having, the soundproof structure according to the present invention.

In the case of adjusting the soundproofing characteristics of the soundproof member 30*d* by combining respective soundproof cells having different resonance frequencies, for example, by combining soundproof cells 31*a*, 31*b*, and 31*c* as shown in FIG. 39, it is preferable that the detaching mechanism 40, such as a magnetic material, a Magic Tape, a button, and a suction cup, is attached to each of the soundproof cells 31*a*, 31*b*, and 31*c* so that the soundproof cells 31*a*, 31*b*, and 31*c* are easily combined. In addition, an uneven portion may be provided in a soundproof cell.

Figure 40:
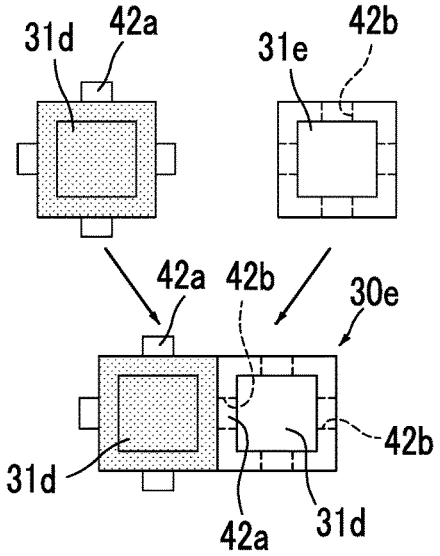
FIG. 40 is a plan view showing attachment and detachment of a unit cell in another example of the soundproof member having the soundproof structure according to the present invention.

For example, as shown in FIG. 40, a protruding portion 42*a* may be provided in a soundproof cell 31*d* and a recessed portion 42*b* may be provided in a soundproof cell 31*e*, and the protruding portion 42*a* and the recessed portion 42*b* may be engaged so that the soundproof cell 31*d* and the soundproof cell 31*e* are detached from each other. As long as it is possible to combine a plurality of soundproof cells, both a protruding portion and a recessed portion may be provided in one soundproof cell.

Furthermore, the soundproof cells may be detached from each other by combining the above-described detaching mechanism 40 shown in FIG. 39 and the uneven portion, the protruding portion 42*a*, and the recessed portion 42*b* shown in FIG. 40.

[Mechanical Strength of Frame]

As the size of the soundproof member having the soundproof structure of the present invention increases, the frame easily vibrates, and a function as a fixed end with respect to film vibration is degraded. Therefore, it is preferable to increase the frame stiffness by increasing the thickness of the frame. However, increasing the thickness of the frame causes an increase in the mass of the soundproof member. This declines the advantage of the present soundproof member that is lightweight.

Figure 41:
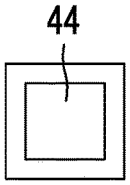
FIG. 41 is a plan view of an example of a soundproof cell of the soundproof structure of the present invention.
Figure 42:
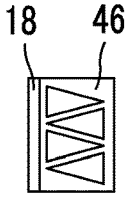
FIG. 42 is a side view of the soundproof cell shown in FIG. 41.
Figure 43:
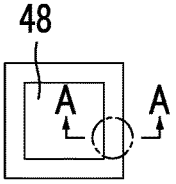
FIG. 43 is a plan view of an example of a soundproof cell of the soundproof structure of the present invention.
Figure 44:
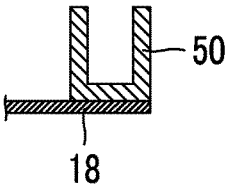
FIG. 44 is a schematic cross-sectional view of the soundproof cell shown in FIG. 43 as viewed from the arrow A-A.

Therefore, in order to reduce the increase in mass while maintaining high stiffness, it is preferable to form a hole or a groove in the frame. For example, by using a truss structure as shown in a side view of FIG. 42 for a frame 46 of a soundproof cell 44 shown in FIG. 41 or by using a Rahmem structure as shown in the A-A arrow view of FIG. 44 for a frame 50*d* of a soundproof cell 48 shown in FIG. 43, it is possible to achieve both high stiffness and light weight.

Figure 45:
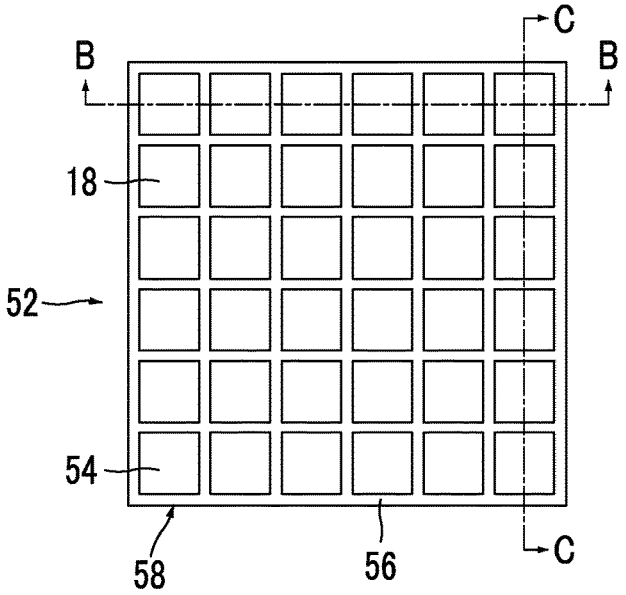
FIG. 45 is a plan view of another example of the soundproof member having the soundproof structure of the present invention.
Figure 46:
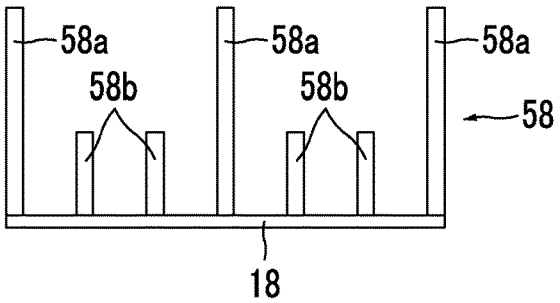
FIG. 46 is a schematic cross-sectional view of the soundproof member shown in FIG. 45 as viewed from the arrow B-B.
Figure 47:
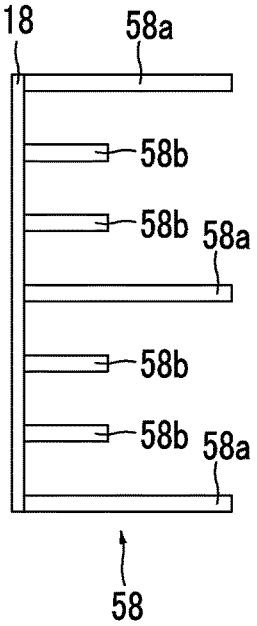
FIG. 47 is a schematic cross-sectional view of the soundproof member shown in FIG. 45 as viewed from the arrow C-C.

For example, as shown in FIGS. 45 to 47, by changing or combining the frame thickness in the plane, it is possible to secure high stiffness and to reduce the weight. As in a soundproof member 52 having the soundproof structure of the present invention shown in FIG. 45, as shown in FIG. 46 that is a schematic cross-sectional view of the soundproof member 52 shown in FIG. 45 taken along the line B-B, frame members 58*a* on both outer sides and a central frame member 58*a* of a frame body 58 configured to include a plurality of frames 56 of 36 soundproof cells 54 are made thicker than frame members 58*b* of the other portions. In the illustrated example, the frame members 58*a* on both outer sides and the central frame member 58*a* are made two times or more thicker than the frame members 58*b* of the other portions. As shown in FIG. 47 that is a schematic cross-sectional view taken along the line C-C perpendicular to the line B-B, similarly in the direction perpendicular to the line B-B, the frame members 58*a* on both outer sides and the central frame member 58*a* of the frame body 58 are made thicker than the frame members 58*b* of the other portions. In the illustrated example, the frame members 58*a* on both outer sides and the central frame member 58*a* are made two times or more thicker than the frame members 58*b* of the other portions.

In this manner, it is possible to achieve both high stiffness and light weight.

Although through-holes are not drilled in the film 18 of each soundproof cell shown in FIGS. 37 to 47 described above, the present invention is not limited thereto, and it is needless to say that the through-hole 24 may be provided as in the soundproof cell 22 of the example shown in FIG. 5.

In the present invention, in the soundproof structure configured to include a soundproof cell having through-holes in a film, a weight that is a factor of increasing the weight is not necessary as described above compared with the technique disclosed in U.S. Pat. No. 7,395,898B (corresponding Japanese Patent Application Publication: JP2005-250474A). Therefore, the soundproof structure of the present invention has the following features in addition to features, such as being able to realize a lighter sound insulation structure.

1. Since a hole can be formed in a film quickly and easily by laser processing or punch holes processing, there is manufacturing suitability.

2. Since the sound insulation characteristics hardly depend on the position or the shape of a hole, stability in manufacturing is high.

3. Since a hole is present, it is possible to realize a structure that shields sound while making a film have air permeability, that is, while allowing wind or heat to pass through the film.

The soundproof structure 10 of the present invention shown in FIG. 1 is manufactured as follows.

First, the frame body 16 having a plurality of frames 14, for example, 225 frames 14, the sheet-shaped film body 20*a* covering all the openings 12 of the frames 14 the number of which is a half of all the frames 14 of the frame body 16, and the sheet-shaped film body 20*b* that covers all the openings 12 of the remaining half frames 14 and has a different thickness from the film body 20*a* are prepared.

Then, the sheet-shaped film body 20*a* is bonded and fixed to the frames 14, the number of which is a half of all the frames 14 of the frame body 16, with an adhesive to form the film 18*a* covering the openings 12 of the half frames 14, thereby forming a plurality of soundproof cells 22*a* having a structure configured to include the frame 14 and the film 18*a*.

The sheet-shaped film body 20*b* is bonded and fixed to the frames 14, which is the remaining half of all the frames 14 of the frame body 16, with an adhesive to form the film 18*b* covering the openings 12 of the remaining half frames 14, thereby forming a plurality of soundproof cells 22*b* having a structure configured to include the frame 14 and the film 18*b*.

In this manner, it is possible to manufacture the soundproof structure 10 of the present invention.

The case of the soundproof structure 10*a* of the present invention shown in FIG. 3 is different from the case of the soundproof structure 10 of the present invention shown in FIG. 1 in that the film 18*a* and the film 18*b* are bonded to the frame 14 so as to be arranged in a zigzag manner.

In addition, the case of the soundproof structure 10*b* of the present invention shown in FIG. 4 is different from the case of the soundproof structure 10 of the present invention shown in FIG. 1 in that the frame body 16 including the frames 14 having different frame sizes and one sheet-shaped film body 20 are prepared and one sheet-shaped film body 20 is bonded to all the frames 14 having different frame sizes of the frame body 16.

In the case of the soundproof structure 10*c* of the present invention shown in FIG. 5, the through-hole 24 is formed in each soundproof cell 22 by drilling one or more through-holes 24 in each of the films 18*a* of the half soundproof cells 22*a* and the films 18*b* of the remaining half soundproof cells 22*b* of the soundproof structure 10 of the present invention shown in FIG. 1 using a processing method for absorbing energy, such as laser processing, or a mechanical processing method using physical contact, such as punching or needle processing.

In this manner, it is possible to manufacture the soundproof structure of the present invention.

The soundproof structure of the present invention is basically configured as described above.

The soundproof structure of the present invention can be used as the following soundproof members.

For example, as soundproof members having the soundproof structure of the present invention, it is possible to mention: a soundproof member for building materials (soundproof member used as building materials); a soundproof member for air conditioning equipment (soundproof member installed in ventilation openings, air conditioning ducts, and the like to prevent external noise); a soundproof member for external opening portion (soundproof member installed in the window of a room to prevent noise from indoor or outdoor); a soundproof member for ceiling (soundproof member installed on the ceiling of a room to control the sound in the room); a soundproof member for internal opening portion (soundproof member installed in a portion of the inside door or sliding door to prevent noise from each room); a soundproof member for toilet (soundproof member installed in a toilet or a door (indoor and outdoor) portion to prevent noise from the toilet); a soundproof member for balcony (soundproof member installed on the balcony to prevent noise from the balcony or the adjacent balcony); an indoor sound adjusting member (soundproof member for controlling the sound of the room); a simple soundproof chamber member (soundproof member that can be easily assembled and can be easily moved); a soundproof chamber member for pet (soundproof member that surrounds a pet's room to prevent noise); amusement facilities (soundproof member installed in a game centers, a sports center, a concert hall, and a movie theater); a soundproof member for temporary enclosure for construction site (soundproof member for preventing leakage of a lot of noise around the construction site); and a soundproof member for tunnel (soundproof member installed in a tunnel to prevent noise leaking to the inside and outside the tunnel).

EXAMPLES

The soundproof structure of the present invention will be specifically described by way of examples.

Before performing an experiment to manufacture an example of the present invention and measure the acoustic characteristic, the design of the soundproof structure by simulation is shown.

Since the system of the soundproof structure is an interaction system of film vibration and sound waves in air, analysis was performed using coupled analysis of sound and vibration. Specifically, designing was performed using an acoustic module of COMSOL ver 5.0 that is analysis software of the finite element method. First, a first resonance frequency was calculated by natural vibration analysis. Then, by performing acoustic structure coupled analysis based on frequency sweep in the periodic structure boundary, transmission loss at each frequency with respect to the sound wave incident from the front was calculated. Based on this design, the shape or the material of the sample was determined. The shielding peak frequency in the experimental result and a predicted shielding peak frequency from the simulation satisfactorily matched each other as in the experiment result of Example 1 and the simulation result shown in FIG. 12.

The correspondence between the first resonance frequency and each physical property was found by taking advantage of the characteristics of the simulation in which the material characteristics or the film thickness can be freely changed. As the parameter B, natural vibration was calculated by changing the thickness t (m) of the film 18, the size (or the radius) R (m) of the frame 14, the Young's modulus E (Pa) of the film, and the density d (kg/m$^3$) of the film. The result is shown in FIGS. 20 and 21. The present inventors have found that a first resonance frequency f_resonance is substantially proportional to $t/R^2*\sqrt{(E/d)}$ through this calculation. Accordingly, it was found that natural vibration could be predicted by setting the parameter $B=t/R^2*\sqrt{(E/d)}$.

First, the sound insulation characteristics of the soundproof structure of the present invention were analyzed by simulation. Examples S1 to S6 by simulation are shown below.

Example S1

First, regarding the simulation of the soundproof structure 10 of the present invention in which two types of PET films having different thicknesses are fixed to the 20-mm frame 14 as the film 18, transmission loss in a case where the PET film of one film 18*a* has a thickness of 100 μm and the PET film of the other film 18*b* has a thickness of 125 μm, 150 μm, 175 μm, 200 μm, 225 μm, and 250 μm is shown in FIG. 6. The frame 14 was a square having a size of 20 mm, the first resonance frequency of the soundproof cell 22*a* of the PET film (100 μm) of one film 18*a* was 800 Hz, the first resonance frequency of the soundproof cell 22*b* of the PET film having a different thickness of the other film 18*b* was on the higher frequency side, and a maximum value of the transmission loss appeared at the frequency therebetween. The frequency indicating the maximum value is the shielding peak frequency.

As is apparent from FIG. 6, as described above, in the soundproof structure 10 of the present invention, as the PET film of the other film 18*b* becomes thick, the first resonance frequency on the high frequency side shifts to the higher frequency side, the shielding peak frequency also shifts to the higher frequency side, and the shielding peak becomes high.

Example S2

Next, in the soundproof structure 10 of the present invention, from the viewpoint of shielding low frequencies, the frame 14 was a square having a size of 25 mm, the film thickness of the PET film of one film 18*a* was set to 50 μm, and the size of the frame 14 was set to 25 mm, so that the first resonance frequency became a low frequency. Simulation was performed by combining the 25-mm square frame 14 and the PET film having a film thickness of 80 μm, 100 μm, and 120 μm of the other film 18*b*, and the frequency dependence of transmission loss was calculated. The result is shown in FIG. 7. It was found that the maximum value of transmission loss also appeared on the low frequency side near the frequencies of 300 Hz to 500 Hz.

As is apparent from FIG. 7, as described above, the soundproof structure 10 of the present invention shows the same tendency as in FIG. 6 even if the PET film is made thinner as a whole.

Example S3

Next, as a simulation in the case of different film types, a combination of a PET film having a thickness of 100 μm of the film 18*a* and a film having a thickness of 100 μm of the film 18*b* for setting the Young's modulus was calculated for the 15-mm square frame 14. The set Young's moduli were 0.9, 1.8, 2.7, 3.6, and 4.5 GPa, and other parameters, such as Poisson's ratios or density, were the same as those of the PET film of the film 18*a*. Here, the Young's modulus of the PET film itself was 4.5 GPa. Those transmission losses are shown in FIG. 8. The first resonance frequency in a case where there is a difference in Young's modulus between the film 18*a* and the film 18*b*, for example, at the time of the film 18*b* having a low Young's modulus is on the low frequency side. In this case, the maximum value of transmission loss appeared between the first resonance frequencies of the frame-film structure of the PET film of the film 18*a*. In a case where the Young's moduli of the film 18*a* and the film 18*b* were equal to 4.5 GPa, only one first resonance frequency appeared and the shielding peak frequency did not appear. As is apparent from FIG. 8, as described above, as the Young's modulus of the film 18*b* having a low Young's modulus becomes low, the first resonance frequency shifts to the low frequency side, the shielding peak frequency also shifts to the low frequency side, and the shielding peak becomes high.

Example S4

Next, as a simulation in a case where the area of the frame 14 is different, simulation was performed in a case where a PET film having a thickness of 150 μm was fixed, as the film body 20 (films 18*e* and 18*f*), to a structure having two types of unit frames of the square frame 14*b* of 20 mm square and the quadrangular frame 14*a* having one side of 20 mm×one side of x mm (x is 15 mm, 20 mm, and 30 mm). FIG. 4 is a plan view schematically showing the soundproof structure 10*c* of the soundproof cell 22 (22*e*, 22*f*) of the frame-film structure at the time of x=30 mm. FIG. 9 shows the result of transmission loss by simulation.

As described above, since the hardness of the film in a unit soundproof cell decreases as the area of a unit frame increases, the first resonance frequency shifts to a low frequency side. From this, at the time of x=30 mm, the first resonance frequency appeared at two frequencies due to the square frame and the rectangular frame, and the transmission loss was a maximum value in the middle. Conversely, at the time of x=15 mm, the first resonance frequency shifted to the high frequency side, and the transmission loss was a maximum value in the middle. At the time of x=20 mm, the sizes of the frame 14*a* and the frame 14*b* became the same, and the soundproof cells 22*e* and 22*f* became the same. As a result, only one first resonance frequency appeared, and the shielding peak frequency did not appear.

Example S5

In order to see the effect of tension, the transmission loss of a model in which tension was applied to one soundproof cell 22 was calculated by using the above COMSOL. The frame 14 of the soundproof cell 22 was a square shape having a size of 20 mm square, and the thickness of the film 18 was set to 100 μm, and a predetermined tension of 130 (N/m) was applied only to the film 18 of the soundproof cell 22 on one side, for example, the film 18*a*. As a material of the film 18, physical property values of the PET film were used.

The transmission loss obtained from the calculation result is shown in FIG. 18. There were two minimum values (first resonance frequencies) of transmission loss corresponding to natural vibration due to cell structures of the soundproof cells 22 (22*a*, 22*b*), and a large transmission loss peak appeared at the frequency therebetween.

By applying tension to the film 18 (18*a*) of the soundproof cell 22 (22*a*), the first resonance frequency shifts to the high frequency side due to a shift from the first resonance frequency of the original cell structure of the soundproof cell 22 (22*b*) to which no tension is applied. Therefore, even if soundproof cells had originally the same characteristic, the first resonance frequencies were different between soundproof cells with different tensions, and strong transmission loss appeared at the frequency therebetween.

Example S6

In order to see the influence in a case where the hardnesses of three or more types of films were different, the transmission loss of the soundproof cell 22 of the frame-film structure having a film thickness of three levels was calculated by using the above COMSOL. The frames 14 of all the soundproof cells 22 of the model were square shapes having a size of 20 mm square, and the thickness of each film 18 was set to three kinds of 100 μm, 150 μm, and 200 μm, and the periphery of the film 18 was fixedly restrained to the frame 14. As a material of the film 18, physical property values of the PET film were used.

The transmission loss obtained from the calculation result is shown in FIG. 19. Minimum values of transmission loss due to three natural vibrations are present, and correspond to the soundproof cells 22 of the film-frame structure having film thicknesses of 100 μm, 150 μm, and 200 μm from the low frequency side. Large shielding occurred between the plurality of first resonance frequencies, specifically, between two adjacent first resonance frequencies. In the case of Example S6, there were also two shielding peaks of transmission loss corresponding to the number of natural vibrations of the film 18.

It was found that a plurality of shielding peaks could be formed by combining the hardnesses of a plurality of types of films in this manner.

Next, the sound insulation characteristics of the soundproof structure of the present invention were analyzed by experiments. Examples 1 to 4 by experiments are shown below.

Example 1

First, as shown in FIG. 1, a soundproof structure 10 having the soundproof cells 22*a* and 22*b*, which were structures in which the films 18*a* and 18*b* were PET films of 100 μm and 188 μm and the size of the frame 14 was 20 mm square, was manufactured. The manufacturing procedure is shown below.

As the films 18*a* and 18*b*, 100-μm and 188-μm PET films (Lumilar, Toray Industries, Inc.) were used. An aluminum having a thickness of 3 mm and a width of 2 mm was used as the frame 14, and the shape of the frame 14 was a square. Processing was performed with one side of the square opening 12 as 20 mm. As shown in FIG. 1, there are a total of 36 (6×6) through openings 12 of the frame structure. For the frame structure, first, a PET film having a thickness of 100 μm was fixed to 3×6 frame regions with an adhesive, and then a PET film having a thickness of 188 μm was fixed to remaining 3×6 frame regions with an adhesive. As a result, the soundproof structure 10 shown in FIG. 1 having two types of soundproof cells, which were frame-film structures configured to include a frame and two types of films, was manufactured.

The acoustic characteristics were measured by a transfer function method using four microphones in a self-made aluminum acoustic tube. This method is based on "ASTM E2611-09: Standard Test Method for Measurement of Normal Incidence Sound Transmission of Acoustical Materials Based on the Transfer Matrix Method". As the acoustic tube, for example, an acoustic tube based on the same measurement principle as WinZac manufactured by Nitto Bosei Aktien Engineering Co., Ltd. was used. It is possible to measure the sound transmission loss in a wide spectral band using this method. The soundproof structure 10 of a frame-film structure was disposed in a measurement portion of the acoustic tube, and the sound transmission loss was measured in the range of 100 Hz to 2000 Hz.

Figure 17:
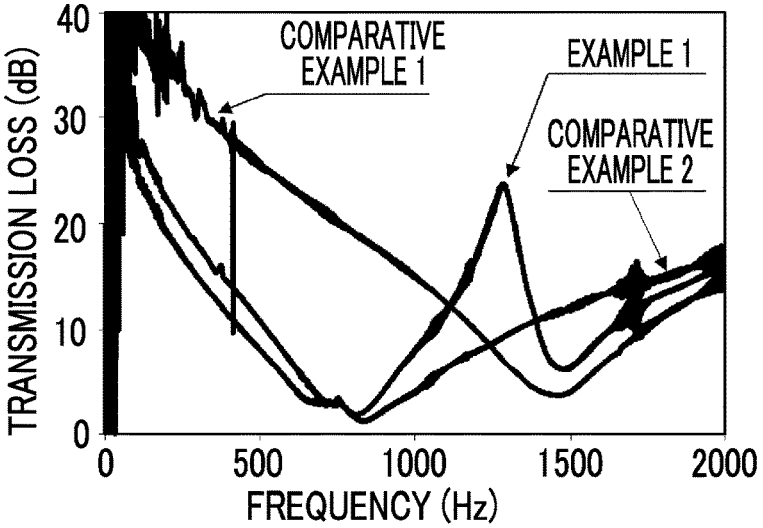
FIG. 17 is a graph showing the sound insulation characteristics of soundproof structures of Example 1, Comparative Example 1, and Comparative Example 2 of the present invention.

The measurement results of the transmission loss are shown in FIGS. 10 and 17.

In the soundproof structure of Example 1, as shown in FIGS. 10 and 17, it was found that two different first resonance frequencies corresponding to two types of soundproof cells were present at about 800 Hz and about 1400 Hz, but very strong shielding occurred at the shielding peak frequency near 1300 Hz between these frequencies. At the shielding peak frequency of 1284 Hz, the peak value of the transmission loss of the shielding peak frequency was 24 dB.

The frequency dependence of the sound absorbance of Example 1 was calculated using the transmittance and the reflectivity measured in Example 1. The result is shown in FIG. 11. In the soundproof structure of Example 1, two different first resonance frequencies corresponding to two types of soundproof cells are present as shown in FIG. 10, but the maximum absorbance is present at the first resonance frequency of each soundproof cell as shown in FIG. 11. As a result, it can be understood that broadband sound absorption is achieved.

Figure 12:
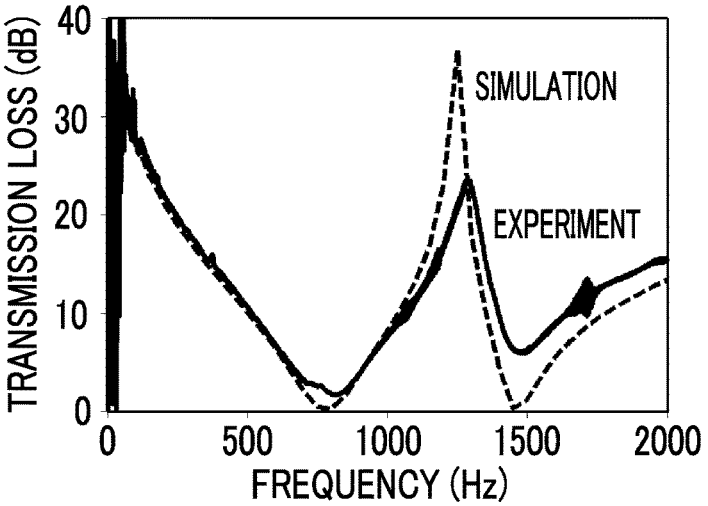
FIG. 12 is a graph showing the measurement result and the simulation result of the sound insulation characteristics of the soundproof structure of Example 1 of the present invention having a frame-film structure shown in FIG. 1.

The sound transmission loss of the soundproof structure having the configuration of Example 1 was measured by simulation in the range of 100 Hz to 2000 Hz. The simulation result is shown in FIG. 12. In FIG. 12, the measurement results of the transmission loss by the experiment shown in FIG. 10 are superimposed.

As shown in FIG. 12, it can be seen that the measurement result of transmission loss by experiment and the predicted result of transmission loss by simulation satisfactorily match each other.

Hereinafter, since the measurement methods are the same in all examples and comparative examples, methods of manufacturing a sample are shown.

Comparative Example 1

In the above Example 1, instead of using two types of films, a PET film having a thickness of 188 μm that was one type of film between the two types of films was fixed to 6×6 frame regions with an adhesive. Sound transmission loss measurement was performed for a soundproof structure having the single type of soundproof cell. Sound insulation according to the general mass law and stiffness law was obtained. FIG. 17 shows the measurement result of the transmission loss in Comparative Example 1. FIG. 17 shows the frequency dependence of the shielding coefficient in Comparative Example 1.

Comparative Example 2

In the above Example 1, instead of using two types of films, a PET film having a thickness of 100 μm that was the other one type of film between the two types of films was fixed to 6×6 frame regions with an adhesive. Sound transmission loss measurement was performed for a soundproof structure having the single type of soundproof cell. Sound insulation according to the general mass law and stiffness law was obtained. FIG. 17 shows the measurement result of the transmission loss in Comparative Example 2. FIG. 17 also shows the frequency dependency of the shielding coefficient in Comparative Example 2. The soundproof structure of Comparative Example 2 has a thinner film thickness than the soundproof structure of Comparative Example 1. Accordingly, the soundproof structure of Comparative Example 2 has lower hardness. For this reason, as shown in FIG. 17, the first resonance frequency appeared on the lower frequency side as compared with Comparative Example 1.

FIG. 17 shows the frequency dependence of the shielding coefficient, which is the measurement result of the transmission loss in all of Example 1, Comparative Example 1, and Comparative Example 2. It is understood from FIG. 17 that the soundproof cell of PET 188 μm of Comparative Example 1 shows the behavior of stiffness law and the soundproof cell of PET 100 μm of Comparative Example 2 shows the behavior of mass law in the vicinity of 1300 Hz. In a case where the transmission amplitudes from the two soundproof cells become equal, a large shielding peak appears in the structure of Example 1 configured to include the two soundproof cells. This shows that the transmitted waves from the two types of soundproof cells canceled each other and accordingly a large sound insulation effect was obtained.

Example 2

Next, a soundproof structure 10 having the soundproof cells 22*a* and 22*b*, which were structures in which the films 18*a* and 18*b* shown in FIG. 1 were PET films of 100 μm and 250 μm and the size of the frame 14 was 25 mm square, was manufactured.

In Example 2, Lumirror was used as the PET film of the films 18*a* and 18*b* in the same manner as in Example 1. As in Example 1, an aluminum having a thickness of 3 mm and a width of 2 mm was used as the frame 14, and the shape of the frame 14 was a square. Processing was performed with one side of the square opening 12 as 25 mm. Unlike in the soundproof structure 10 shown in FIG. 1, there are a total of 16 (4×4) through openings 12 of the frame structure. For the frame structure, first, a PET film having a thickness of 100 μm was fixed to 2×4 frame regions with an adhesive, and then a PET film having a thickness of 250 μm was fixed to remaining 2×4 frame regions with an adhesive. As a result, a soundproof structure having two types of soundproof cells, which were frame-film structures configured to include a frame and two types of films, was manufactured. Measurement of the sound insulation characteristics was performed in the same manner as in Example 1.

FIG. 13 shows the measurement result of the transmission loss in Example 2. The calculated sound absorption rate in Example 2 is shown in FIG. 14.

In the soundproof structure of Example 2, as shown in FIG. 13, it was found that two different first resonance frequencies corresponding to two types of soundproof cells were present at about 600 Hz and about 1300 Hz, but very strong shielding occurred in a frequency region centered on a shielding peak frequency near 1000 Hz to 1100 Hz between these frequencies. At the shielding peak frequency of 1100 Hz, the peak value of the transmission loss of the shielding peak frequency was 30 dB.

As shown in FIG. 14, in the soundproof structure of Example 2, a maximum absorbance due to the two types of first resonance frequencies of the two types of soundproof cells 22*a* and 22*b* also appeared in this case.

Example 3

The through-hole 24 having a diameter of 1 mm was formed in the film 18 of each soundproof cell 22 of the soundproof structure of the above Example 2. The through-hole 24 was dynamically formed using a punch. It was confirmed using an optical microscope that the diameter of the through-hole 24 was 1 mm. In this manner, the soundproof structure 10*c* having the soundproof cells 22*e* and 22*f* with the through-hole 24, which were schematically shown in FIG. 5 and had different effective hardnesses, was formed.

Acoustic measurement was performed as in Example 1. FIG. 15 shows the measurement result of the transmission loss. As seen in Example 2, about 600 Hz and about 1300 Hz of the two first resonance frequencies due to the two types of different film thicknesses remained, a shielding peak near 1100 Hz that is the shielding peak frequency between the first resonance frequencies also remained, and the peak value of the transmission loss was 24 dB at 1150 Hz that is the shielding peak frequency.

A new shielding peak due to the through-hole 24 being provided occurred on the low frequency side. The shielding peak due to the through-hole 24 appeared near 400 Hz, and the transmission loss of 25 dB as a peak value of shielding was shown at 380 Hz. In Example 2 in which there is no hole, since the transmission loss at 380 Hz is 12 dB, it can be seen that the sound insulation improved is improved by providing the through-hole 24.

The result of measurement of the sound absorbance is shown in FIG. 16. Also in this case, the maximum absorbance due to the two first resonance frequencies of the two types of soundproof cells appeared, and absorption that did not appear in Example 2 also appeared in the lower frequency region than the shielding peak on the low frequency side due to the through-hole being provided.

Example 4

By the same thickness combination as in Example 1, as in the soundproof structure 10*a* shown in FIG. 3, by changing the thickness of an adjacent soundproof cell for each soundproof cell in association with the arrangement of the soundproof cells 22 having different film thicknesses, a sample in which the soundproof cells 22 having different film thicknesses were arranged in a checkered pattern was manufactured. In the soundproof structure 10*a* of Example 4, the transmission loss and the sound absorbance were measured in the same manner as in Example 1. As a result, it was found that there was no change from Example 1.

This can be considered as follows. Also in the Example 1, the size of the 6×3 structure of the soundproof cell 22 was less than the wavelength in the present frequency measurement range. Accordingly, in both the structure of Example 1 and the structure of Example 4, diffraction or scattering did not occur because the basic unit of the size was less than the wavelength. As a result, since the structure was coarse-grained to function as seen from the sound wave, there was no change in the function with respect to the sound wave.

Example 5

As shown in FIG. 22, a soundproof structure 10*d* configured to include the soundproof cells 22*h* and 22*i*, which were structures in which the thickness (frame thickness) L1 of the frame 14 was 15 mm and the size (frame size) of the frame 14 was 20 mm square, was manufactured. For the structure, the PET film 18*g* was edge-fixed using an adhesive so as to cover one side of the opening 12 of the frame 14, and then the PET film 18*h* was edge-fixed using an adhesive so that both sides of the opening 12 of the frame 14 were covered and the distance between two layers (between films) was 15 mm. As a result, the soundproof structure 10*d* having two types of soundproof cells 22*h* and 22*i* was manufactured. A PET film having a thickness (film thickness) of 188 μm was used as the film 18*g*, and a PET film having a thickness (film thickness) of 100 μm was used as the film 18*h*. The above frame thickness, frame size, and film thickness are designed so that the first resonance frequency of the soundproof cell 22*h* and the higher order resonance frequency of the soundproof cell 22*i* match each other.

Measurement of the sound insulation characteristics was performed in the same manner as in Example 1. The sound insulation characteristics were obtained by measuring the transmission loss at each frequency for the sound wave incident from the lower side in FIG. 22.

Figure 24:
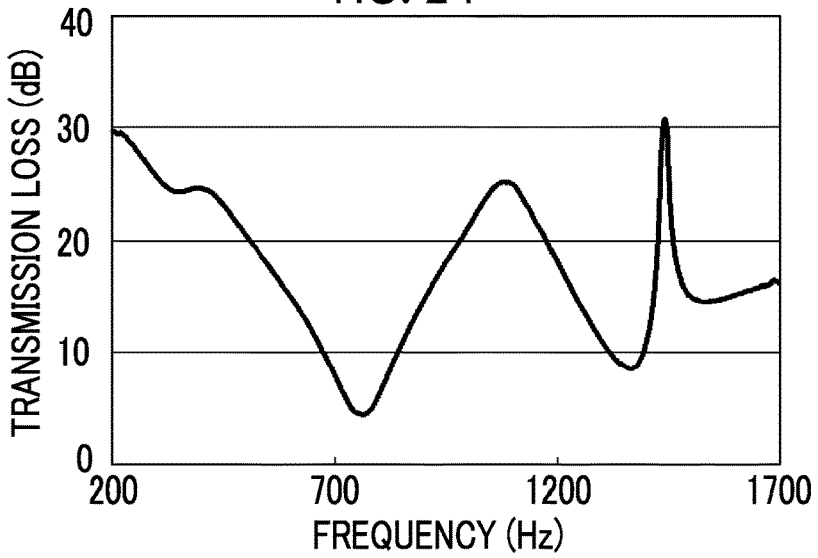
FIG. 24 is a graph showing the sound insulation characteristics of a soundproof structure of Example 5 of the present invention.

FIG. 24 shows the measurement result of the transmission loss in Example 5. FIG. 25 shows the obtained transmittance, reflectivity, and sound absorbance in Example 5.

In the soundproof structure 10*d* of Example 5, as shown in FIG. 24, it was found that a first resonance frequency corresponding to the soundproof cell 22*h* was present at 1410 Hz, a first resonance frequency corresponding to the soundproof cell 22*i* was present at 760 Hz, and a large transmission loss with peak shielding occurred in the vicinity of 1090 Hz between the frequencies.

In the soundproof structure of Example 5, as shown in FIG. 24, it was found that a large transmission loss of 30 dB or more occurred in the vicinity of 1410 Hz. This is because the shielding peak appears at a frequency at which the first resonance frequency of the soundproof cell 22*h* matches the higher order (second order) resonance frequency of the soundproof cell 22*i*. From the reflectivity and the absorbance in the vicinity of the frequency of 1410 Hz shown in FIG. 25, it was found that this transmission loss was caused not by large reflection but by large absorption and the absorbance reached up to 93%.

Considering that the frame thickness of each of the soundproof cells 22*h* and 22*i* was 15 mm and the frame size was 20 mm, the wavelength of 1410 Hz at which the maximum absorbance was obtained was about 240 mm. Therefore, it was found that a very high sound absorbance was realized with a size less than 1/10 of the wavelength of the sound wave.

Figure 26:
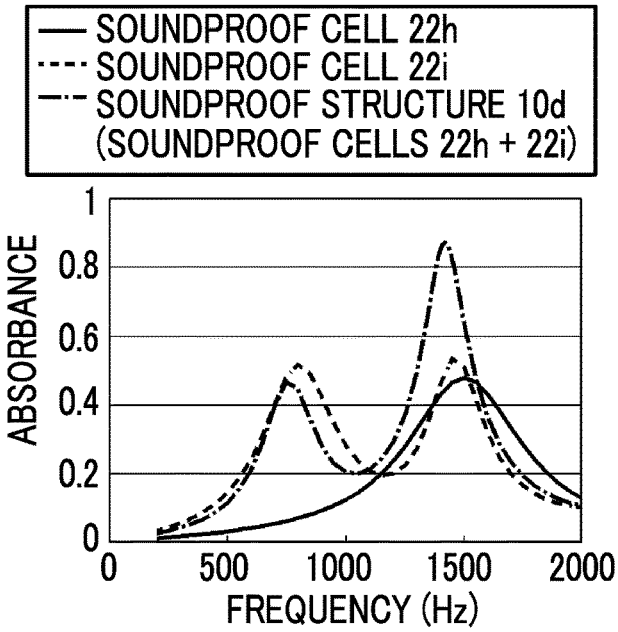
FIG. 26 is a graph showing the sound absorption characteristics of the soundproof structure of Example 5 of the present invention and soundproof cells forming the soundproof structure.

FIG. 26 shows the result of analyzing the sound insulation characteristics by simulation for each of the soundproof structure 10*d* and the soundproof cells 22*h* and 22*i* of Example 5. The analysis was performed using an acoustic module of COMSOL ver 5.0 that is the analysis software of the finite element method described above. According to FIG. 26, it can be seen that the soundproof structure 10*d* of Example 5 is designed such that the first resonance frequency of the soundproof cell 22*h* and the higher order resonance frequency of the soundproof cell 22*i* match each other. Both the absorbance of the soundproof cell 22*h* and the absorbance of the soundproof cell 22*i* were limited to about 50%, but the absorbance of about 90% was shown in the soundproof structure 10*d* in which these two soundproof cells are arranged adjacent to each other. In the acoustic module, acoustic structure interaction is calculated by coupling the transmission of the sound wave and the vibration of the structure. Therefore, the behavior of vibration of the vibrating film is also calculated by structural calculation, and pressure at each position and the direction of local velocity can be output by sound wave calculation.

Figure 27:
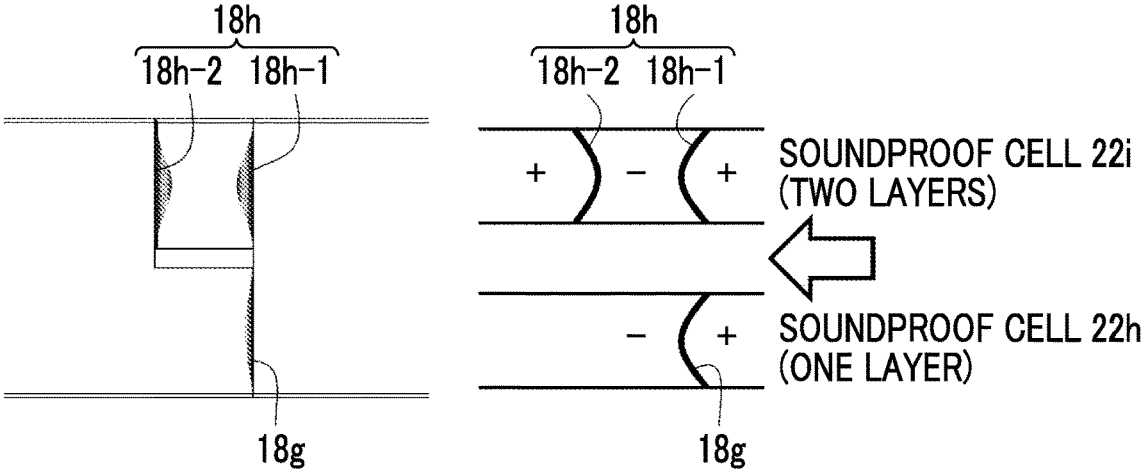
FIG. 27 is a diagram schematically showing the film displacement of the soundproof structure of Example 5 of the present invention.
Figure 28:
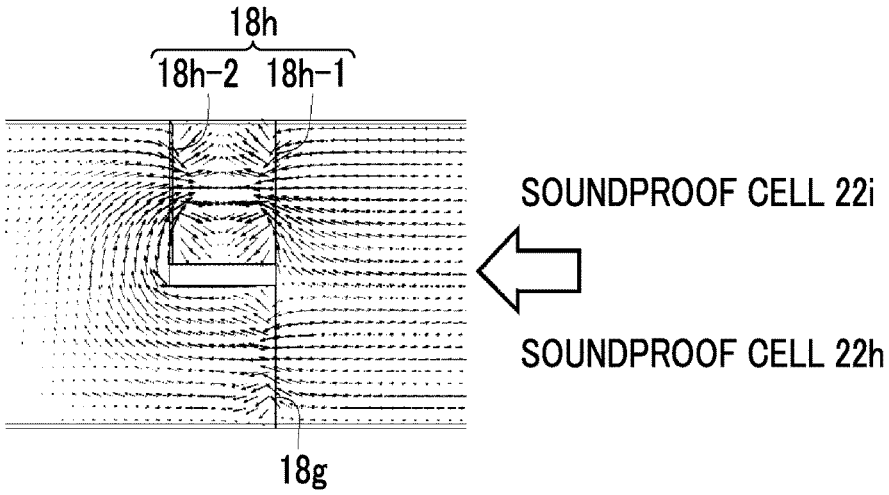
FIG. 28 is a diagram showing the local velocity in the film displacement shown in FIG. 27.

FIG. 27 shows a film displacement occurring in a case where sound waves are incident on the soundproof structure 10*d* from the direction indicated by the arrow, that is, from the lower side in FIG. 22, and its schematic diagram, and FIG. 28 shows the local velocity.

It can be seen from the film displacement shown in FIG. 27 that a large vibration state occurs in a central portion of the film 18*g* due to the displacement of the film in the normal first resonance frequency mode, that is, incident sound pressure, in the soundproof cell 22*h* having a one-layer (monolayer) film and the displacements of the films 18*h* of two layers occur in opposite directions due to incident sound pressure to cause the displacement of the film of the resonance mode in the soundproof cell 22*i* having the films of two layers. The reason is as follows. As shown in the schematic diagram of FIG. 27, in the soundproof cells 22*h* and 22*i*, the film 18*g* and the film 18*h*-1 are pressed at the same time by the incident sound pressure, but the phase of the sound wave is inverted on the sound wave emission side, that is, on a side opposite to the sound wave incidence direction. Accordingly, the wave transmitted through the film 18*h*-1 and the wave transmitted through the film 18*h*-2 interfere with each other between the film 18*h*-1 and the film 18*h*-2. Also from FIG. 28, it can be seen that the sound wave transmitted through the film 18*g* of the soundproof cell 22*h* is inverted in phase and incident on the film 18*h*-2 of the soundproof cell 22*i* and is canceled by the sound wave transmitted through the film 18*h*-1 and accordingly the transmitted wave becomes small.

That is, it can be seen that it is possible not only to increase the transmission loss by canceling transmitted waves in a region interposed between the first resonance frequencies but also to obtain the sound absorbance far beyond 50% even if the frame size of the soundproof cell is less than 1/10 of the wavelength of the sound wave by matching the first resonance frequency of the one-layer film of the soundproof cell 22*h* with the higher order resonance frequency of the two-layer film of the soundproof cell 22*i*.

Example 6

As shown in FIG. 23, a soundproof structure 10*e* configured to include soundproof cells, which were structures in which the frame 14 of one structure was a square having a size (frame size) of 14 mm square and the frame 14 of the other structure was a square having a size (frame size) of 20 mm square and the frame thickness L2 in both the structures was 10 mm, was manufactured. For the frame structure, by edge-fixing the PET film 18*i* using an adhesive so as to cover one side of the opening 12 of the frame 14, the soundproof cell 22*j* was manufactured. In addition, for the frame structure, by edge-fixing the PET film 18*j* using an adhesive so that both sides of the opening 12 of the frame 14 were covered and the distance between two layers (between films) was 10 mm, the soundproof cell 22*k* was manufactured. PET films each having a thickness (film thickness) of 100 μm were used as the films 18*i* and 18*j*. Therefore, after applying an adhesive to the frame, a portion in contact with the film 18*i* and a portion in contact with the film 18*j*-1 can be generated simply by being attached so as to cover the entire portion with the same PET film. The above frame thickness, frame size, and film thickness are designed so that the first resonance frequency of the soundproof cell 22*j* and the higher order resonance frequency of the soundproof cell 22*k* match each other.

Figure 29:
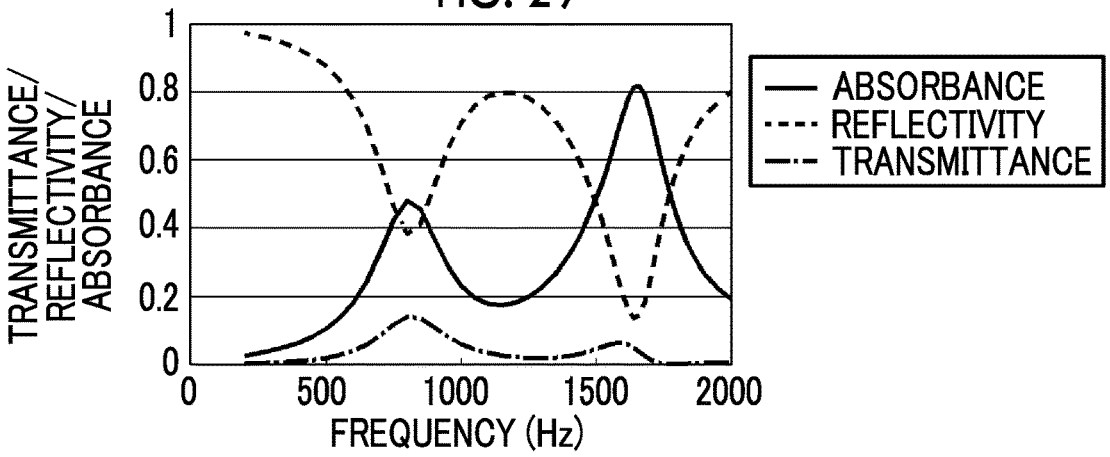
FIG. 29 is a graph showing the sound transmission characteristics, sound reflection characteristics, and sound absorption characteristics of a soundproof structure of Example 6 of the present invention.

FIG. 29 shows the result of analyzing the sound insulation characteristics by simulation for the soundproof structure 10*e* of Example 6. The analysis was performed using an acoustic module of COMSOL ver 5.0 that is the analysis software of the finite element method described above.

According to FIG. 29, similarly to the result of Example 5, it can be seen that the sound absorbance of the soundproof structure 10*e* of Example 6 is an absorbance of 82% far beyond 50%.

Figure 30:
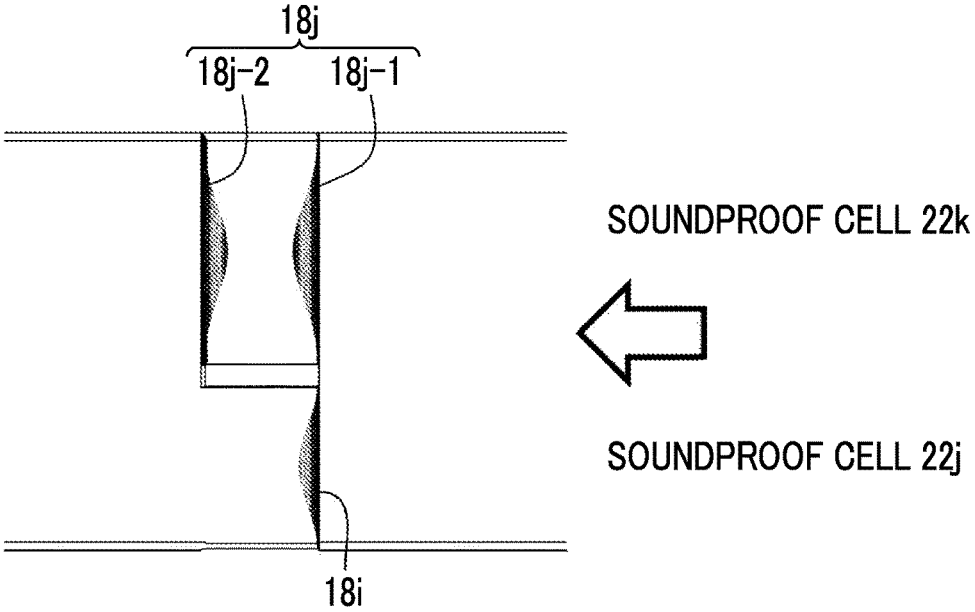
FIG. 30 is a diagram showing the film displacement of the soundproof structure of Example 6 of the present invention.
Figure 31:
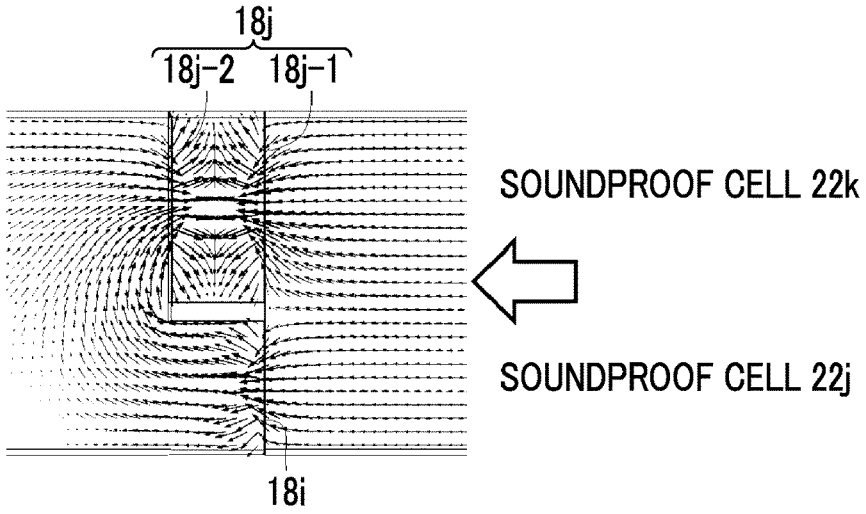
FIG. 31 is a diagram showing the local velocity in the film displacement shown in FIG. 30.

FIG. 30 shows a film displacement occurring in a case where sound waves are incident on the soundproof structure 10*e* from the direction indicated by the arrow, that is, from the lower side in FIG. 23, and FIG. 31 shows the local velocity.

Also in FIG. 30, similarly to the result of the soundproof structure 10*d* of Example 5, it can be seen that a large vibration state occurs in a central portion of the film 18*i* due to the displacement of the film in the normal first resonance frequency mode, that is, incident sound pressure, in the soundproof cell 22*j* having a one-layer (monolayer) film and the displacements of the films 18*j* of two layers occur in opposite directions due to incident sound pressure to cause the displacement of the film of the resonance mode in the soundproof cell 22*k* having the films of two layers. Also from FIG. 31, it can be seen that the sound wave transmitted through the film 18*i* of the soundproof cell 22*j* is inverted in phase and incident on the film 18*j*-2 of the soundproof cell 22*k* and is canceled by the sound wave transmitted through the film 18*j*-1 and accordingly the transmitted wave becomes small.

Table 5 summarizes the construction conditions of the soundproof structures of Examples 5 and 6. By appropriately setting the frame thickness, the layer structure, the frame size, and the film thickness of two types of soundproof cells as shown in Table 5, it is possible to realize a sound absorbance far beyond 50% in the soundproof structure of the present invention.

TABLE 5

| | Film thickness (mm) | First soundproof cell | First soundproof cell frame size (mm) | First soundproof cell film thickness (μm) | Second soundproof cell | Second soundproof cell frame size (mm) | Second soundproof cell film thickness (μm) |
|---|---|---|---|---|---|---|---|
| Example 5 | 15 | One layer (single layer) | 20 | 188 | Second layers | 20 | 100 |
| Example 6 | 10 | One layer (single layer) | 14 | 100 | Second layers | 20 | 100 |

Example 7

Figure 32:
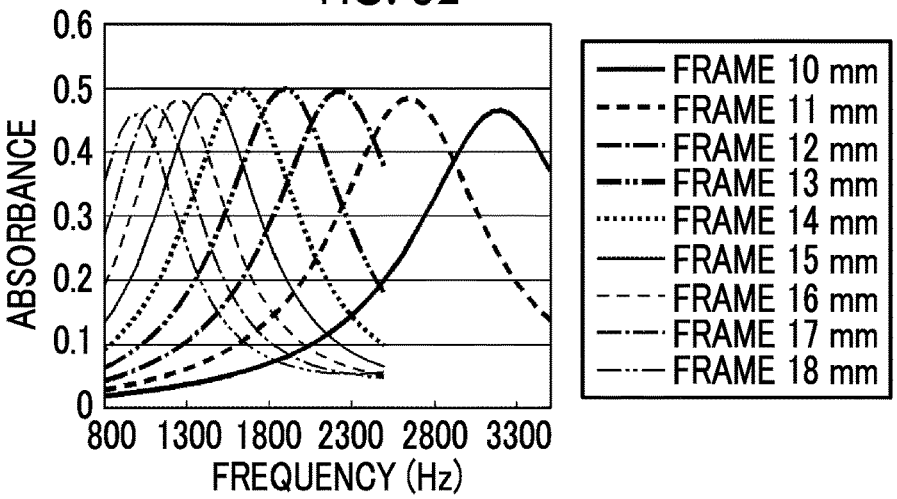
FIG. 32 is a graph showing sound absorption characteristics for different frame sizes of the first soundproof cells shown in FIG. 23.
Figure 33:
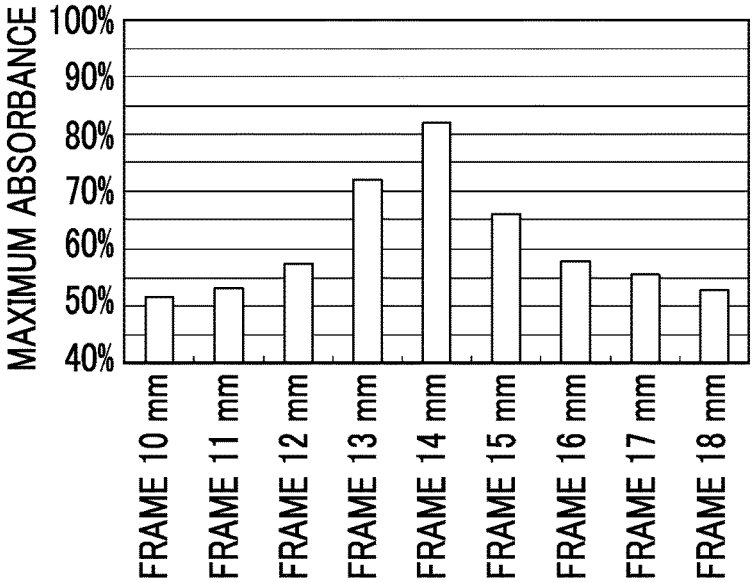
FIG. 33 is a graph showing the maximum absorbance of the soundproof structure shown in FIG. 23 that includes a first soundproof cell having each frame size shown in FIG. 32.

Next, a soundproof cell (first soundproof cell) was manufactured in a case where the frame size of the soundproof cell 22*j* of the soundproof structure 10*e* of Example 6 shown in FIG. 23 was changed in units of 1 mm in the range of 10 mm to 18 mm as shown in Table 6, and the first resonance frequency of each soundproof cell was calculated. In addition, as shown in FIG. 23, a soundproof structure in which the manufactured soundproof cell (first soundproof cell) and the manufactured soundproof cell (second soundproof cell) 22*k* were arranged adjacent to each other was manufactured, and the maximum sound absorbance was calculated. The results are shown in Table 6. FIG. 32 shows the absorption spectrum of each manufactured soundproof cell (first soundproof cell). FIG. 33 is a graph based on Table 6, which shows the relationship between the frame size of each soundproof cell (first soundproof cell) and the maximum sound absorbance of the soundproof structure in which each soundproof cell (first soundproof cell) and the soundproof cell (second soundproof cell) 22*k* are arranged adjacent to each other.

As shown in FIG. 32, in the soundproof structure including only the first soundproof cell, in a case where the frame size is 12 mm to 14 mm, the absorbance is approximately 50% that is the maximum. However, the absorbance is not increased exceeding 50%. In addition, it can be seen that, in a case where the frame size is 14 mm, the absorbance becomes the maximum 50% at the frequency of 1650 Hz.

TABLE 6

| Frame size (mm) | First resonance frequency (Hz) of first soundproof cell | Difference (deviation) from maximum absorption frequency (1650 Hz) | Maximum absorbance of first soundproof cell + second soundproof cell |
|---|---|---|---|
| 10 | 3200 | 1550 | 51.70% |
| 11 | 2650 | 1000 | 53.10% |
| 12 | 2200 | 550 | 57.50% |
| 13 | 1900 | 250 | 72.00% |
| 14 | 1650 | 0 | 82.00% |
| 15 | 1400 | −250 | 65.90% |
| 16 | 1250 | −400 | 57.90% |
| 17 | 1100 | −550 | 55.50% |
| 18 | 1000 | −650 | 52.90% |

As shown in FIG. 33 and Table 6, the maximum absorbance of 82% was confirmed in a soundproof structure, in which the soundproof cell (first soundproof cell) having a frame size of 14 mm and the second soundproof cell 22*k* were arranged adjacent to each other, of all the manufactured soundproof structures, and the first resonance frequency of the first soundproof cell was 1650 Hz. That is, this indicates that the higher order (second order) resonance frequency of the second soundproof cell 22*k* is also 1650 Hz.

Here, the difference (deviation) between the first resonance frequency of each manufactured first soundproof cell and the maximum absorption frequency at which the soundproof structure indicates the maximum absorbance, for example, 1650 Hz that is the higher order resonance frequency of the second soundproof cell, is shown in Table 6. In addition, the relationship between the difference between the first resonance frequency of the first soundproof cell of each manufactured soundproof structure and the higher order resonance frequency (1650 Hz) of the second soundproof cell soundproof structure, at which the soundproof structure indicates the maximum absorbance, and the maximum absorbance of each soundproof structure is shown in FIG. 34.

From Table 6, it could be seen that the sound absorption of 55% or more could be realized in a case where the difference (deviation) was within ±550 Hz (within ±⅓). In addition, it was found that the maximum sound absorbance of the soundproof structure decreased as the difference (deviation) increased.

Figure 34:
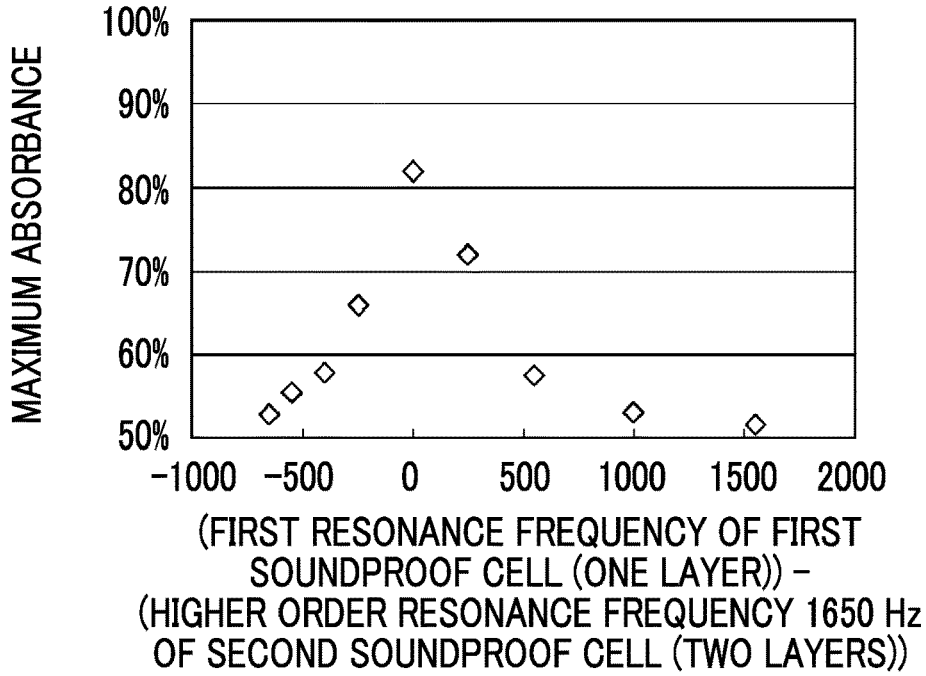
FIG. 34 is a graph showing the maximum absorbance of the soundproof structure shown in FIG. 23 at each difference between the first resonance frequency of the first soundproof cell and the higher order resonance frequency of a second soundproof cell.

From FIG. 34, it could be seen that the maximum sound absorbance of the soundproof structure is approximately symmetrical with respect to a maximum sound absorbance at which the difference (deviation) between the first resonance frequency of the first soundproof cell and the higher order resonance frequency of the second soundproof cell, at which the maximum absorbance of the soundproof structure was obtained, was "0" and that the absorbance increased as the difference (deviation) decreased.

As is apparent from the simulation results shown in FIGS. 6 to 9, 12, 18, and 19, the actual measurement results shown in FIGS. 10 to 16 and 17, and the simulation results shown in FIGS. 24, 26, 33, and 34, including Examples S1 to S6 of simulation and Examples 1 to 7 of experiments, in the soundproof structure of the present invention, unlike in Comparative Examples 1 and 2, two different first resonance frequencies due to two types of different soundproof cells having different effective hardnesses are provided, and a shielding peak where the transmission loss is a peak is present at the shielding peak frequency between the two first resonance frequencies. Therefore, it is possible to selectively insulate sound in a frequency band having a predetermined width centered on the shielding peak frequency.

In addition, as is apparent from the results of Examples 5 to 7 shown in FIGS. 24, 26, 33, and 34, in the soundproof structure of the present invention, by matching the first resonance frequency of one soundproof cell with the higher order resonance frequency of the other soundproof cell in a soundproof structure including two types of soundproof cells having different first resonance frequencies, a high absorbance that cannot be achieved in each soundproof cell can be achieved where the two frequencies match each other.

As described above, it could be seen that the soundproof structure of the present invention had excellent sound insulation characteristics capable of shielding a specific desired frequency component very strongly and could increase the absorption of components on the lower frequency side.

From the above, the effect of the soundproof structure of the present invention is obvious.

While the soundproof structure of the present invention has been described in detail with reference to various embodiments and examples, the present invention is not limited to these embodiments and examples, and various improvements or modifications may be made without departing from the scope and spirit of the present invention.

EXPLANATION OF REFERENCES

10, 10*a*, 10*b*, 10*c*, 10*d*, 10*e*: soundproof structure
12, 12*a*, 12*b*: through opening
14, 14*a*, 14*b*, 46, 50, 56: frame
15, 58*a*, 58*b*: frame member
16, 58: frame body
18, 18*a*, 18*b*, 18*c*, 18*d*, 18*e*, 18*f*, 18*g*, 18*h*, 18*i*, 18*j*: film
20, 20*a*, 20*b*: film body
22, 22*a*, 22*b*, 22*c*, 22*d*, 22*e*, 22*f*, 22*h*, 22*i*, 22*j*, 22*k*, 31*a*, 31*b*, 31*c*, 31*d*, 31*e*, 44, 48, 54: soundproof cell
24: through-hole

30*a*, 30*b*, 30*c*, 30*d*, 52: soundproof member
32: cover
34: hole
36, 40: detaching mechanism
38: wall
42*a*: protruding portion
42*b*: recessed portion

What is claimed is:

1. A soundproof structure, comprising:

a plurality of soundproof cells arranged in a two-dimensional manner, wherein each of the plurality of soundproof cells comprises a frame formed of a frame member forming an opening and a film fixed to the frame, end portions of the frame on both sides of the opening are not blocked, two or more types of soundproof cells having different first resonance frequencies are present in the plurality of soundproof cells, and a shielding peak frequency at which transmission loss is maximized is present within a range equal to or higher than a lowest frequency among first resonance frequencies of the soundproof cells and equal to or lower than a highest frequency among the first resonance frequencies of the soundproof cells.

2. The soundproof structure according to claim 1, wherein the first resonance frequency is determined by a geometric form of the frame of each soundproof cell and stiffness of the film of each soundproof cell, there are one or more shielding peak frequencies, and each shielding peak frequency is set to a frequency between the two different first resonance frequencies adjacent to each other.

3. The soundproof structure according to claim 1, wherein two or more different first resonance frequencies among the first resonance frequencies of the plurality of soundproof cells are included within a range of 10 Hz to 100000 Hz.

4. The soundproof structure according to claim 1, wherein, assuming that a circle equivalent radius of the frame is R (m), a thickness of the film is t (m), a Young's modulus of the film is E (Pa), and a density of the film is d (kg/m$^3$), a parameter B expressed by following Equation (1) for each of the two or more types of soundproof cells having the different first resonance frequencies is 15.47 or more and $2.350\times10^5$ or less, $$B=t/R^2*\sqrt{(E/d)} \quad (1).$$

5. The soundproof structure according to claim 1, wherein an average size of the frames of the plurality of soundproof cells is equal to or less than a wavelength size corresponding to the shielding peak frequency.

6. The soundproof structure according to claim 1, wherein the two or more types of soundproof cells having the different first resonance frequencies have the two or more types of films having different film thicknesses.

7. The soundproof structure according to claim 1, wherein the two or more types of soundproof cells having the different first resonance frequencies have the two or more types of frames having different frame sizes.

8. The soundproof structure according to claim 1, wherein the two or more types of soundproof cells having the different first resonance frequencies have the two or more types of films having different tensions.

9. The soundproof structure according to claim 6, wherein the two or more types of soundproof cells having the different first resonance frequencies are formed of the films of the same kind of film material.

10. The soundproof structure according to claim 1, wherein the two or more types of soundproof cells having the different first resonance frequencies have the two or more types of films using different film materials.

11. The soundproof structure according to claim 1, wherein a region where the soundproof cells having the same first resonance frequency are continuous is less than a wavelength at the shielding peak frequency.

12. The soundproof structure according to claim 1, wherein the film of each of the plurality of soundproof cells has one or more through-holes the film.

13. The soundproof structure according to claim 1, wherein the plurality of soundproof cells have a first soundproof cell and a second soundproof cell having the different first resonance frequencies, and a first resonance frequency of the first soundproof cell and a higher order resonance frequency of the second soundproof cell match each other.

14. The soundproof structure according to claim 13, wherein, in a case where the first resonance frequency of the first soundproof cell and the higher order resonance frequency of the second soundproof cell match each other, the soundproof structure comprising the first soundproof cell and the second soundproof cell shows a maximum absorbance, and the first resonance frequency of the first soundproof cell and the higher order resonance frequency of the second soundproof cell match each other means that a difference between the first resonance frequency of the first soundproof cell and the higher order resonance frequency of the second soundproof cell is within ±⅓ of the higher order resonance frequency of the second soundproof cell.

15. The soundproof structure according to claim 13, wherein the first soundproof cell has a film of one layer covering an opening, and the second soundproof cell has films of a plurality of layers each covering an opening.

16. The soundproof structure according to claim 15, wherein the second soundproof cell has films of two layers, and the higher order resonance frequency of the second soundproof cell is a resonance frequency of a resonance mode in which displacements of the films of the two layers of the second soundproof cell occur in opposite directions.

17. The soundproof structure according to claim 13, wherein a frame size or a frame thickness of the frame of each of the plurality of soundproof cells is a size less than ¼ of a wavelength of a sound wave.

18. The soundproof structure according to claim 13, wherein the second soundproof cell has films of a plurality of layers each covering an opening, and a distance between adjacent films among the films of the plurality of layers is a size less than ¼ of a wavelength of a sound wave.

* * * * *